US008699958B2

(12) United States Patent
Ida

(10) Patent No.: US 8,699,958 B2
(45) Date of Patent: Apr. 15, 2014

(54) WIRELESS COMMUNICATION DEVICE AND RADIATION DIRECTIVITY ESTIMATING METHOD

(75) Inventor: Ichirou Ida, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 583 days.

(21) Appl. No.: 12/758,318

(22) Filed: Apr. 12, 2010

(65) Prior Publication Data

US 2010/0279607 A1 Nov. 4, 2010

(30) Foreign Application Priority Data

May 1, 2009 (JP) ..... 2009-112127

(51) Int. Cl.
*H04B 17/00* (2006.01)
*H03C 1/62* (2006.01)
*H04M 1/00* (2006.01)

(52) U.S. Cl.
USPC ..... 455/67.11; 455/550.1; 455/115.1

(58) Field of Classification Search
USPC ..... 455/423, 41.1, 41.2, 63.1, 66.1, 67.11, 455/67.13, 550.1, 100, 115.1
See application file for complete search history.

(56) References Cited

U.S. PATENT DOCUMENTS

| | | | | |
|---|---|---|---|---|
| 2002/0034967 | A1* | 3/2002 | Taniguchi et al. | 455/562 |
| 2003/0210203 | A1 | 11/2003 | Phillips et al. | |
| 2007/0024293 | A1* | 2/2007 | Kosaka et al. | 324/750 |
| 2007/0285322 | A1* | 12/2007 | Nyshadham et al. | 343/703 |
| 2008/0111748 | A1 | 5/2008 | Dunn et al. | |
| 2011/0116392 | A1* | 5/2011 | Barriac et al. | 370/252 |
| 2011/0158291 | A1* | 6/2011 | Aytur et al. | 375/137 |

FOREIGN PATENT DOCUMENTS

| | | |
|---|---|---|
| JP | 2001-102844 | 4/2001 |
| JP | 2002-100917 | 4/2002 |
| JP | 2002-185391 | 6/2002 |
| JP | 2006-222798 | 8/2006 |
| JP | 2007-78482 | 3/2007 |

OTHER PUBLICATIONS

European Search Report dated Aug. 26, 2010, from the corresponding European Application.

* cited by examiner

*Primary Examiner* — Andrew Wendell
(74) *Attorney, Agent, or Firm* — Katten Muchin Rosenman LLP

(57) ABSTRACT

A wireless communication device includes a circuit board to include an antenna element, an estimating unit to estimate a current distribution in at least a partial area on the circuit board, which is induced by power feeding to the antenna element, and a specifying unit to specify a radiation pattern associated with the current distribution estimated by the estimating unit as a radiation directivity of the circuit board.

10 Claims, 42 Drawing Sheets

FIG. 5

| CURRENT DISTRIBUTION PATTERN | CORRELATION OF DETECTED CURRENT VALUES | RADIATION DIRECTIVITY | DIRECTIVITY CODE |
|---|---|---|---|
| 1 | A≒B≒C | RADIATIONS AT APPROXIMATELY SAME LEVEL OF INTENSITY IN ± X DIRECTIONS AND IN ± Y DIRECTIONS, RESPECTIVELY. (NO CHANGE FROM INITIAL STATE) | 001 |
| 2 | A≒B≒C (ABSOLUTE VALUE:SMALL) | RADIATIONS AT APPROXIMATELY SAME LEVEL OF INTENSITY IN ± X DIRECTIONS AND IN ± Y DIRECTIONS, RESPECTIVELY. RADIATIONS SHOW BIAS IN - Y DIRECTION AND ARE WEAK ON WHOLE. | 010 |
| 3 | A≒C>B | STRONG RADIATIONS IN + Y DIRECTION. | 011 |
| 4 | A>B≒C | STRONG RADIATIONS IN - X DIRECTION. | 100 |
| 5 | A≒B<C | STRONG RADIATIONS IN + X DIRECTION. | 101 |

A: DETECTED CURRENT VALUE OF CURRENT SENSOR 31 (#1)
B: DETECTED CURRENT VALUE OF CURRENT SENSOR 31 (#2)
C: DETECTED CURRENT VALUE OF CURRENT SENSOR 31 (#3)

FIG. 22

| CURRENT DISTRIBUTION PATTERN | CORRELATION OF DETECTED CURRENT VALUES | RADIATION DIRECTIVITY | DIRECTIVITY CODE |
|---|---|---|---|
| 1 | B<C<D | RADIATIONS AT APPROXIMATELY SAME LEVEL OF INTENSITY IN DIRECTION OF 45-DEGREES AND OPPOSITE DIRECTION (225 DEGREES) (NO CHANGE FROM INITIAL STATE). | 001 |
| 2 | A>B | STRONG RADIATIONS IN + X DIRECTION. | 010 |
| 3 | B≒C≒D | STRONG RADIATIONS IN − X DIRECTION. | 011 |
| 4 | B≒C≪D | STRONG RADIATIONS IN + Y DIRECTION. | 100 |
| 5 | B<C≒D | STRONG RADIATIONS IN − Y DIRECTION. | 101 |
| 6 | B≒C<D (ABSOLUTE VALUE:LARGE) | RADIATIONS AT APPROXIMATELY SAME LEVEL OF INTENSITY IN DIRECTION OF 45-DEGREES AND OPPOSITE DIRECTION (225 DEGREES). WHOLE RADIATIONS ARE EXTREMELY WEAK. | 110 |

A: DETECTED CURRENT VALUE OF CURRENT SENSOR 31 (#1)
B: DETECTED CURRENT VALUE OF CURRENT SENSOR 31 (#2)
C: DETECTED CURRENT VALUE OF CURRENT SENSOR 31 (#3)
D: DETECTED CURRENT VALUE OF CURRENT SENSOR 31 (#4)

FIG. 38

| CURRENT DISTRIBUTION PATTERN | CORRELATION OF DETECTED CURRENT VALUES | RADIATION DIRECTIVITY | DIRECTIVITY CODE |
|---|---|---|---|
| 1 | A≒C<B | RADIATIONS AT APPROXIMATELY SAME LEVEL OF INTENSITY IN ± X DIRECTIONS AND IN ± Y DIRECTIONS, RESPECTIVELY (NO CHANGE FROM INITIAL STATE). | 001 |
| 2 | A≒B≒C | STRONG RADIATIONS IN − X DIRECTION. | 010 |
| 3 | A<B≒C | STRONG RADIATIONS IN + Y DIRECTION. | 011 |
| 4 | A≒B>C | STRONG RADIATIONS IN − Y DIRECTION. | 100 |

A: DETECTED CURRENT VALUE OF CURRENT SENSOR 31 (#1)
B: DETECTED CURRENT VALUE OF CURRENT SENSOR 31 (#2)
C: DETECTED CURRENT VALUE OF CURRENT SENSOR 31 (#3)

WIRELESS COMMUNICATION DEVICE AND RADIATION DIRECTIVITY ESTIMATING METHOD

CROSS-REFERENCE TO RELATED APPLICATIONS

This application is based upon and claims the benefit of priority of the prior Japanese Patent Application No. 2009-112127, filed on May 1, 2009, the entire contents of which are incorporated herein by reference.

FIELD

The present invention relates to a technology of estimating a radiation directivity.

BACKGROUND

A near-distance wireless communication network configured by a sensor device which acquires biometric information and a gateway device which collects pieces of biometric information from the sensor device and transmits the biometric information to another network, is called a body area network (BAN). With utilization of this BAN, it is feasible to realize an application which improves the efficiency of an inspection at a medical institution or enriches health management outside the medical institution by measuring the biometric information such as heart beats and a body temperature at all times.

As communication methods used for the BAN system, there exist a method of utilizing electromagnetic waves propagated in the air spaced away from the living body, a method of using the electromagnetic waves propagated along the surface of the living body, and so on.

In the wireless communication system which uses a spatial transmission path as in the BAN, there is a case where a human body as an obstacle might largely affect a wireless environment. Such being the case, some methods for avoiding this problem are disclosed (refer to Patent documents 1 through 4 given below).

[Patent document 1] Japanese Laid-open Patent Publication No. 2002-100917

[Patent document 2] Japanese Laid-open Patent Publication No. 2001-102844

[Patent document 3] Japanese Laid-open Patent Publication No. 2002-185391

[Patent document 4] Japanese Laid-open Patent Publication No. 2007-78482

SUMMARY

The sensor device in the BAN system is fixed onto the living body or in the vicinity of the living body (e.g., several meters from the living body) in many cases, and hence a part of the living body such as an arm and a foot might become an obstacle against the electromagnetic waves radiated from the sensor device. If the obstacle such as the arm gets close to the sensor device, there is a case in which a radiation directivity of the electromagnetic waves transmitted from the sensor device changes, and a communication characteristic declines. In this case, such a possibility arises that a device like a gateway device for collecting the biometric information from other sensor devices can not properly collect the biometric information acquired by other sensor devices.

In order to avoid this problem, the conventional sensor device, in the case of detecting that the transmitted biometric information does not correctly reach a communication partner device, repeats retransmission thereof. This method, however, leads to an increase in power consumption of the sensor device and a shortened life-span of a power source such as a cell and a battery. These problems have a possibility of causing a situation in which the sensor device is disabled from transmitting urgent information, though this urgent information has been acquired, due to run-down of the cell.

Each aspect of the present disclosure adopts the following configuration in order to solve the problems given above.

In a first aspect, a wireless communication device includes: a circuit board to include an antenna element; an estimating unit to estimate a current distribution in at least a partial area on the circuit board, which is induced by power feeding to the antenna element; and a specifying unit to specify a radiation pattern associated with the current distribution estimated by the estimating unit as a radiation directivity of the circuit board.

Another mode of the present disclosure may also be a radiation directivity estimating method by which any one of the processes described above is executed.

The object and advantages of the embodiment will be realized and attained by means of the elements and combinations particularly pointed out in the claims.

It is to be understood that both the foregoing general description and the following detailed description are exemplary and explanatory and are not restrictive of the embodiment, as claimed.

BRIEF DESCRIPTION OF THE DRAWINGS

FIG. 5 is a diagram illustrating an example of the association between a detected current and a radiation directivity;

FIG. 22 is a diagram illustrating an example of the association between the detected current and the radiation directivity in the third working example;

FIG. 38 is a diagram illustrating an example of the association between the detected current and the radiation directivity in the fourth working example;

DESCRIPTION OF EMBODIMENTS

A sensor device in an embodiment will hereinafter be described with reference to the drawings in a way that gives a specific example. The following working examples will exemplify the sensor device applied to a BAN system, however, the sensor device in the embodiment does not limit a system etc to be utilized. Further, the working examples given below will exemplify the sensor device, however, a wireless communication device, which includes only a wireless communication function without a sensing function, is also available. Configurations in the respective working examples that will hereinafter be described are exemplifications, and the embodiment is not limited to the configurations in the following working examples.

First Working Example

Figure 1:
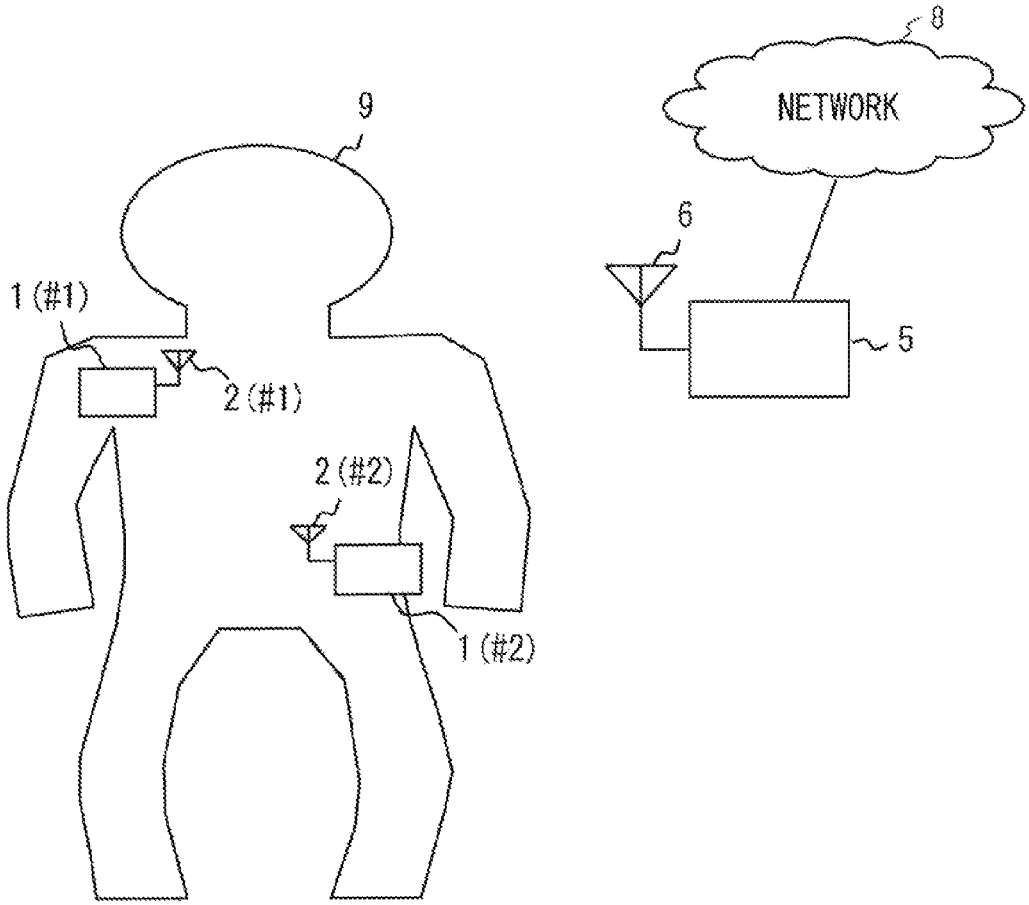
FIG. 1 is a diagram illustrating an example of an architecture of a BAN system.

The sensor device in a first working example will hereinafter be described. The sensor device in the first working example is applied to the BAN system as illustrated in FIG. 1. FIG. 1 is a view depicting an example of an architecture of the BAN system.

The BAN system includes sensor devices 1 (#1 and #2), a gateway device 5, etc. The sensor device 1 is fitted to a living body 9 and measures, e.g., biometric information. The sensor devices 1 (#1 and #2), which include antennas 2 (#1 and #2), perform wireless communications with the gateway device 5 via an air space as a transmission path. The sensor devices 1 (#1 and #2) transmit the measured biometric information to the gateway device 5 through the wireless communications. The sensor devices 1 (#1 and #2) may perform the wireless communications with each other. The sensor devices will hereinafter be marked with the symbols (#1 and #2) only when required to distinguish between these plural devices.

The gateway device 5 performs the wireless communications with the sensor device 1 through the air space as the transmission path. The gateway device 5 is, e.g., installed in a position spaced away from the living body 9 in a wireless-communication-enabled range with the sensor device 1. The gateway device 5 transmits the pieces of biometric information collected from the sensor device 1 to a network 8 etc. It should be noted that the embodiment does not limit the information (biometric information etc) dealt with in the BAN system.

[Configuration of Device]

Figure 2:
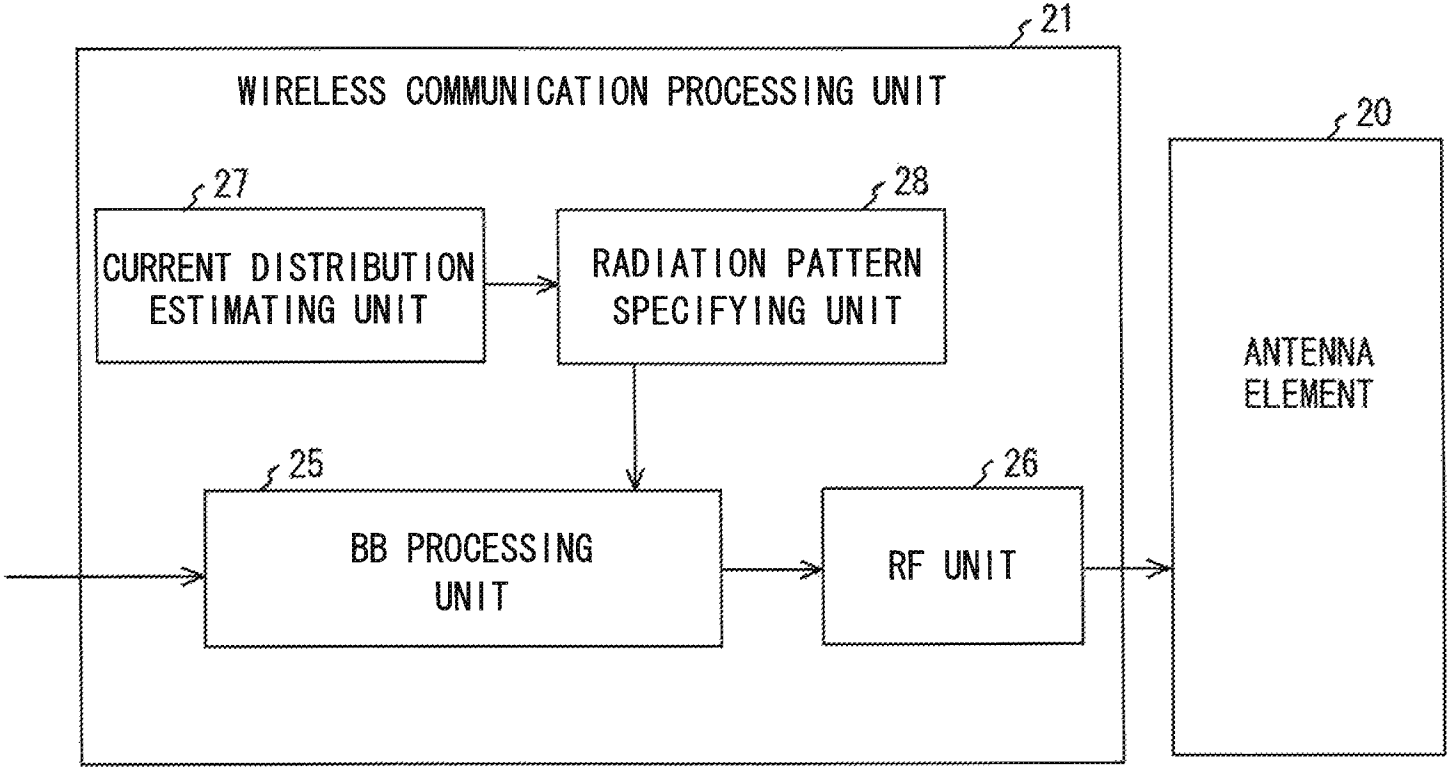
FIG. 2 is a diagram illustrating a configuration of a wireless communication processing unit in a sensor device 1 in a first working example.

FIG. 2 is a diagram illustrating a configuration of a wireless communication processing unit of the sensor device 1 in the first working example. The sensor device 1 in the first working example includes a wireless communication processing unit 21 as a part of components thereof. The sensor device 1 does not restrict processes (a biometric information sensing process etc) other than the wireless communication process held by the sensor device 1, and hence the description of the embodiment does not extend to other processes.

An antenna element 20 is fixed onto a circuit board. The antenna element 20 radiates high-frequency signals transmitted from the wireless communication processing unit 21. Further, the antenna element 20 receives the signals propagated through the air space, and transmits the received signals to the wireless communication processing unit 21.

The wireless communication processing unit 21 generates the high-frequency signals for carrying transmission information and transmits the generated high-frequency signals to the antenna element 20. On the other hand, the wireless communication processing unit 21 processes the signals received by the antenna element 20, then extracts reception information from within these received signals and transmits the extracted reception information to other processing units unillustrated. The wireless communication processing unit 21 includes a baseband processing unit (which will hereinafter be abbreviated to a BB processing unit) 25, a wireless unit (which will hereinafter be referred to as a RF (Radio Frequency) unit) 26, a current distribution estimating unit 27 and a radiation pattern specifying unit 28.

The BB processing unit 25 executes a baseband process. The BB processing unit 25 receives the transmission information from other processing units unillustrated, then encodes the transmission information, converts the transmission information into baseband signals by coding, modulating, etc., and transmits the thus-converted baseband signals to the RF unit 26. The transmission information is, e.g., the biometric information (on a blood pressure, a body temperature, etc) collected from (the sensor devices 1 fitted to) the living body 9.

On the other hand, in the case of receiving the baseband signals corresponding to the signals received by the antenna element 20, the BB processing unit 25 demodulates and decodes the baseband signals, thereby obtaining the reception information from the baseband signals. If the reception signal is an ACK (reception acknowledgment) signal, the reception information is, e.g., information representing the reception acknowledgment. Further, the reception information may also be the biometric information described above. The thus-acquired reception information is transmitted to other processing units unillustrated.

The RF unit 26 receives the baseband signal from the BB processing unit 25 and converts this baseband signal into the high-frequency signal having a predetermined frequency. The RF unit 26, after amplifying the thus-converted high-frequency signal up to a predetermined level of electric power, transmits the amplified signal to the antenna element 20. On the other hand, the RF unit 26, when receiving the reception signal from the antenna element 20, amplifies this reception signal while reducing noises. The RF unit 26 converts the thus-amplified reception signal into the baseband signal, and transmits this baseband signal to the BB processing unit 25.

When supplying the power to a feeding point of the antenna element 20, the high-frequency current is also induced on the circuit board onto which the antenna element 20 is fixed. The current distribution estimating unit 27 estimates a current distribution of at least a partial area on the circuit board onto which the antenna element 20 is fixed. The embodiment does not restrict the estimation range of the current distribution estimated by the current distribution estimating unit 27. The current distribution estimating unit 27 transmits the information on the estimated current distribution to the radiation pattern specifying unit 28.

The current distribution on the circuit board changes corresponding to a change in radiation directivity of the circuit board including the antenna element 20. The radiation directivity of the circuit board including the antenna element 20 changes, for instance, when an obstacle exists in the vicinity of the sensor device 1 including the circuit board. The sensor device 1 in the first working example is fitted to the living body 9, and hence a part like an arm etc of the living body 9 and another living body located close to the living body 9 might become the obstacles.

The radiation pattern specifying unit 28 specifies, as the present radiation directivity, a radiation pattern, which corresponds to the current distribution estimated by the current distribution estimating unit 27, of the circuit board including the antenna element. For example, the radiation pattern specifying unit 28 retains an associative relation between each pattern of the current distribution on the circuit board and each radiation pattern, and determines, as the present radiation pattern, the radiation pattern associated with the current distribution pattern transmitted from the current distribution estimating unit 27 by use of this associative relation. The radiation pattern specifying unit 28 transmits the information representing the thus-specified radiation pattern to the BB processing unit 25.

As described above, the sensor device 1 in the first working example estimates the current distribution of at least the partial area on the circuit board including the antenna element, and specifies the present radiation pattern associated with the current distribution on the circuit board. If the obstacle exists in the vicinity of the circuit board of the sensor device 1, the radiation pattern of the circuit board changes. From this change, the sensor device 1 in the first working example specifies the radiation pattern as described above, whereby the change in radiation directivity corresponding to the obstacle can be detected.

Accordingly, the sensor device 1 can take some kind of measure for avoidance without performing the futile retransmission if a radiation characteristic declines. This measure for avoidance may be such that another sensor device 1 existing in a direction with a stronger sensitivity based on the present radiation directivity specified relays the desired information to the gateway device 5, and may also be a measure of waiting till the radiation directivity is restored.

Therefore, according to the first working example, the futile retransmission can be reduced by detecting the change in radiation directivity, which corresponds to the obstacle, and, by extension, it is feasible to decrease power consumption required for the futile wireless transmission. Moreover, according to the first working example, the wireless-communication-disabled status can be avoided by taking the avoidance measure using the specified radiation directivity.

The sensor device 1 in the first working example may include a current detecting unit which detects the current on the circuit board including the antenna element 20. With this configuration, the current distribution estimating unit 27 described above may estimate, as the present current distribution, any one of the plurality of previously-retained current distribution patterns on the circuit board by use of the current value detected by the current detecting unit. According to the specific example such as this, the current distribution is estimated based on the current value on the actual circuit board, thereby enabling the current distribution to be estimated more accurately.

In this case, the radiation pattern specifying unit 28 can specify, as the radiation directivity of the circuit board, the radiation pattern associated with the current distribution estimated by the current distribution estimating unit 27 in the plurality of radiation patterns associated respectively with the plurality of previously-retained current distribution patterns on the circuit board.

Second Working Example

The sensor device 1 in a second working example will hereinafter be described.

[Configuration of Device]

Figure 3:
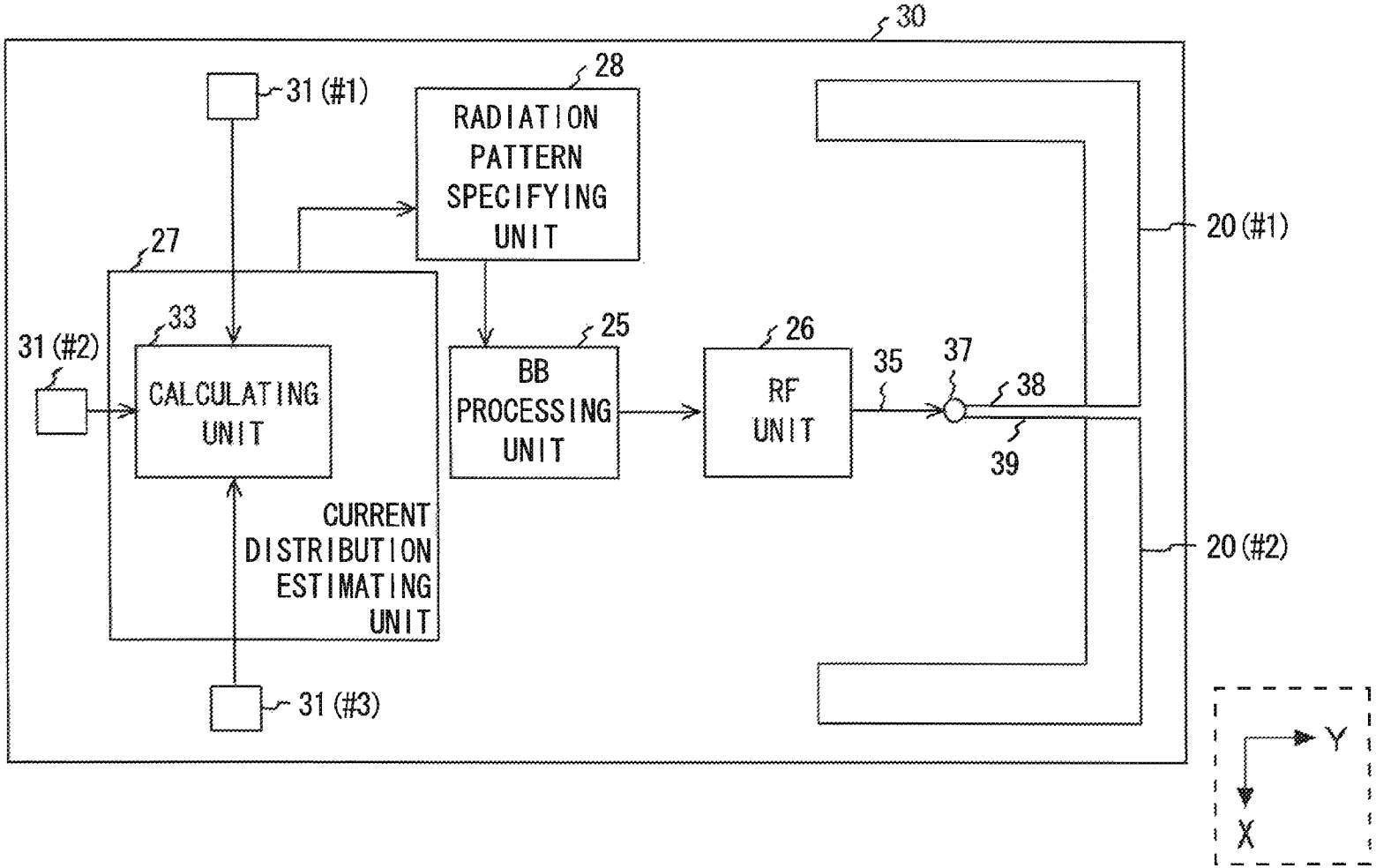
FIG. 3 is a diagram illustrating an example of a partial configuration of the sensor device 1 in a second working example.

FIG. 3 is a diagram illustrating an example of a partial configuration of the sensor device 1 in the second working example. The sensor device 1 in the second working example partially includes the antenna elements 20 (#1 and #2), the BB processing unit 25, the RF unit 26, the current distribution estimating unit 27, the radiation pattern specifying unit 28, current sensors 31 (#1, #2 and #3), a calculating unit 33, etc. Among these components, the antenna elements 20 (#1 and #2) and the current sensors 31 (#1, #2 and #3) are fixed to positions as illustrated in FIG. 3 on a circuit board 30. Hereafter, the description of the positions of the antenna elements 20 and the positions of the current sensors 31 on the circuit board 30 involves using an X-axis and Y-axis depicted in FIG. 3.

The BB processing unit 25, the RF unit 26, the current distribution estimating unit 27, the radiation pattern specifying unit 28 and the calculating unit 33 are individually realized by software components or hardware components or combinations of these components (refer to Item [Others]). FIG. 3 does not illustrate installation positions of the BB processing unit 25, the RF unit 26, the current distribution estimating unit 27, the radiation pattern specifying unit 28 and the calculating unit 33.

On the circuit board 30, electronic devices such as a transistor, a capacitor, a resistor, an IC (Integrated circuit) and an LSI (Large Scale Integration) are fixed and connected to each other by use of wires. The second working example exemplifies a laminated circuit board 30, of which upper and lower surfaces each take a rectangular shape. FIG. 3 illustrates the upper surface of the circuit board 30. Note that the embodiment does not restrict a structure, a form, etc of the circuit board 30.

Each of the antenna elements 20 (#1 and #2) is an L-shaped conductor and takes a form of a dipole antenna. The antenna elements 20 (#1 and #2) in the second working example are, as illustrated in FIG. 3, fitted to an edge area of the upper surface of the circuit board 30 in a +Y direction along the Y-axis (a longitudinal direction) so that the antenna elements 20 are symmetric with respect to the center of the circuit board 30 along the X-axis (a lateral (widthwise) direction). One end of each of the antenna elements 20 (#1 and #2) is connected to a feeding point 37 via a feeder line 38 or 39. The antenna elements 20 (#1 and #2) are each supplied with the electricity from the feeding point 37.

Figure 4:
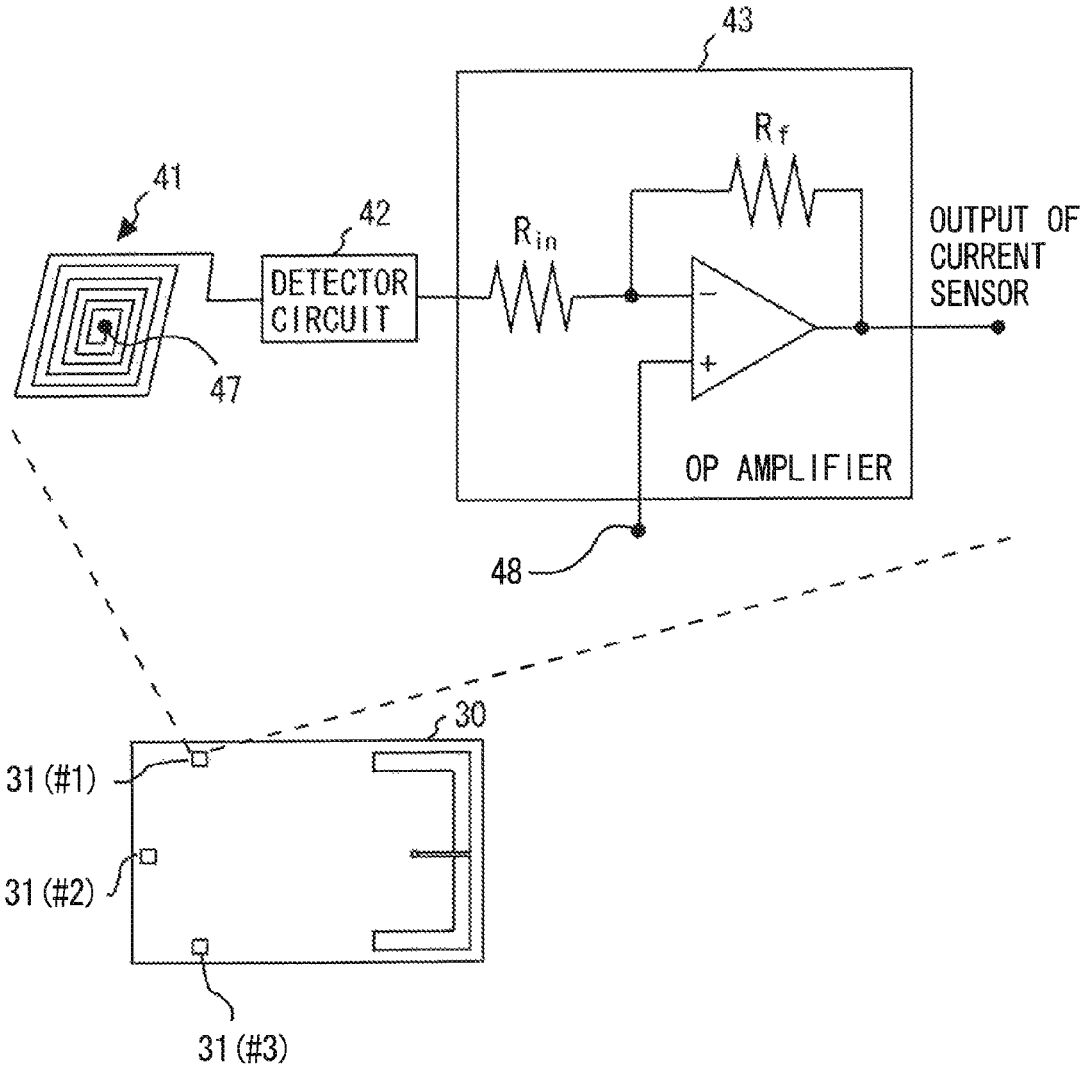
FIG. 4 is a diagram illustrating an example of a configuration of a current sensor 31 in the second working example.

Each of the current sensors 31 (#1, #2 and #3) detects the high-frequency current in each position, as illustrated in FIG. 3, on the upper surface of the circuit board 30, and transmits each detected current value to the current distribution estimating unit 27. FIG. 4 is a diagram illustrating an example of a configuration of the current sensor 31 in the second working example.

The current sensor 31 includes a current probe 41, a detector circuit 42, an amplifier circuit 43, etc. The current probe 41 is fixed by printing etc to a predetermined surface position on the upper surface of the circuit board 30. Note that fitting positions of the respective current sensors 31 (#1, #2 and #3) will be described later on. When the high-frequency current flows around the fitting position of the current sensor 31, an AC voltage is generated at the current probe 41, and the detector circuit 42 converts this AC voltage into a DC voltage. The amplifier circuit 43 amplifies the thus-converted DC voltage, and the amplified voltage is output. An output voltage value from each current sensor 31 corresponds to each detected current value.

It is to be noted that the amplifier circuit 43 illustrated in FIG. 3 is a general type of inverting amplifier circuit and includes resistors 44 and 45, an operational amplifier 46, etc. A plus input terminal 48 of the operational amplifier 46 of the amplifier circuit 43 and one end 47 of the current probe 41 are connected to the ground (GND) provided on the undersurface of the circuit board 30.

The current distribution estimating unit 27 includes the calculating unit 33. The calculating unit 33 receives the respective output voltages of the current sensors (#1, #2 and #3), and calculates a relation of magnitude between the respective output voltages, a difference absolute value of each output voltage from other output voltages and each output voltage value, respectively. The relation of magnitude between the respective output voltages, the difference absolute value of each output voltage from other output voltages and each output voltage value, which are herein calculated, correspond to a relation of magnitude between the respective detected current values, a difference absolute value of each detected current value from other detected current values and each detected current value. The calculating unit 33 includes, for calculating these items of information, e.g., an absolute value circuit, a subtractor and a comparator.

The current distribution estimating unit 27, upon receiving the relation of magnitude between the respective output voltages, the difference absolute value of each output voltage from other output voltages and each output voltage value from the calculating unit 33, determines which pattern in the plurality of previously-retained current distribution patterns corresponds to the correlation of these detected current values. In the second working example, the current distribution estimating unit 27 previously retains five patterns illustrated in FIG. 5 with respect to the correlation of the detected current values. The current distribution estimating unit 27 determines which pattern in the five current distribution patterns illustrated in FIG. 5 corresponds to the correlation of the detected current values.

FIG. 5 is a diagram illustrating an example of an associative relation between the detected current and the radiation directivity. In FIG. 5, the symbol "A" represents the detected current value of the current sensor 31 (#1), "B" designates the detected current value of the current sensor 31 (#2), and "C" stands for the detected current value of the current sensor 31 (#3).

According to the example in FIG. 5, a current distribution pattern 1 represents a relation in which the respective differences between A, B and C fall within a predetermined value. A current distribution pattern 2 represents a relation in which the respective differences between A, B and C fall within the predetermined value, and each current value is smaller than the current distribution pattern 1. A current distribution pattern 3 represents a relation in which the difference between A and C falls within the predetermined value, and A and C are larger than B to such a degree that a difference between A and B and a difference between C and B exceed the predetermined value. A current distribution pattern 4 represents a relation in which the difference between B and C falls within the predetermined value, and A is larger than B and C to such a degree that a difference between A and B and a difference A and C exceed the predetermined value. A current distribution pattern 5 represents a relation in which the difference between A and B falls within the predetermined value, and C is larger than A and B to such a degree that a difference between C and A and a difference between C and B exceed the predetermined value. It should be noted that the predetermined value used for the approximate determination in the current distribution pattern depends on accuracy of the current value detected by the current sensor 31, and hence, if this accuracy is low, the predetermined value may not be used.

Thus, the current distribution estimating unit 27 in the second working example uses the results of the comparisons between the respective current values detected by the current sensors 31 (#1, #2 and #3) to thereby estimate the current distributions at that time. The current distribution patterns 1-5 illustrated in FIG. 5 correspond to current distributions estimated by the current distribution estimating unit 27.

The radiation pattern specifying unit 28 acquires directivity codes associated with the current distribution patterns estimated by the current distribution estimating unit 27. According to the example in FIG. 5, the directivity code is expressed by a 3-bit code. In the case of the current distribution pattern 1, the directivity code thereof is expressed by [001]. In the case of the current distribution pattern 2, the directivity code thereof is expressed by [010]. In the case of the current distribution pattern 3, the directivity code thereof is expressed by [011]. In the case of the current distribution pattern 4, the directivity code thereof is expressed by [100]. In the case of the current distribution pattern 5, the directivity code thereof is expressed by [101].

The respective directivity codes, as illustrated in FIG. 5, represent the following radiation patterns. The radiation pattern specified by the directivity code [001] of the current distribution pattern 1 has a characteristic that the signals are radiated at approximately the same level of intensity in +X direction and −X direction, and also in +Y direction and −Y direction, respectively. The radiation pattern specified by the directivity code [010] of the current distribution pattern 2 has a characteristic that the signals are radiated at approximately the same level of intensity in the +X direction and the −X direction, and also in the +Y direction and the −Y direction, respectively, however, the radiations have a bias in the −Y direction and are weaker on the whole than the current distribution pattern 1. The radiation pattern specified by the directivity code [011] of the current distribution pattern 3 has a characteristic that the signals are radiated strongly in the +Y direction. The radiation pattern specified by the directivity code [100] of the current distribution pattern 4 has a characteristic that the signals are radiated strongly in the −X direction. The radiation pattern specified by the directivity code [101] of the current distribution pattern 5 has a characteristic that the signals are radiated strongly in the +X direction. The radiation pattern specifying unit 28 transmits the acquired directivity code to the BB processing unit 25.

The BB processing unit 25 generates, similarly to the first working example, the baseband signal for carrying the transmission information, and generates the baseband signal for carrying the directivity code sent from the radiation pattern specifying unit 28. The BB processing unit 25 transmits the thus-generated baseband signals to the RF unit 26.

The process of the RF unit 26 is the same as in the first working example. The RF unit 26 converts the baseband signals transmitted from the BB processing unit 25 into the high-frequency signals, and transmits the high-frequency signals to a feeder line 35. The RF unit 26 is connected via this feeder line 35 to the feeding point 37. The high-frequency signals transmitted from the RF unit 26 are further transmitted to the antenna element 20 from the feeding point 37.

Note that the BB processing unit 25 described above executes the baseband process for wirelessly transmitting the directivity code but may switch over a transmitting destination node corresponding to the directivity code. For example, a transmitting destination node ID set in a transmission packet (frame) may be switched over to a node ID of another sensor device from the gateway device 5. With this switchover, even when the directivity changes corresponding to the obstacle, the desired information can be transferred to the gateway device 5 via another sensor device.

[Method of Determining Position of Current Sensor]

As described above, it is desirable that each of the current sensors 31 (#1, #2 and #3) is disposed in a position enabling the current distribution to be detected, which corresponds to the change in radiation directivity due to the obstacle. One example of a method of determining the position of the current sensor 31 will hereinafter be explained.

In this example, a relation between the current distribution on the circuit board 30 and the radiation pattern on the circuit board 30 including the antenna element 20 at that time, is grasped beforehand by electromagnetic field simulation. The electromagnetic field simulation involves utilizing a general type of electromagnetic analysis using a method of moment, an FDTD (Finite-Difference Time-Domain) method, etc. Incidentally, another available method, which does not use the simulation such as this, is that the electricity is actually supplied to the antenna element 20, and the current thus induced on the circuit board 30 is measured.

Figure 6:
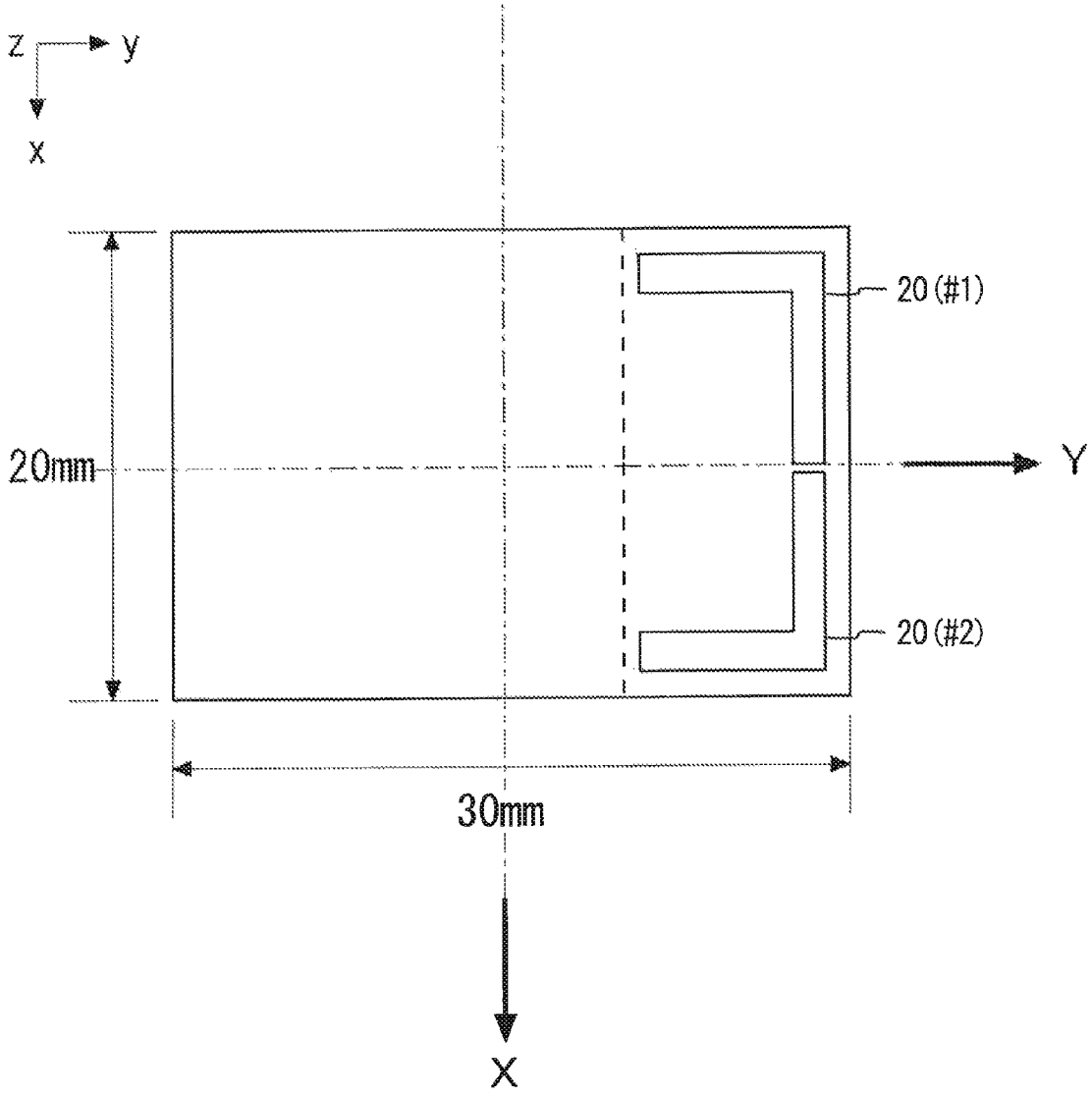
FIG. 6 is a diagram illustrating the sensor device 1 in the second working example as an analytic model.
Figure 7:
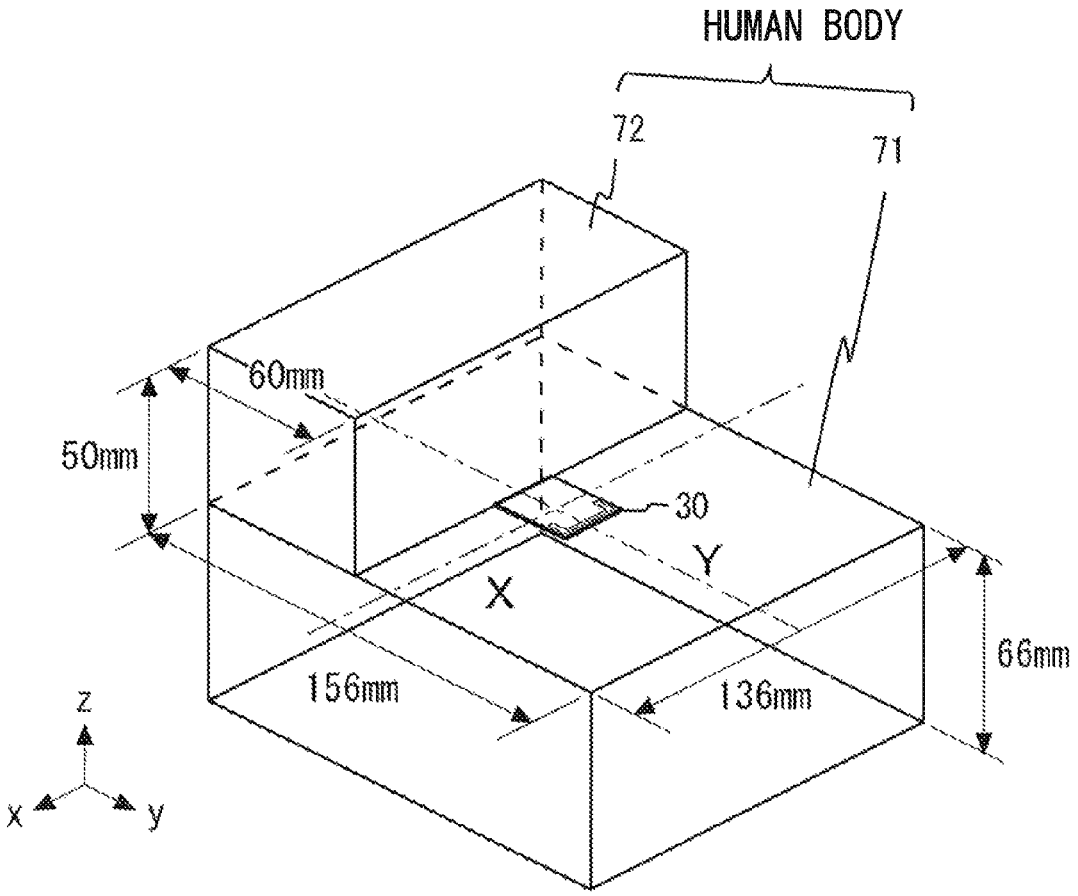
FIG. 7 is a diagram illustrating a whole image of the analytic model in an electromagnetic field simulation.

In this electromagnetic field simulation, the change in current distribution on the circuit board 30 and the change in radiation directivity when a lossy body (obstacle) such as a human body exists in the vicinity of the circuit board 30, are examined by use of analytic models as illustrated in FIGS. 6 and 7. FIG. 6 is a diagram illustrating the sensor device 1 in the second working example as the analytic model. FIG. 7 is a diagram illustrating an entire image of the analytic model in the electromagnetic field simulation.

In this analytic model, a size of the circuit board 30 of the current sensor 1 in the second working example is set to 20 millimeters [mm] in the X-axis direction and 30 [mm] in the Y-axis direction. Further, with respect to coordinates, an edge to which the feeder line 38 of the antenna element 20(#1) is connected is set such as X=0, the center of the circuit board 30 in the Y-axis direction is set such as Y=0, and the direction toward the upper surface from the lower surface of the circuit board 30 is set to a Z-axis. A thickness of the circuit board 30 in the Z-axis direction is assumed to be 2.4 [mm]. Further, this analytic model involves, with respect to the circuit board 30, taking 4.5 as a relative permittivity for dielectric material and 5 e-6 siemens per meter [S/m] as a specific electric conductivity for conductors.

Moreover, an assumption of this analytic model for conforming to the embodiment of the sensor device 1 is that a human body 71 (the relative permittivity=40, and the specific electric conductivity=2.0 [S/m]) exists in a state that touches the lower surface of the circuit board 30. This human body 71 is set to have a size that is 156 [mm] in the X-axis direction, 136 [mm] in the Y-axis direction and 66 [mm] in the Z-axis direction. In this state, in the case of supplying the high-frequency power on the order of 2.45 giga hertz (GHz) to the feeding point 37 of the antenna element 20, the current distribution on the circuit board 30 is simulated with respect to the following models.

Model 1: Any obstacle does not exist (only the human body 71 touches the lower surface).

Model 2: A part 72 of the human body, which is presumed to be an arm etc, is spaced-apart by 1 [mm] from the edge of the circuit board 30 in the −Y direction (the analytic model depicted in FIG. 7).

Model 3: The part 72 of the human body is spaced-apart by 1 [mm] from the edge of the circuit board 30 in the +X direction.

Model 4: The part 72 of the human body is spaced-apart by 1 [mm] from the edge of the circuit board 30 in the +Y direction.

Model 5: The part 72 of the human body is spaced-apart by 1 [mm] from the edge of the circuit board 30 in the −X direction.

Model 6: The part 72 of the human body is spaced-apart by 1 [mm] from the upper surface of the circuit board 30 in the +Z-axis direction (the part 72 of the human body covers the circuit board 30).

Model 7: The part 72 of the human body exists in a position spaced 10 [mm] away from the upper surface of the circuit board 30 in the +Z-axis direction (the part 72 of the human body covers the circuit board 30).

Note that the part 72, presumed to be the arm etc, of the human body is used as a part having a size that is 60 [mm] in the Y-axis direction, 136 [mm] in the X-axis direction and 50 [mm] in the Z-axis direction. Moreover, the reason why the disposition of the part 72 of the human body is set in the position spaced 1 [mm] away from the circuit board 30 is based on the assumption of a case where the clothing etc is interposed between the human body and the circuit board 30 by way of the embodiment of the sensor device 1.

Thus in the present method, the electromagnetic field simulation is conducted by use of each model in the case where the obstacle exists in each position adjacent to the sensor device 1, thereby finding out, at first, the associative relation between the current distribution on the circuit board 30 and the radiation pattern. Next, the present method involves determining such positions on the circuit board 30 as to make distinguishable between the respective current distributions associated with the radiation patterns of the individual models. As a result, the determined position is further determined to be a current detecting position in which the current sensor 31 is disposed.

As a result of the electromagnetic field simulation, in the sensor device 1 of the second working example, three positions A, B and C are determined as the current detecting positions corresponding to the installing positions of the antenna elements 20. With respect to the current detecting position, the position B in the −Y direction is determined because of facilitating discernment of the change in current distribution in the position spaced away from the antenna element 20. Moreover, the position A in the +X direction and the position C in the −X direction are determined in order to detect the distributions in the X-axis direction.

It should be noted that a degree of accuracy rises with an increase in number of current detecting positions on the circuit board 30 for distinguishing between the respective current distributions, and, on the other hand, such a demerit arises that the circuit configuration becomes intricate as the number of current detecting positions increases. Accordingly, it is desirable for realizing the sensor device 1 with the low power consumption at a low cost that the number of current detecting positions is determined to the minimum number required for distinguishing between the respective current distributions. The reason why the number of current detecting positions is determined to be "3" in the present method is that these positions are spaced away from the antenna elements 20 for facilitating the distinction between the changes of the current distributions, and "3" is the minimum number required for covering the X-Y plane.

Results of the electromagnetic field simulations in the analytic models given above will hereinafter be described, and the three current detecting positions A, B and C will be verified.

Figure 8:
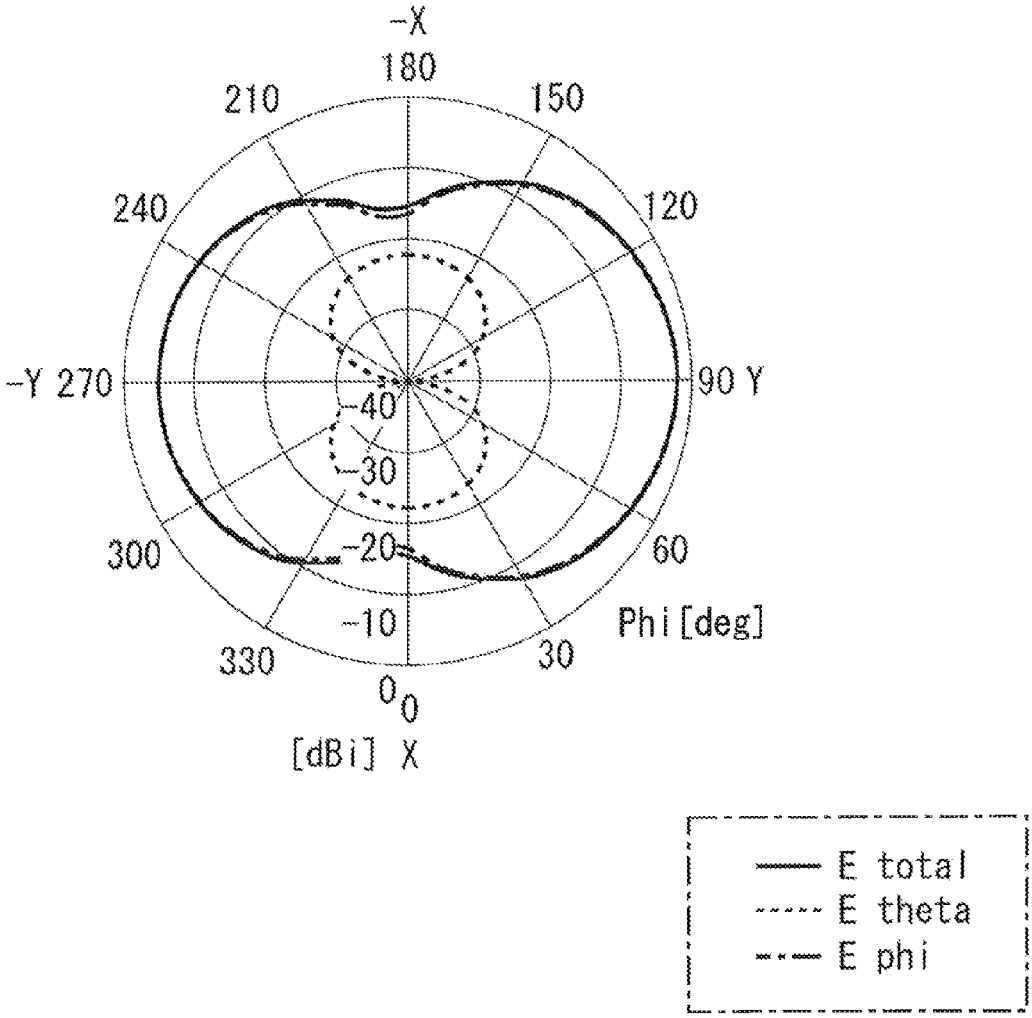
FIG. 8 is a graph illustrating the radiation directivity on an X-Y plane in a model 1.
Figure 9:
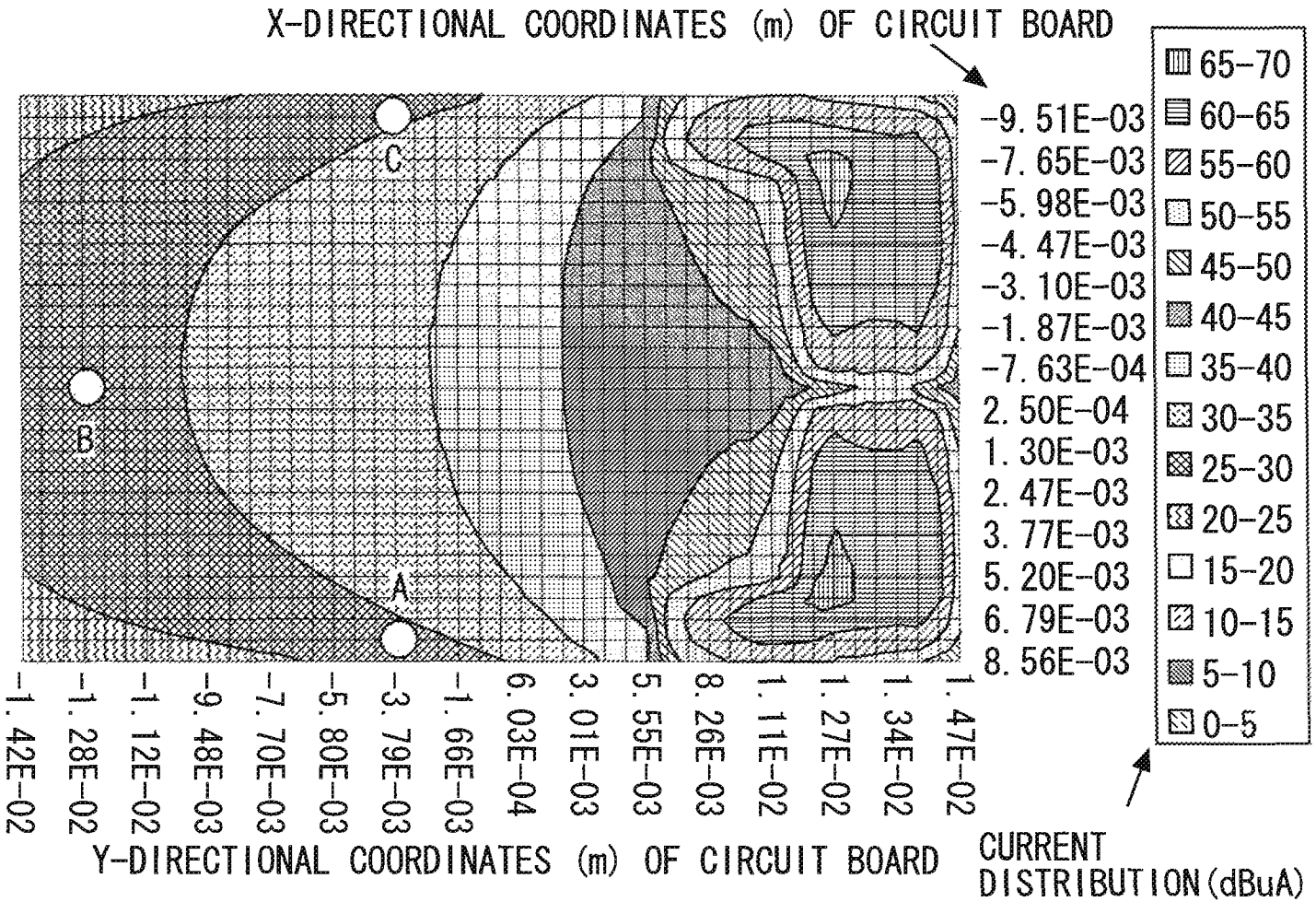
FIG. 9 is a graph illustrating a current distribution on a circuit board 30 in the model 1.

FIG. 8 is a graph indicating the radiation pattern on the X-Y plane in the model 1. FIG. 9 is a graph representing the current distribution on the circuit board 30 in the model 1. It should be noted that the graph representing the current distribution as in FIG. 9 indicates an average value of snapshots on the surface of the circuit board 30 with substantially one period (t=1.09 nanoseconds [ns], 1.152 [ns], 1.192 [ns], 1.25 [ns], 1.299 [ns], 1.352 [ns], 1.401 [ns], 1.450 [ns], 1.490 [ns]. t denotes the elapsed time from the start of the FDTD simulation) with respect to an available frequency (2.45[GHz]).

In the model 1, i.e., the radiation pattern in a state where none of the obstacle exists in the vicinity of the sensor device 1, as illustrated in FIG. 8, the signals are radiated at approximately the same level of intensity in the +X direction and the −X direction, and also in the +Y direction and the −Y direction, respectively, from the circuit board 30 on the X-Y plane. The current distribution of the model 1 is that as depicted in FIG. 9, the current in the position close to the antenna element 20 is large but becomes gradually smaller as the position gets away (in the −Y direction) from the antenna element 20.

With this pattern, the positions A, B and C belong to the current distribution ranging from 25 dB (decibel) microamperes [dBuA] to 30 [dBuA]. Hence, if each current value difference between the positions A, B and C is within 5 [dBuA], the radiation pattern in the case of having no obstacle, i.e., the radiation pattern having the same level of intensity in the +X direction and the −X direction, and also in the +Y direction and the −Y direction, respectively, from the circuit board 30 can be specified as the present radiation directivity.

Figure 10:
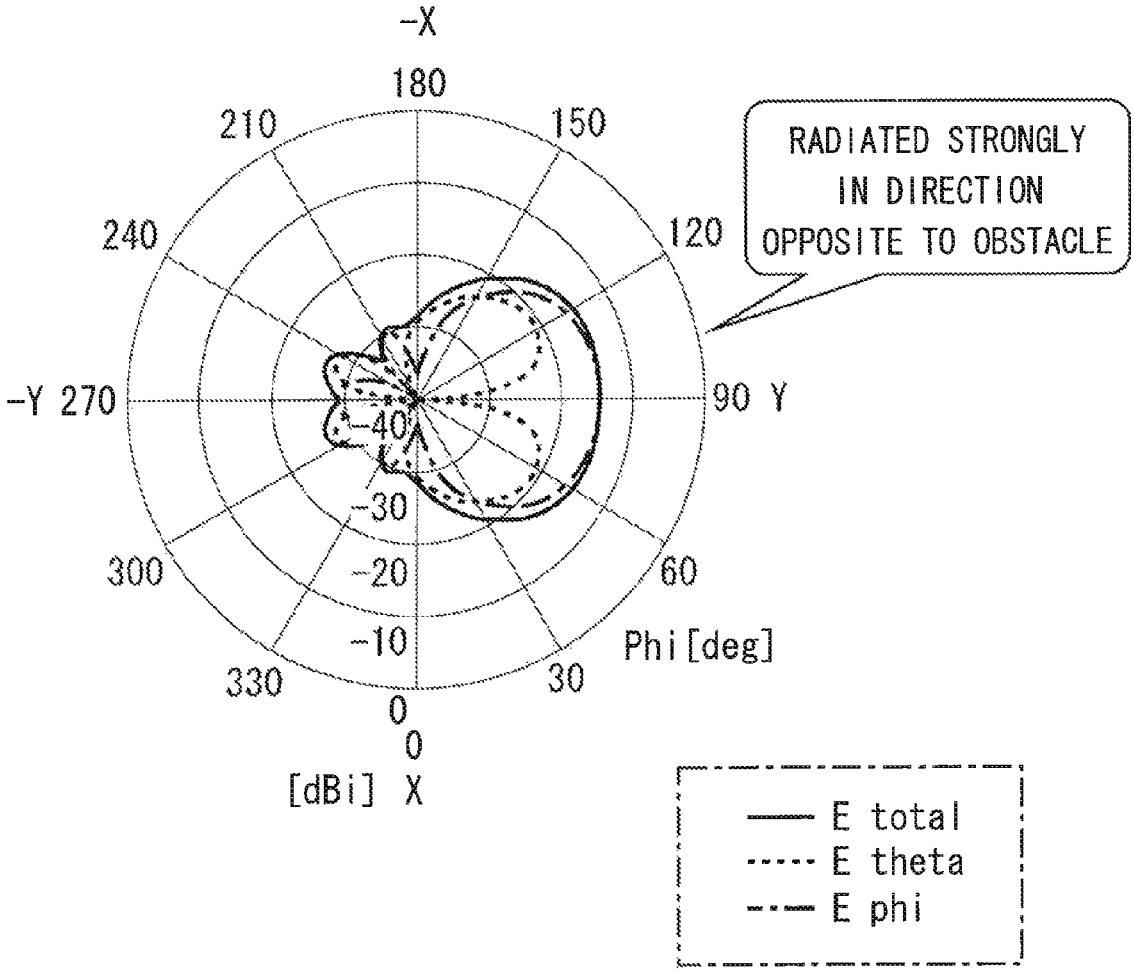
FIG. 10 is a graph illustrating the radiation directivity on the X-Y plane in a model 2.
Figure 11:
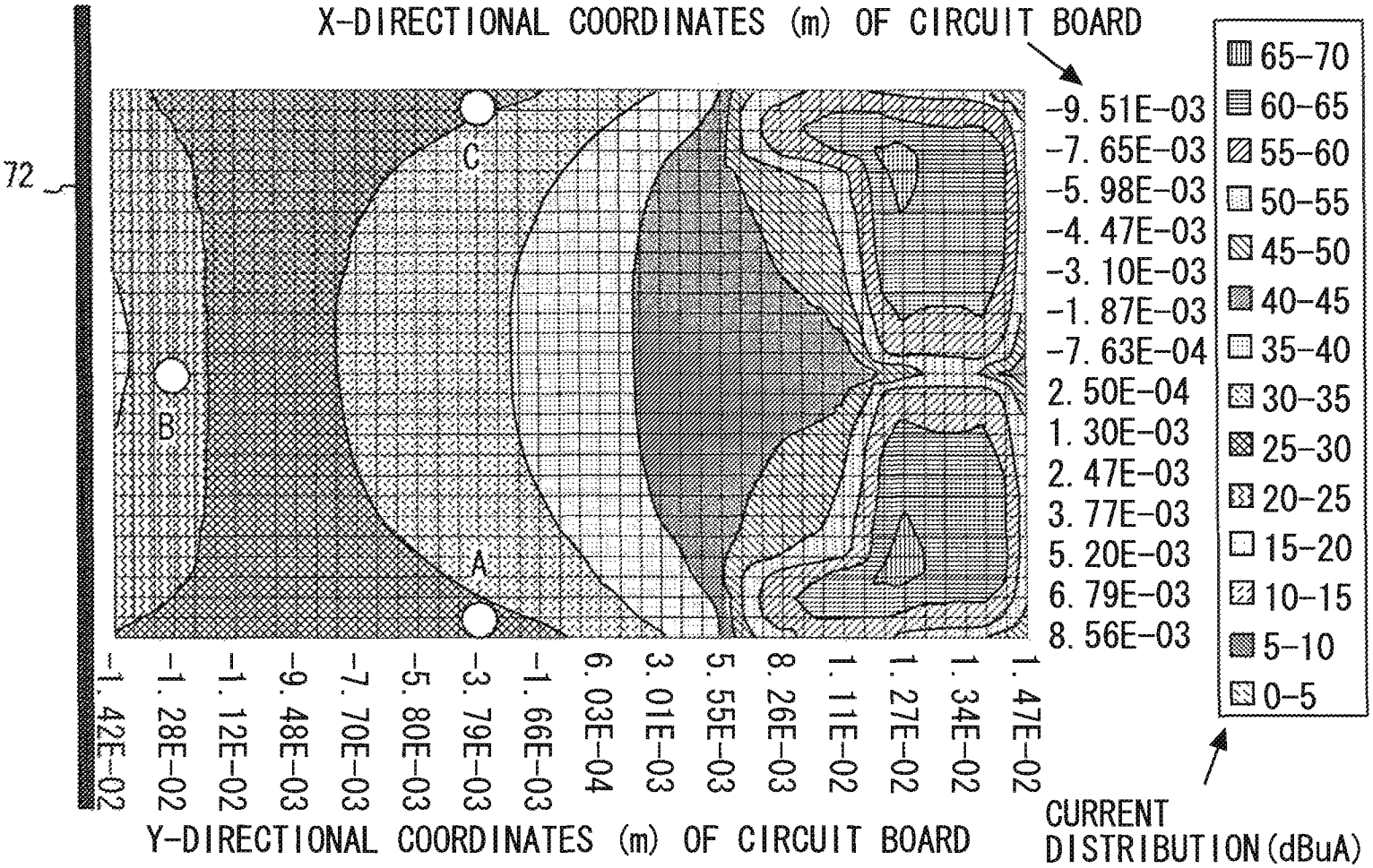
FIG. 11 is a graph illustrating the current distribution on the circuit board 30 in the model 2.

FIG. 10 is a graph indicating the radiation pattern on the X-Y plane in the model 2. FIG. 11 is a graph representing the current distribution on the circuit board 30 in the model 2. The radiation pattern in the model 2 becomes, as illustrated in FIG. 10, stronger in the direction (+Y direction) opposite to the position of the obstacle, but any remarkable bias of the radiation directivity is not seen in the +X directions. Namely, if the obstacle exists in the vicinity of the edge, apart from the antenna element 20, of the circuit board 30, the radiation pattern has a strong characteristic in the direction opposite to the obstacle.

In the current distribution of the model 2, as depicted in FIG. 11, the current value of an area vicinal to the obstacle is smaller than that in the model 1. From this comparison, in the model 2, the current distribution ranging from 20 [dBuA] to 25 [dBuA] exists in the position indicating the current value ranging from 25 [dBuA] to 30 [dBuA] in the model 1. As a result, the positions A and C similarly to the model 1 belong to the current distribution ranging from 25 [dBuA] to 30 [dBuA], and the position B belongs to the current distribution from 20 [dBuA] to 25 [dBuA].

Hence, if the current value difference between the positions A and C falls within 5 [dBuA] and if the current value of the position B is smaller by 5 [dBuA] or more than the current values of other positions A and C, the radiation pattern having the strong characteristic in the +Y direction can be specified as the present radiation directivity.

Figure 12:
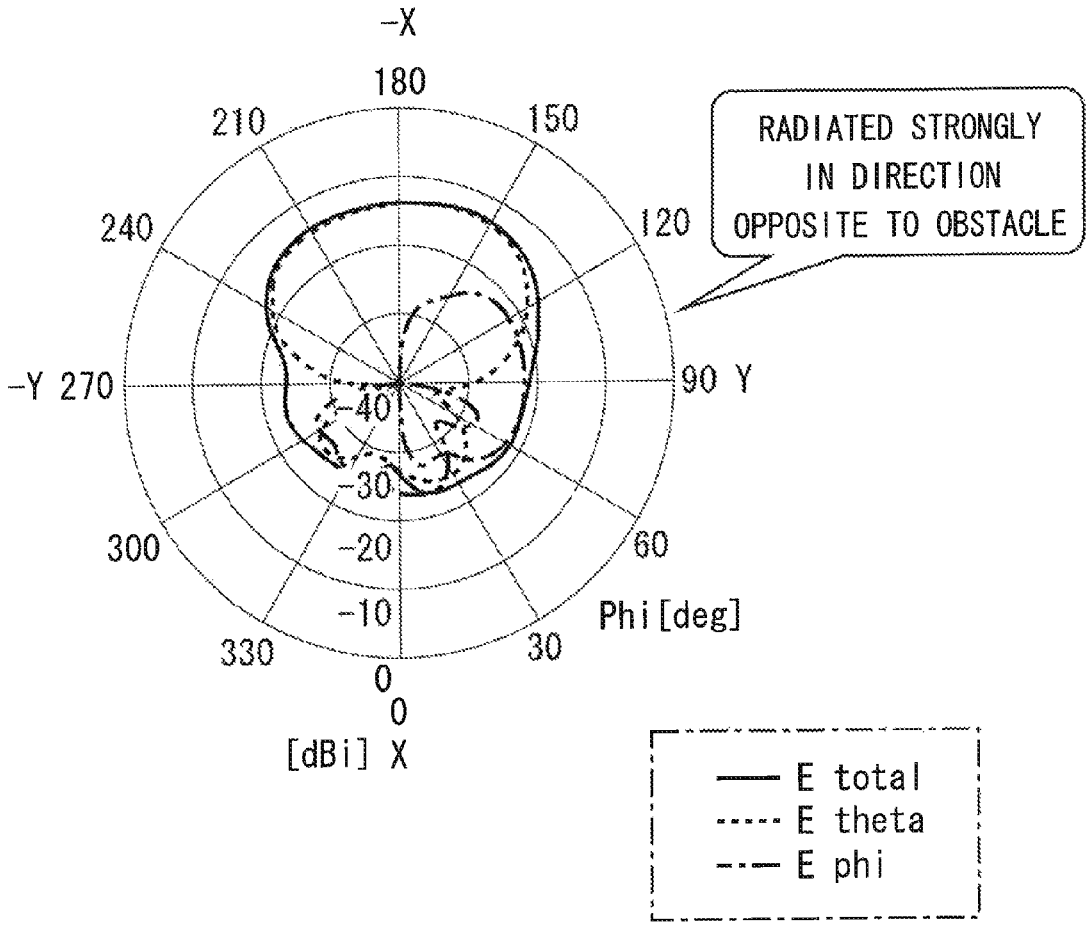
FIG. 12 is a graph illustrating the radiation directivity on the X-Y plane in a model 3.
Figure 13:
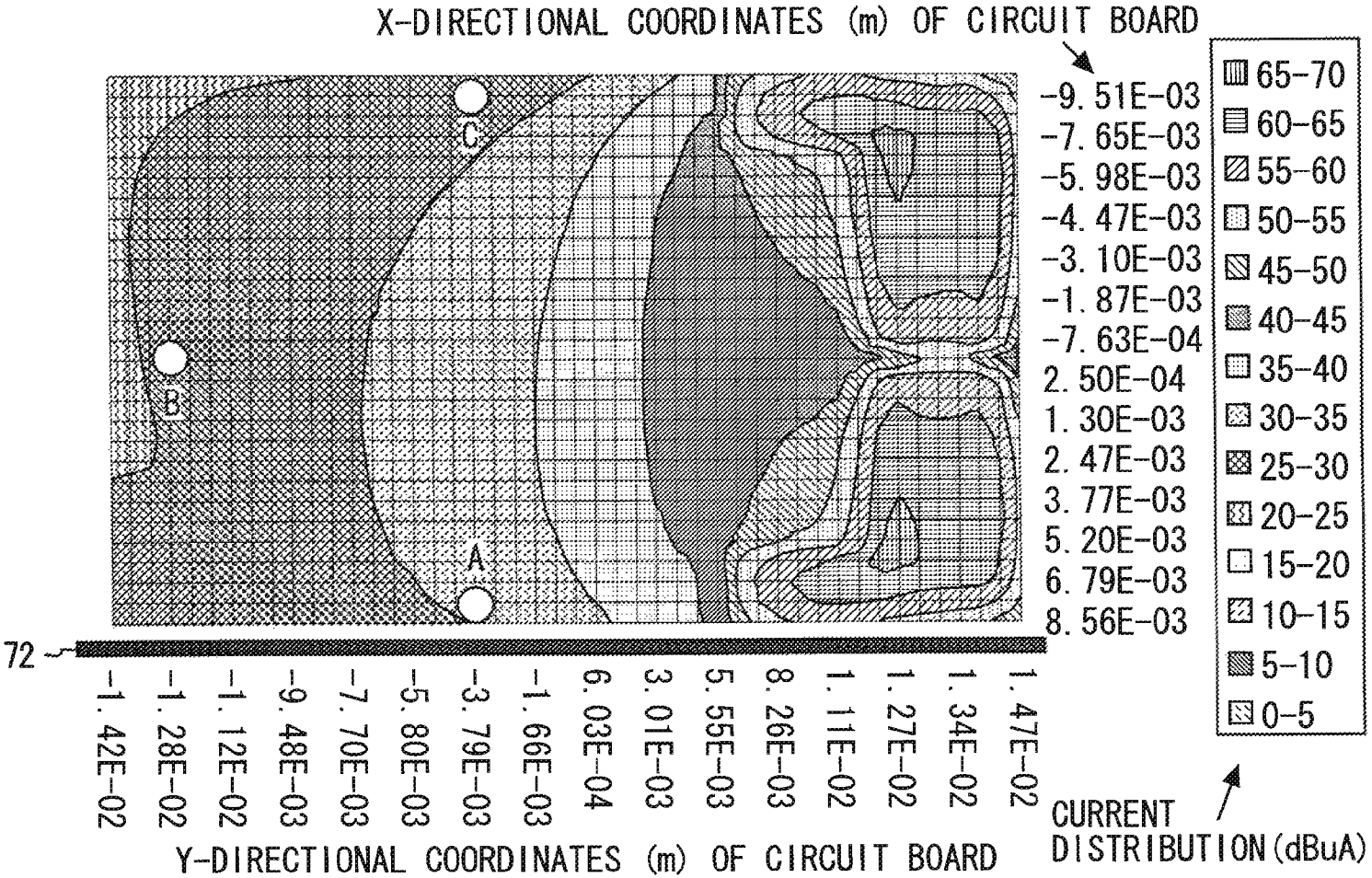
FIG. 13 is a graph illustrating the current distribution on the circuit board 30 in the model 3.

FIG. 12 is a graph representing the radiation pattern on the X-Y plane in the model 3. FIG. 13 is a graph indicating the current distribution on the circuit board 30 in the model 3. The radiation pattern in the model 3 has, as illustrated in FIG. 12, no remarkable bias of the radiation directivity in the +Y directions but is strong in the −X direction opposite to the obstacle.

In the current distribution in the model 3, as depicted in FIG. 13, such a portion exists that the current value of the other opposite edge area (−X side) is smaller than in the edge area close to the obstacle in the same Y position. From this point, the positions B and C similarly to the model 1 belong to the current distribution from 25 [dBuA] to 30 [dBuA], and the position A belongs to the current distribution from 30 [dBuA] to 35 [dBuA].

Hence, if the current value difference between the positions B and C falls within 5 [dBuA] and if the current value of the position A is larger to such a degree as to exceed 5 [dBuA] than the current values of other positions B and C, the radiation pattern having the strong characteristic in the −X direction can be specified as the present radiation directivity.

Figure 14:
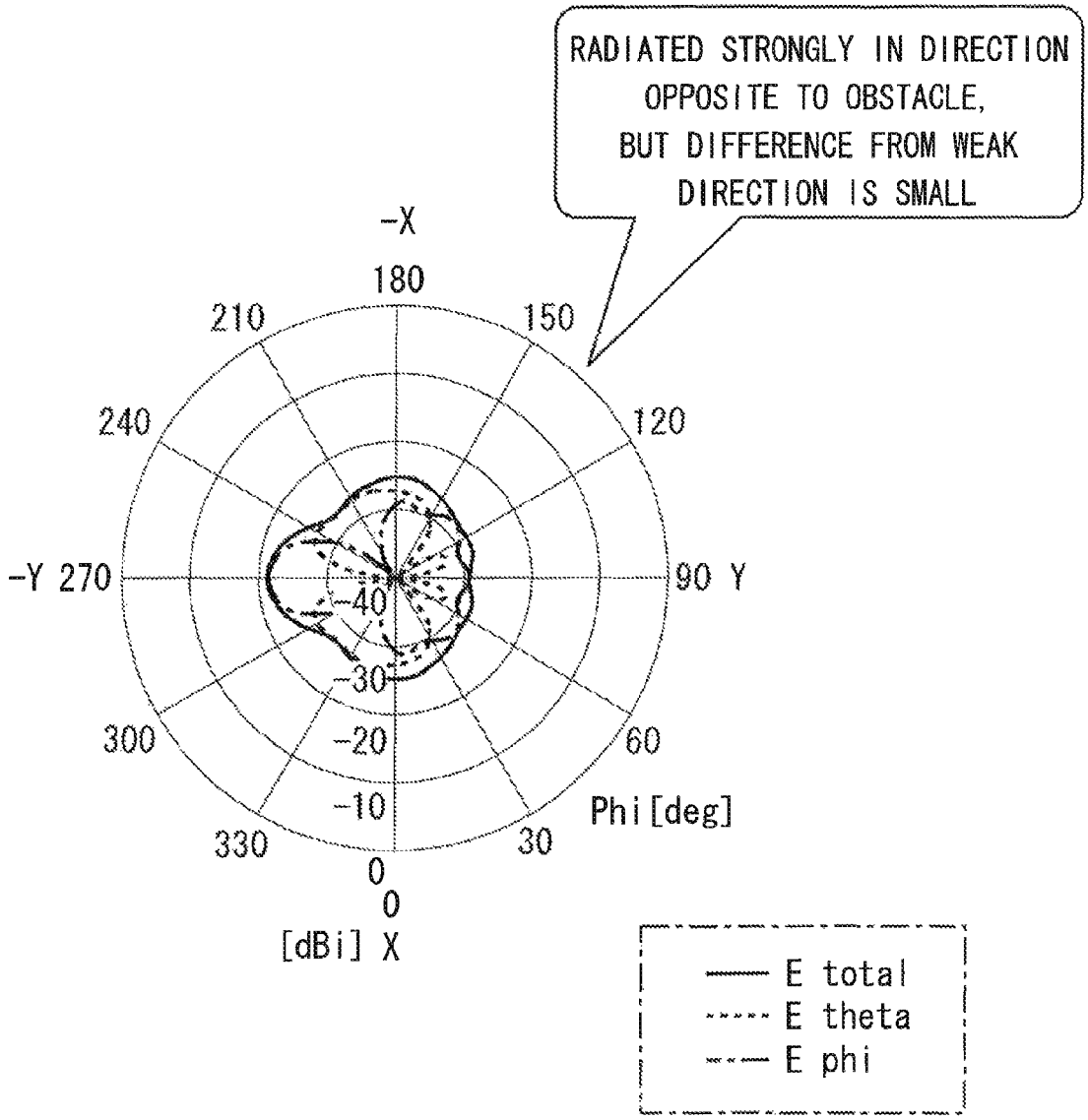
FIG. 14 is a graph illustrating the radiation directivity on the X-Y plane in a model 4.
Figure 15:
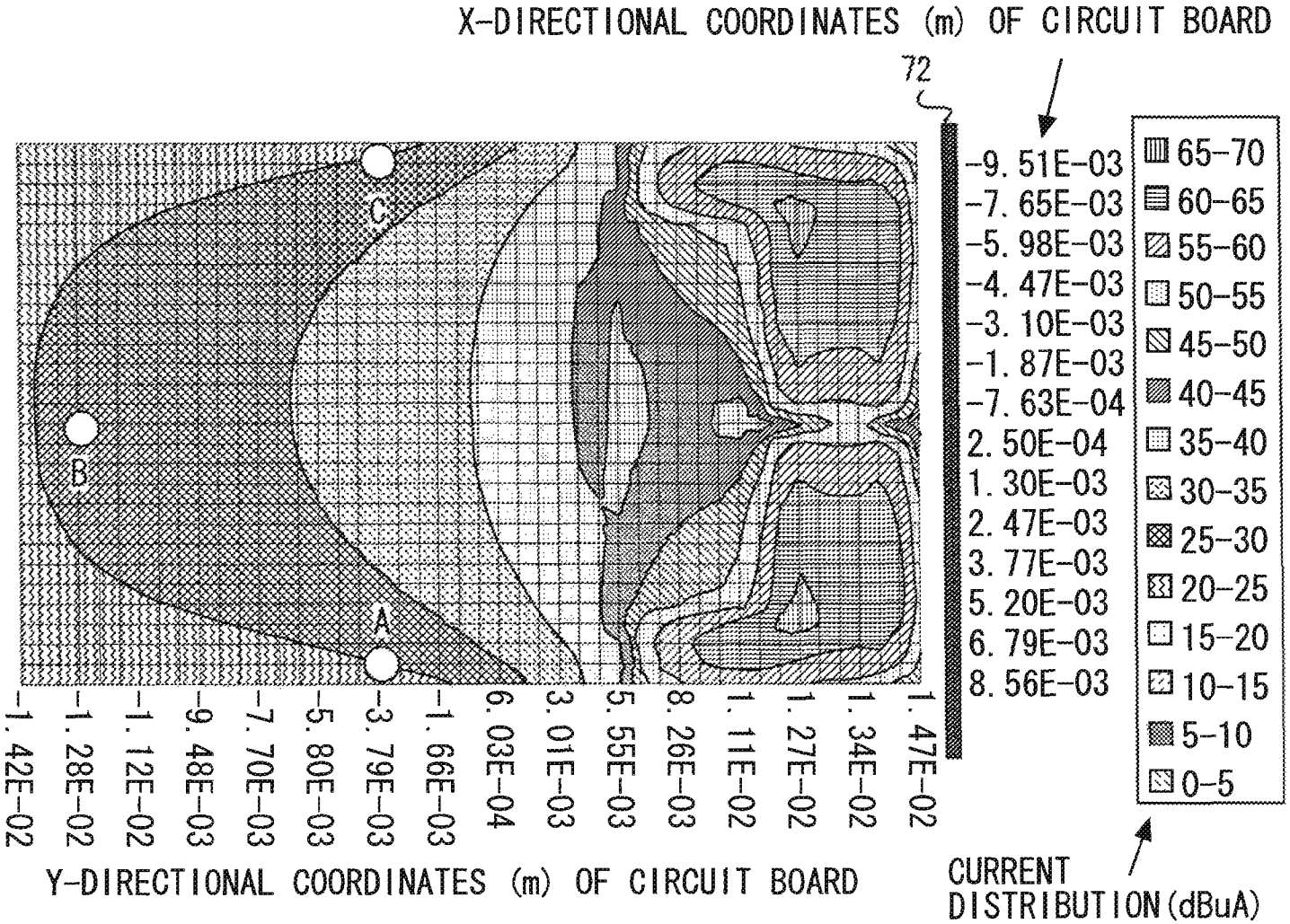
FIG. 15 is a graph illustrating the current distribution on the circuit board 30 in the model 4.

FIG. 14 is a graph representing the radiation pattern on the X-Y plane in the model 4. FIG. 15 is a graph indicating the current distribution on the circuit board 30 in the model 4. The radiation directivity in the model 4 has, as illustrated in FIG. 14, no remarkable bias of the radiation directivity in the +X directions but is strong in the −Y direction opposite to the obstacle. As compared with the models 2 and 3, however, the −Y directional bias of the radiation pattern of the model 4 has a small rate. This is, it is considered, derived from a cause that the lossy obstacle exists in the vicinity of the antenna element 20, and consequently radiation efficiency of the antenna remarkably decreases, which leads to a reduction in absolute gain itself.

In the current distribution of the model 4, as depicted in FIG. 15, a reduction width of the current value corresponding to a −Y directional distance from the antenna element 20 is large as compared with the model 1. With this reduction, the current value from 25 [dBuA] to 30 [dBuA] deviates more in the +Y direction than in the model 1, and the current value from 20 [dBuA] to 25 [dBuA] widely spreads. From this point, each of the positions A, B and C, though not explicitly illustrated in FIG. 15 in terms of a matter of precision of the graph, takes a smaller value than in the model 1, and the current value difference between the respective positions falls within 5 [dBuA].

Hence, if the current value difference between the positions A, B and C falls within 5 [dBuA] and if each current value is smaller than in the model 1, the radiation pattern having the bias in the −Y direction, of which a bias degree is smaller than in the models 2 and 3, can be specified as the present radiation directivity.

The model 5 comes to have, though not illustrated, the result opposite in the X-axis direction to the model 3 because the analytic model uses the antenna elements, which are symmetric with respect to the X-axis center on the circuit board 30. Namely, the radiation pattern in the model 5 has none of the remarkable bias of the radiation directivity in the +Y directions but is strong in the +X direction opposite to the obstacle. In the current distribution of the model 5, such a portion exists that the current value of the other opposite edge area (+X side) is smaller than in the edge area close to the obstacle in the same Y position.

From this point, if the current value difference between the positions A and B falls within 5 [dBuA] and if the current value of the position C is larger to such a degree as to exceed 5 [dBuA] than the current values of other positions A and B, the radiation pattern having the strong characteristic in the +X direction can be specified as the present radiation directivity.

Figure 16:
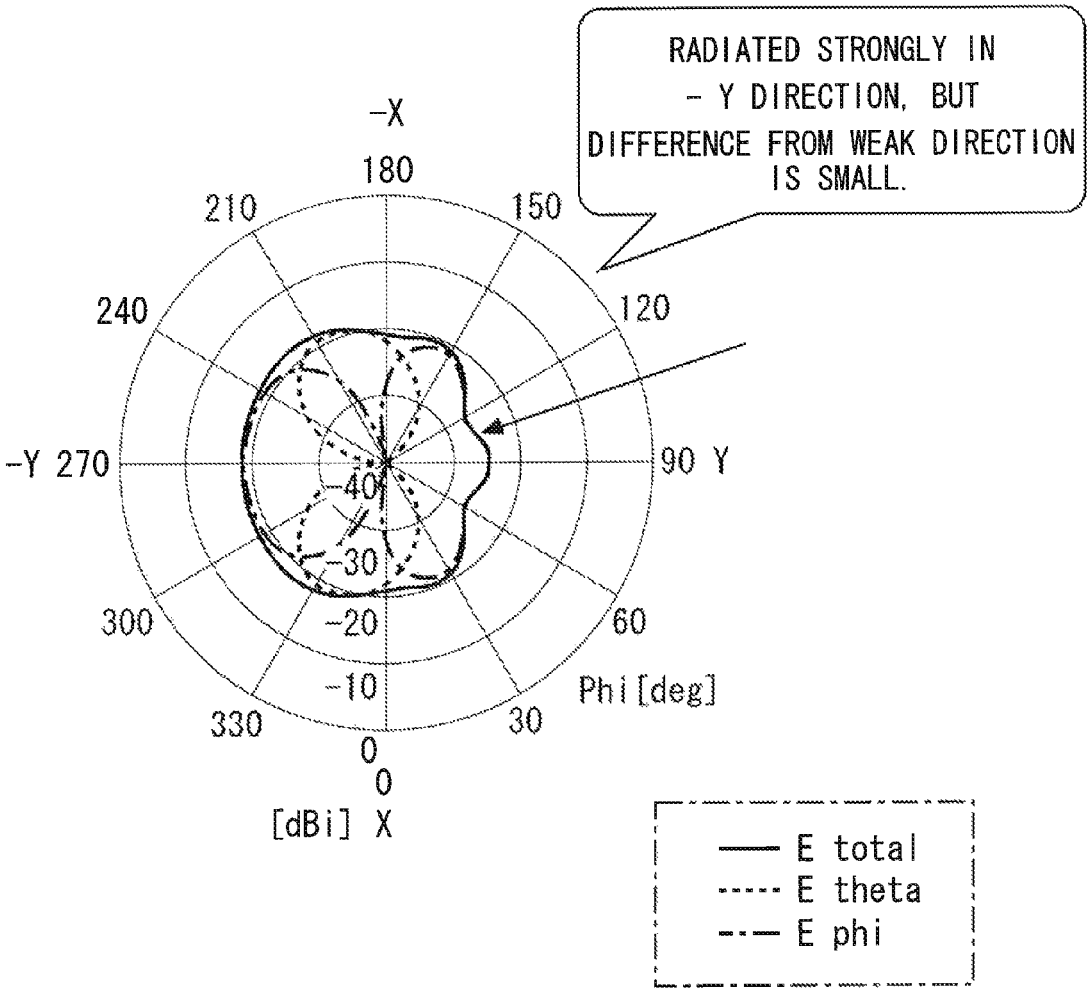
FIG. 16 is a graph illustrating the radiation directivity on the X-Y plane in a model 6.
Figure 17:
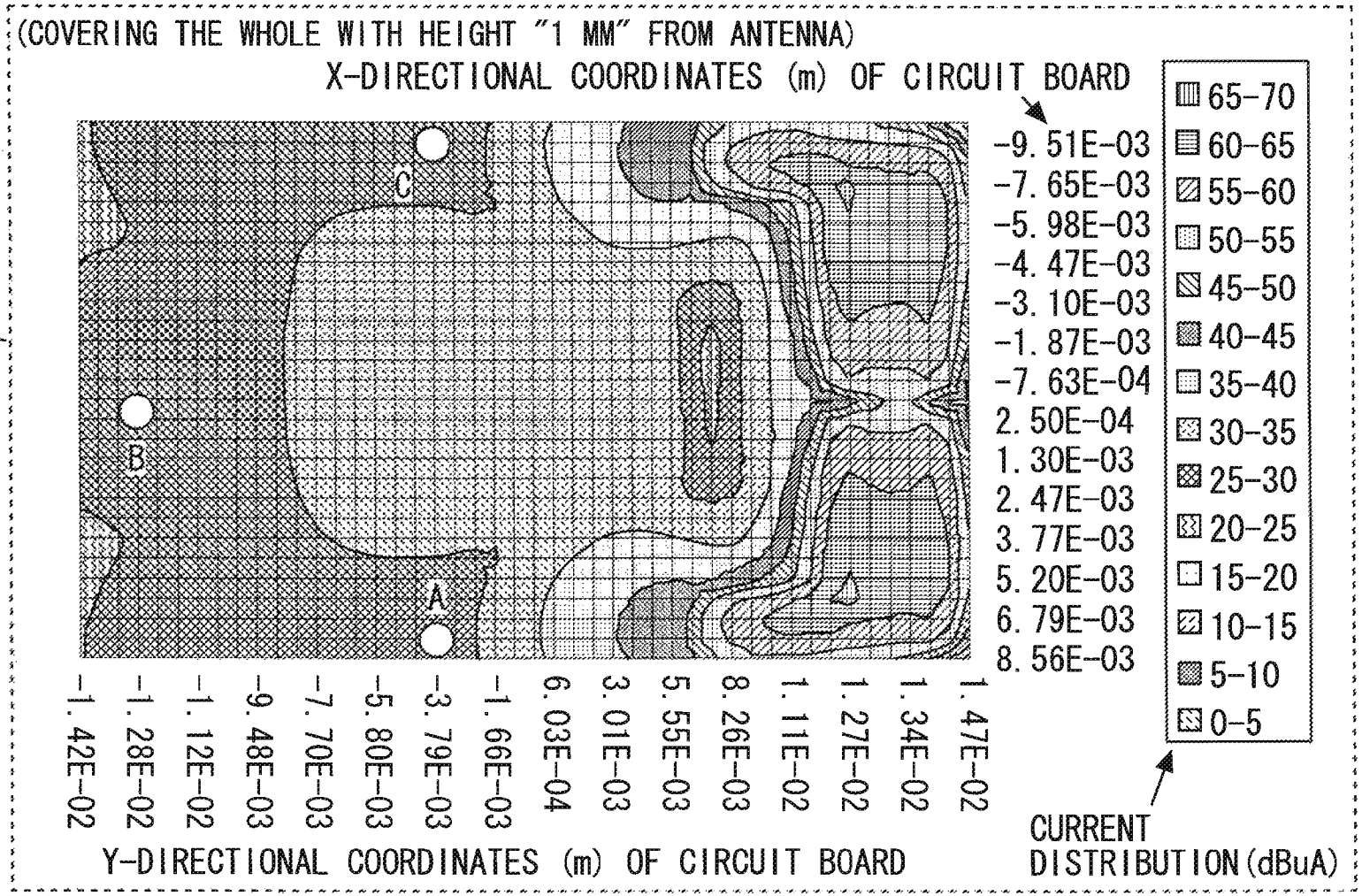
FIG. 17 is a graph illustrating the current distribution on the circuit board 30 in the model 6.

FIG. 16 is a graph representing the radiation pattern on the X-Y plane in the model 6. FIG. 17 is a graph indicating the current distribution on the circuit board 30 in the model 6. The radiation pattern in the model 6 has, as illustrated in FIG. 16, no remarkable bias of the radiation directivity in the ±X directions but is strong in the −Y direction. As compared with the models 2 and 3, however, the −Y directional bias of the radiation pattern of the model 6 has the small rate. The obstacle is disposed in a way that covers the sensor device 1 in the model 6, however, the lossy obstacle can be said to exist in the vicinity of the antenna element 20, and hence this characteristic is, it is considered, resultantly similar to the model 4.

In the current distribution of the model 6, as illustrated in FIG. 17, the current value from 30 [dBuA] to 35 [dBuA] widely spreads in the central area on the circuit board 30. In this case, each current value of the positions A, B and C, though not explicitly illustrated in FIG. 17 in terms of the matter of precision of the graph, takes the smaller value than in the model 1, and the current value difference between the respective positions falls within 5 [dBuA].

Hence, if the current value difference between the positions A, B and C falls within 5 [dBuA] and if each current value is smaller than in the model 1, the radiation pattern having the bias in the −Y direction, of which the bias degree is smaller than in the models 2 and 3, can be specified as the present radiation directivity.

It should be noted that the present method, as described above, does not distinguish between the radiation patterns of the model 4 and the model 6, however, if viewed in detail as illustrated in FIGS. 14 and 16, the radiation patterns of the model 4 and the model 6 are different from each other. Further, the current distributions of the model 4 and the model 6 are different from each other in the central area on the circuit board 30. Accordingly, the radiation pattern of the model 4 may be distinguished from the radiation pattern of the model 6 by further increasing the number of current detecting positions in the central area on the circuit board 30.

Figure 18:
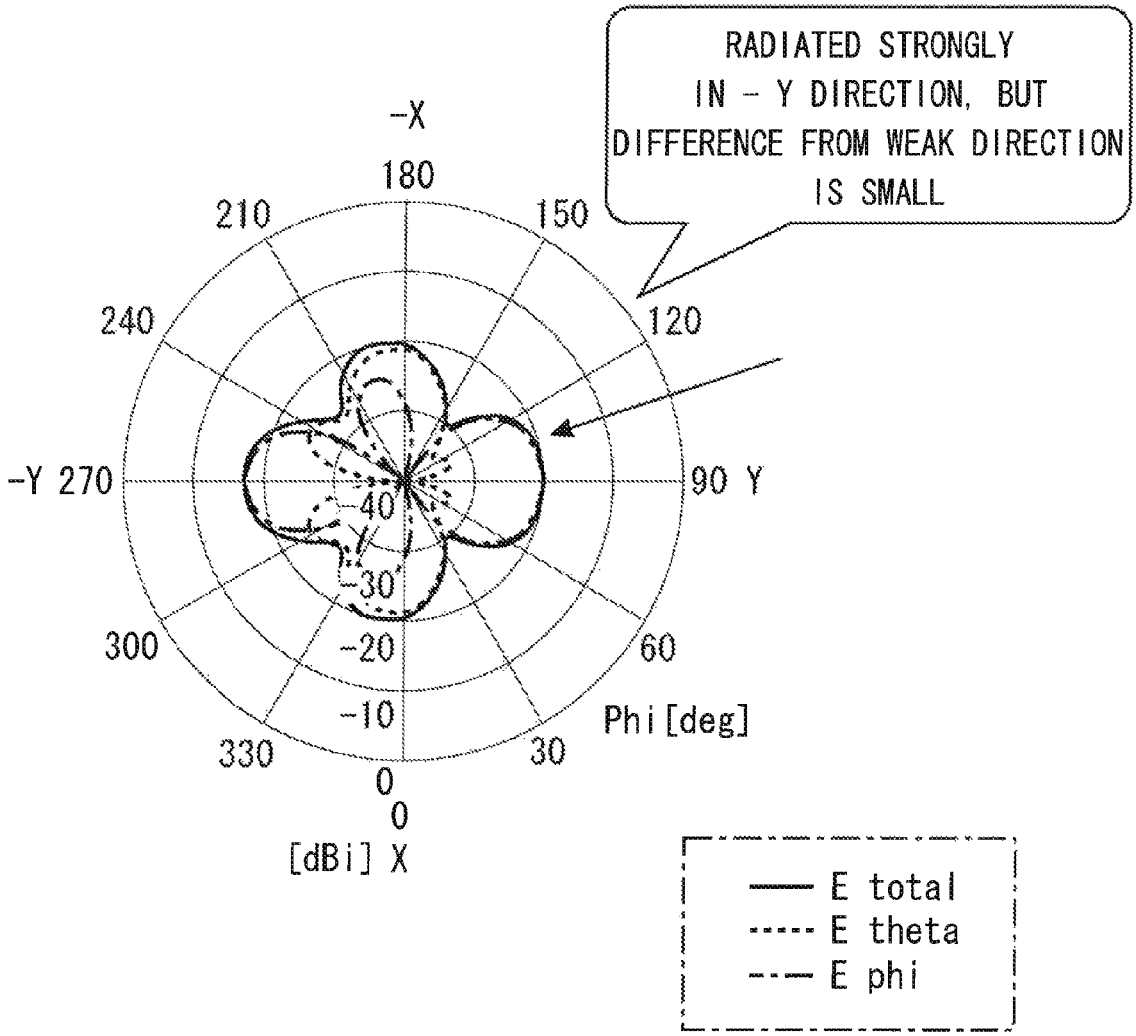
FIG. 18 is a graph illustrating the radiation directivity on the X-Y plane in a model 7.
Figure 19:
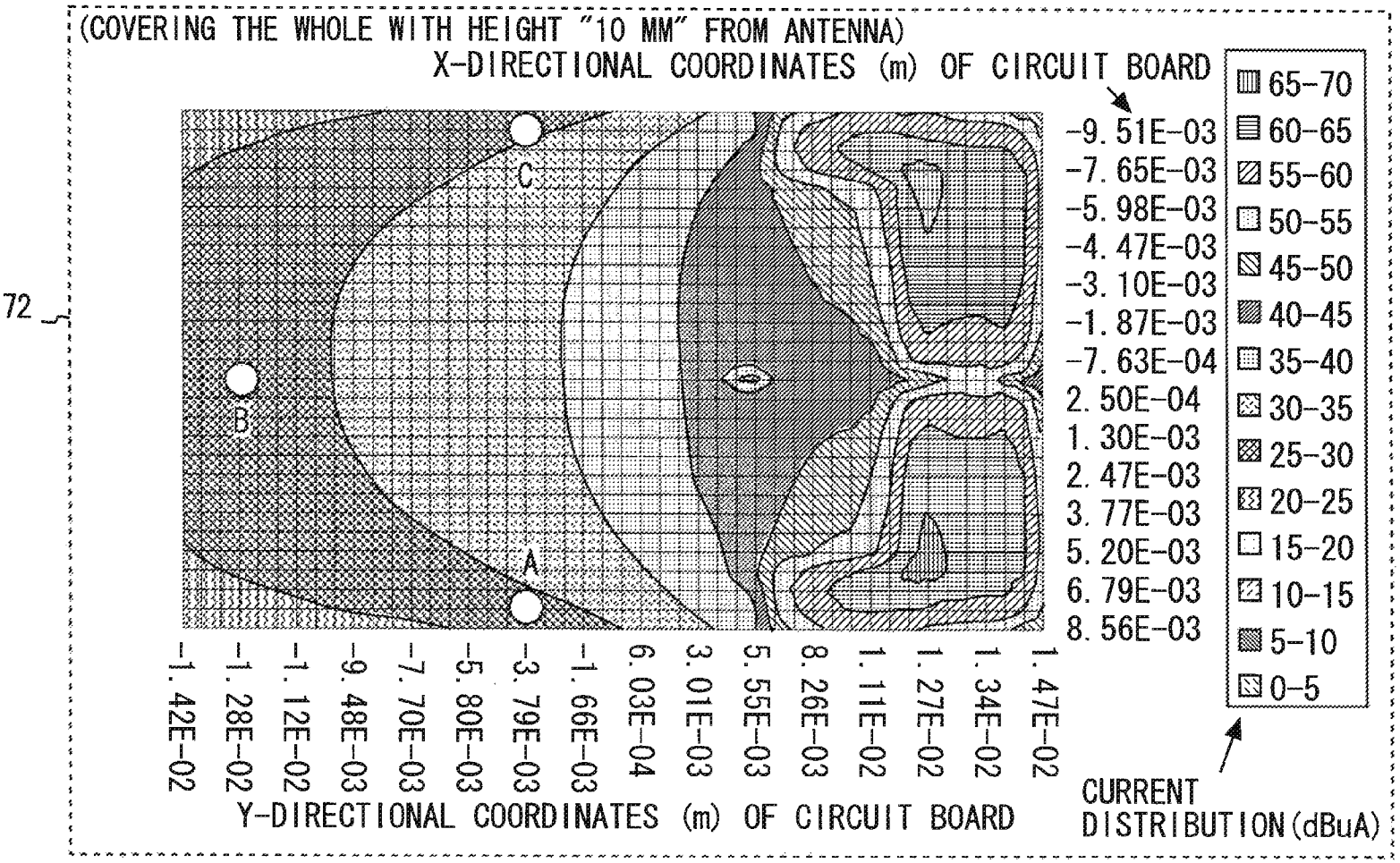
FIG. 19 is a graph illustrating the current distribution on the circuit board 30 in the model 7.

FIG. 18 is a graph representing the radiation pattern on the X-Y plane in the model 7. FIG. 19 is a graph indicating the current distribution on the circuit board 30 in the model 7. The radiation pattern in the model 7 has, as illustrated in FIG. 18, no remarkable bias of the radiation pattern in the ±X directions and the ±Y directions and is similar to the radiation pattern of the model 1.

The current distribution of the model 7 has, as depicted in FIG. 19, no difference from the model 1 without the obstacle. In this case, the current values of the positions A, B and C are the same as in the model 1, and hence the same radiation pattern as the pattern of the model 1 can be specified as the present radiation directivity.

According to the results of the electromagnetic field simulation described above, it is feasible to acquire the associative relation between the current distribution and the radiation pattern of each model as illustrated in FIG. 5. According to the example in FIG. 5, the models 1 and 7 have the current distribution pattern 1 in FIG. 5 and the radiation pattern associated therewith. Similarly, the models 4 and 6 correspond to the current distribution pattern 2 in FIG. 5, the model 2 corresponds to the current distribution pattern 3 in FIG. 5, the model 3 corresponds to the current distribution pattern 4 in FIG. 5, and the model 5 corresponds to the current distribution pattern 5 in FIG. 5.

Further, it is possible to verify that the current distributions of the respective models, i.e., the individual current distribution patterns corresponding to the position of the obstacle can be estimated by use of the current values detected in the three current detecting positions A, B and C. As a result, the current sensors 31 (#1, #2 and #3) are disposed in the thus-determined current detecting positions, and the sensor device 1 in the second working example can be realized by incorporating the relationship between the correlations of the current values detected in the respective current detecting positions and the radiation patterns into the current distribution estimating unit 27 and the radiation pattern specifying unit 28.

Operational Example

Figure 20:
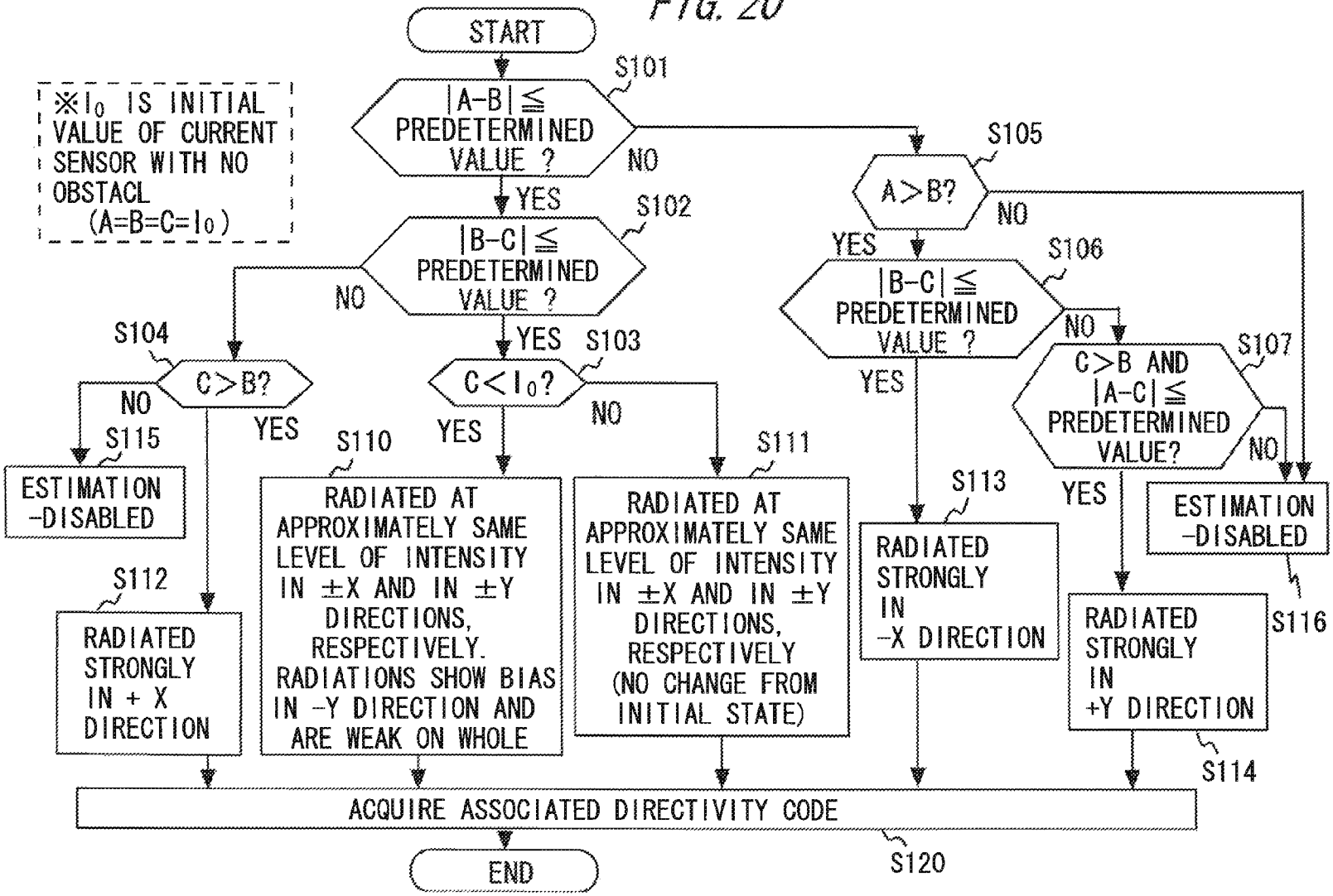
FIG. 20 is a flowchart illustrating an example of a current distribution estimating operation and a radiation pattern specifying operation in the sensor device 1 in a second working example.

A current distribution estimating operation of the current distribution estimating unit 27 and a radiation pattern specifying operation of the radiation pattern specifying unit 28 will hereinafter be described with reference to FIG. 20. FIG. 20 is a flowchart illustrating the current distribution estimating operation and the radiation pattern specifying operation in the sensor device 1 in the second working example.

The current distribution estimating unit 27 receives, from the calculating unit 33, the relation of magnitude between the respective detected current values, the difference absolute value of each detected current value from other detected current values and each detected current value, and estimates at first the present current distribution on the circuit board 30 by use of these items of information. The following discussion will be made on the assumption that the symbol "A" represents the detected current value of the current sensor 31

(#1), "B" designates the detected current value of the current sensor 31 (#2), and "C" stands for the detected current value of the current sensor 31 (#3).

The current distribution estimating unit 27 determines whether or not the difference absolute value between the current value A and the current value B is within the predetermined value (S101). The predetermined value is a value depending on the accuracy of the current value detected by the current sensor 31 and is set to, e.g., 5 [dBuA] according to the result of the electromagnetic field simulation. The predetermined value is previously retained in an adjustable manner by the current distribution estimating unit 27. The current distribution estimating unit 27, when determining that the difference absolute value between the current value A and the current value B is within the predetermined value (S101; YES), determines next whether or not a difference absolute value between the current value B and the current value C is within the predetermined value (S102). Note that the current value B is compared with the current value C in (S102), however, the current value A may also be compared with the current value C.

The current distribution estimating unit 27, when determining the difference absolute value between the current value B and the current value C is within the predetermined value (S102; YES), further determines whether or not the current value C is smaller than a predetermined current value $I_0$ detected when the obstacle does not exist (S103). This predetermined current value $I_0$ is also previously retained in the adjustable manner. Herein, the current distribution estimating unit 27, when determining that the current value C is equal to or larger than the predetermined current value $I_0$ (S103; NO), estimates this value status as the current distribution pattern in the state 1 illustrated in FIG. 5.

The radiation pattern specifying unit 28 specifies, as the radiation pattern associated with the thus-estimated current distribution pattern in the state 1, the radiation pattern in the initial state with no obstacle, i.e., the radiation pattern in which the signals are radiated at approximately the same level of intensity in the +X direction and the −X direction, and also in the +Y direction and the −Y direction, respectively (S111). Note that the current value C is compared with the predetermined current value in the example of FIG. 20, however, the current values A, B and C are approximate to each other, and therefore the current value A or B may be compared with the predetermined current value.

On the other hand, the current distribution estimating unit 27, when determining that the current value C is smaller than the predetermined current value $I_0$ (S103; YES), estimates this value status as the current distribution pattern in the state 2 illustrated in FIG. 5. The radiation pattern specifying unit 28 specifies, as the radiation pattern associated with the thus-estimated current distribution pattern in the state 2, the radiation pattern in which the signals are radiated at the same level of intensity in the +X direction and the −X direction, and also in the +Y direction and the −Y direction, respectively, but the radiation is weak on the whole with a bias in the −Y direction (S110).

Furthermore, the current distribution estimating unit 27, when determining that the difference absolute value between the current value A and the current value B is within the predetermined value (S101; YES) and that the difference absolute value between the current value B and the current value C is not within the predetermined value (S102; NO), further determines whether the current value C is larger than the current value B or not (S104). Herein, if the current value C is determined to be larger than the current value B (S104; YES), the current distribution estimating unit 27 estimates this value status as the current distribution pattern in the state 5 illustrated in FIG. 5. The radiation pattern specifying unit 28 specifies, as the radiation pattern associated with the thus-estimated current distribution pattern in the state 5, the radiation pattern in which the radiation is strong in the +X direction (S112). Incidentally, the current value B is compared with the current value C in (S104), however, the current value C may also be compared with the current value A.

The current distribution estimating unit 27, when determining in the determining process described above that the difference absolute value between the current value A and the current value B is not equal to or smaller than the predetermined value (S101; NO), determines next whether the current value A is larger than the current value B or not (S105). Herein, if the current value A is determined to be larger than the current value B (S105; YES), the current distribution estimating unit 27 further determines whether the difference absolute value between the current value B and the current value C is equal to or smaller than the predetermined value or not (S106). Herein, if the difference absolute value between the current value B and the current value C is determined to be equal to or smaller than the predetermined value (S106; YES), the current distribution estimating unit 27 estimates this value status as the current distribution pattern in the state 4 illustrated in FIG. 5. The radiation pattern specifying unit 28 specifies the radiation pattern in which the radiation is strong in the −X direction as the radiation pattern associated with the thus-estimated current distribution pattern in the state 4 (S113).

On the other hand, the current distribution estimating unit 27, when determining that the difference absolute value between the current value B and the current value C is larger than the predetermined value (S106; NO), further determines whether the current value C is larger than the current value B or not and whether the difference absolute value between the current value A and the current value C is equal to or smaller than the predetermined value or not (S107). Herein, when determining that the current value C is larger than the current value B and whether the difference absolute value between the current value A and the current value C is equal to or smaller than the predetermined value (S107; YES), the current distribution estimating unit 27 estimates this value status as the current distribution pattern in the state 3 illustrated in FIG. 5. The radiation pattern specifying unit 28 specifies the radiation pattern having the strong radiation in the +Y direction as the radiation pattern associated with the thus-estimated current distribution pattern in the state 3 (S114).

Note that the current distribution estimating unit 27, if determined, based on the various items of information acquired from the calculating unit 33, to be applied to none of the current distribution patterns in the states 1 through 5 illustrated in FIG. 5, determines this status as a current distribution estimation-disabled status (S115, S116). The radiation pattern specifying unit 28, if determined to be the current estimation-disabled status, decides that the radiation pattern can not be specified. In the case of deciding that the radiation pattern can not be specified, a directivity code indicating the radiation pattern specification-disabled status is generated, and this directivity code may be transmitted to the BB processing unit 25.

The radiation pattern specifying unit 28, in the case of determining the present radiation pattern to be applied to any one of the states 1 through 5 illustrated in FIG. 5 (S110, S111, S112, S113, S114), acquires the directivity code associated with this radiation pattern (S120). The radiation pattern specifying unit 28 transmits this directivity code to the BB processing unit 25.

In the operational example of FIG. 20, the process starts with the comparison between the current value A and the current value B, however, the process may start with the comparison between the current value A and the current value C and may also start with the comparison between the current value B and the current value C. Moreover, the embodiment does not restrict the comparative sequence of the respective current values, and hence the comparative sequence may be changed in a determinable manner.

Operations and Effects in Second Working Example

In the sensor device 1 of the second working example, the plurality of current sensors 31 (#1, #2 and #3) detects the respective high-frequency currents corresponding to the installing positions thereof on the circuit board 30. Subsequently, the calculating unit 33 acquires the relation of magnitude between the respective detected current values and the difference absolute value of each detected current value from other detected current values. The current distribution estimating unit 27 estimates, based on the respective items of information calculated by the calculating unit 33 and the individual detected current values, any one of the previously retained current distribution patterns as the present current distribution. Subsequently, the radiation pattern specifying unit 28 specifies the radiation pattern associated with the current distribution pattern estimated by the current distribution estimating unit 27.

Thus, according to the second working example, it is feasible to specify the radiation pattern which changes corresponding to the obstacle on the basis of the current value detected in the predetermined position on the circuit board 30 including the antenna elements.

The specification of the current distribution pattern and the radiation pattern described above involves utilizing the correlation of the detected current values and the associative relation between the current distribution pattern and the radiation pattern, which are calculated through the electromagnetic field simulation and retained. Further, with respect to the current detecting positions, the number of the current detecting positions and the positions themselves, which enable the current distribution patterns associated with the respective radiation patters to be specified, are each determined through the electromagnetic field simulation that is conducted beforehand.

This scheme enables the number of the current sensors 31 to be minimized as required and the accurate radiation pattern to be specified with the simple configuration.

According to the second working example, the sensor device 1 can accurately detect the change in directivity corresponding to the obstacle and can by itself take the avoidance measure for performing the wireless communications by avoiding shadowing due to the obstacle.

Moreover, in the second working example, the directivity code indicating the thus-specified radiation pattern is wirelessly transmitted to a communication partner device. The communication partner device is thereby capable of precisely detecting the change in directivity corresponding to the obstacle against the sensor device 1 in accordance with the received directivity code. By extension, the communication partner device can take the avoidance measure for receiving the data from the sensor device 1, corresponding to the change in directivity thereof.

Third Working Sample

The sensor device 1 in a third working example will hereinafter be described. The third working example will exemplify an example in which the form and the installing position of the antenna element 20 are different from those in the second working example.

[Configuration of Device]

Figure 21:
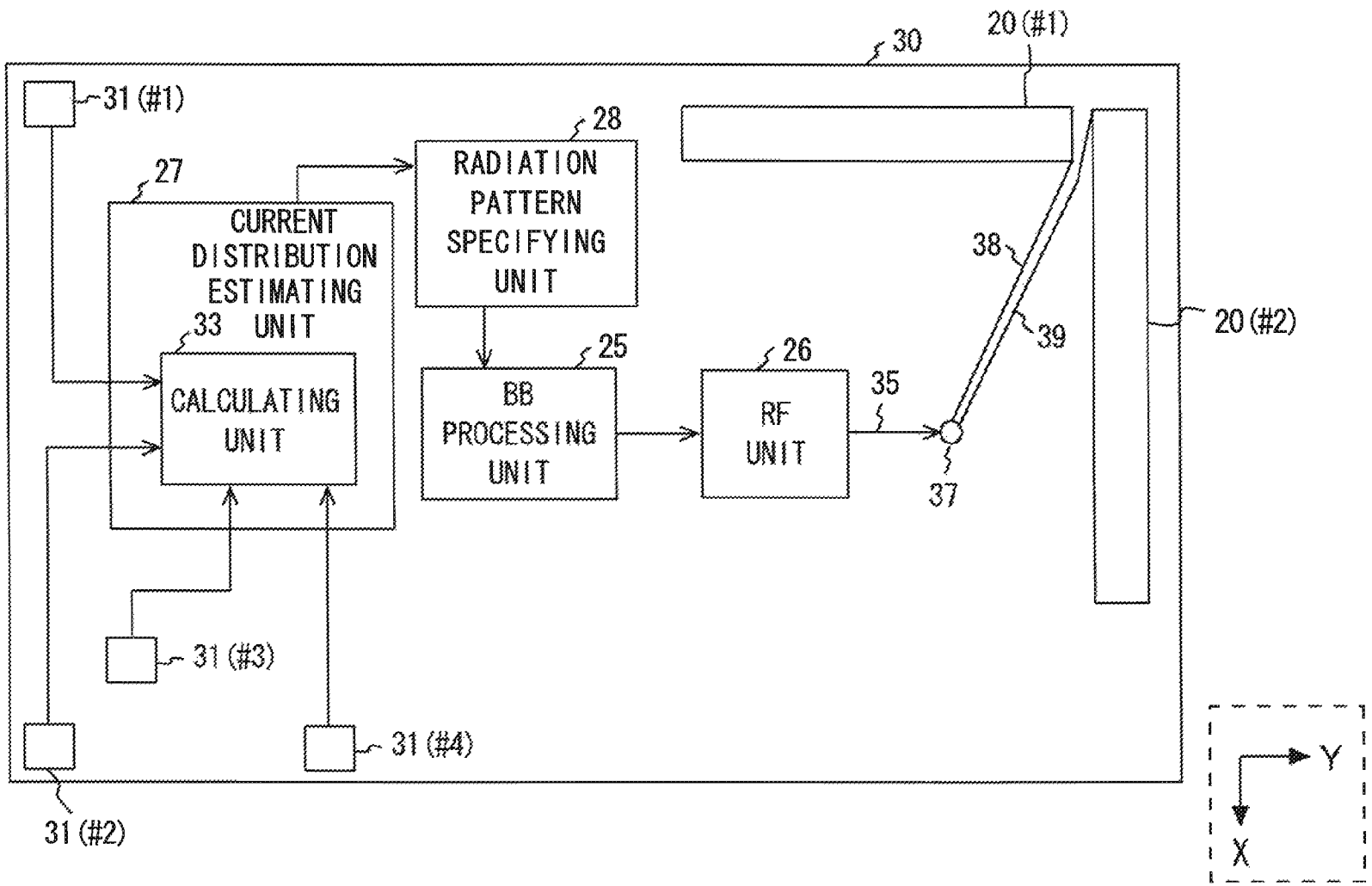
FIG. 21 is a diagram illustrating an example of a partial configuration of the sensor device 1 in a third working example.

FIG. 21 is a diagram illustrating an example of a partial configuration of the sensor device 1 in the third working example. The sensor device 1 in the third working example is different from the sensor device 1 in the second working example in terms of, as illustrated in FIG. 21, the forms and the installing positions of the antenna elements 20 (#1 and #2) and the number and the installing positions of the current sensors 31. Other configurations are the same as in the second working example.

The antenna elements 20 (#1 and #2) are linear conductors each having a predetermined width and form the dipole antennas. The antenna element 20 (#2) is installed in the edge area in the +Y direction and in a position one-sided in the −X direction on the upper surface of the circuit board 30. The antenna element 20 (#1) is installed in the edge area in the −X direction and in a position one-sided in the +Y direction on the upper surface of the circuit board 30. The antenna elements 20 in the third working example are, unlike the second working example, fitted to the positions that are asymmetric with respect to both of the X-axis and the Y-axis.

The differences of the forms and the installing positions of the antenna elements 20 lead to a change in radiation directivity from the circuit board 30 including the antenna elements 20. The change in radiation directivity from the circuit board 30 leads to a change in current distribution on the circuit board 30, which accompanies supplying the electricity to the antenna element 20. Hence, the third working example is different from the second working example in terms of the number and the installing positions of the current sensors 31.

The sensor device 1 in the third working example includes four pieces of current sensors 31 (#1, #2, #3 and #4). The configuration of each current sensor 31 is the same as in the second working example. The number and the installing positions of the current sensors 31 are determined through the electromagnetic field simulation similarly to the second working example.

The current distribution estimating unit 27 and the radiation pattern specifying unit 28 previously retain associative information of the correlation of the respective detected current values and the radiation directivity, which are illustrated in FIG. 22. Note that the associative information is calculated through the electromagnetic field simulation similarly to the second working example. The current distribution estimating unit 27 determines, based on the relation of magnitude between the respective detected current values, the difference absolute value of each detected current value, and the respective detected values, which are transmitted from the calculating unit 33, which pattern in the six current distribution patterns illustrated in FIG. 22 corresponds to the correlation of the respective detected current values. The radiation pattern specifying unit 28 acquires the directivity code associated with the current distribution pattern estimated by the current distribution estimating unit 27.

FIG. 22 is a diagram illustrating an example of the associative relation between the detected current and the radiation directivity in the third working example. In FIG. 22, the symbol "A" represents the detected current value of the current sensor 31 (#1), "B" designates the detected current value of the current sensor 31 (#2), "C" stands for the detected current value of the current sensor 31 (#3), and "D" represents the detected current value of the current sensor 31 (#4).

According to the example in FIG. 22, a current distribution pattern 1 represents a relation in which the respective differences between B, C and D are larger than a predetermined value, D is larger than C, and C is larger than B. A current distribution pattern 2 represents a relation in which A is larger than B by a difference value exceeding the predetermined value. A current distribution pattern 3 represents a relation in which the differences between B, C and D fall within the predetermined value. A current distribution pattern 4 represents a relation in which the difference between B and C falls within the predetermined value, and D is larger than B and C by a difference value exceeding the predetermined value. A current distribution pattern 5 represents a relation in which the difference between C and D falls within the predetermined value, and B is smaller than C and D by a difference value exceeding the predetermined value. A current distribution pattern 6 represents a relation in which the difference between B and C falls within the predetermined value, and D is larger than B and C by a difference value exceeding the predetermined value and by a difference value exceeding the difference value between D and B, C in the current distribution pattern. It should be noted that the predetermined value, similarly to the second working example, may not be used depending on the accuracy of the current value detected by the current sensor 31. The respective current distribution patterns through 6 illustrated in FIG. 22 correspond to current distributions estimated by the current distribution estimating unit 27.

[Method of Determining Position of Current Sensor]

The positions where the current sensors 31 (#1, #2, #3 and #4) are disposed are determined as those enabling the detection of the current distribution corresponding to the change in radiation directivity due to the obstacle by employing the same methods and the same analytic models as those in the second working example.

As the results of the electromagnetic field simulations, in the sensor device 1 of the third working example, the four positions A, B, C and D are determined to be the current detecting positions. With respect to the current detecting positions, the positions A, B, C and D are determined in the areas which are spaced-apart from the antenna elements 20 and where the distinction between the changes in current distributions is distinguishable. The scheme of facilitating the distinction between the changes in current distributions in the areas spaced away from the antenna elements 20, is the same as in the form of the antenna element 20 in the second working example.

The results of the electromagnetic field simulations in the analytic models given above will hereinafter be described, and the four current detecting positions A, B, C and D in the third working example will be verified.

Figure 23:
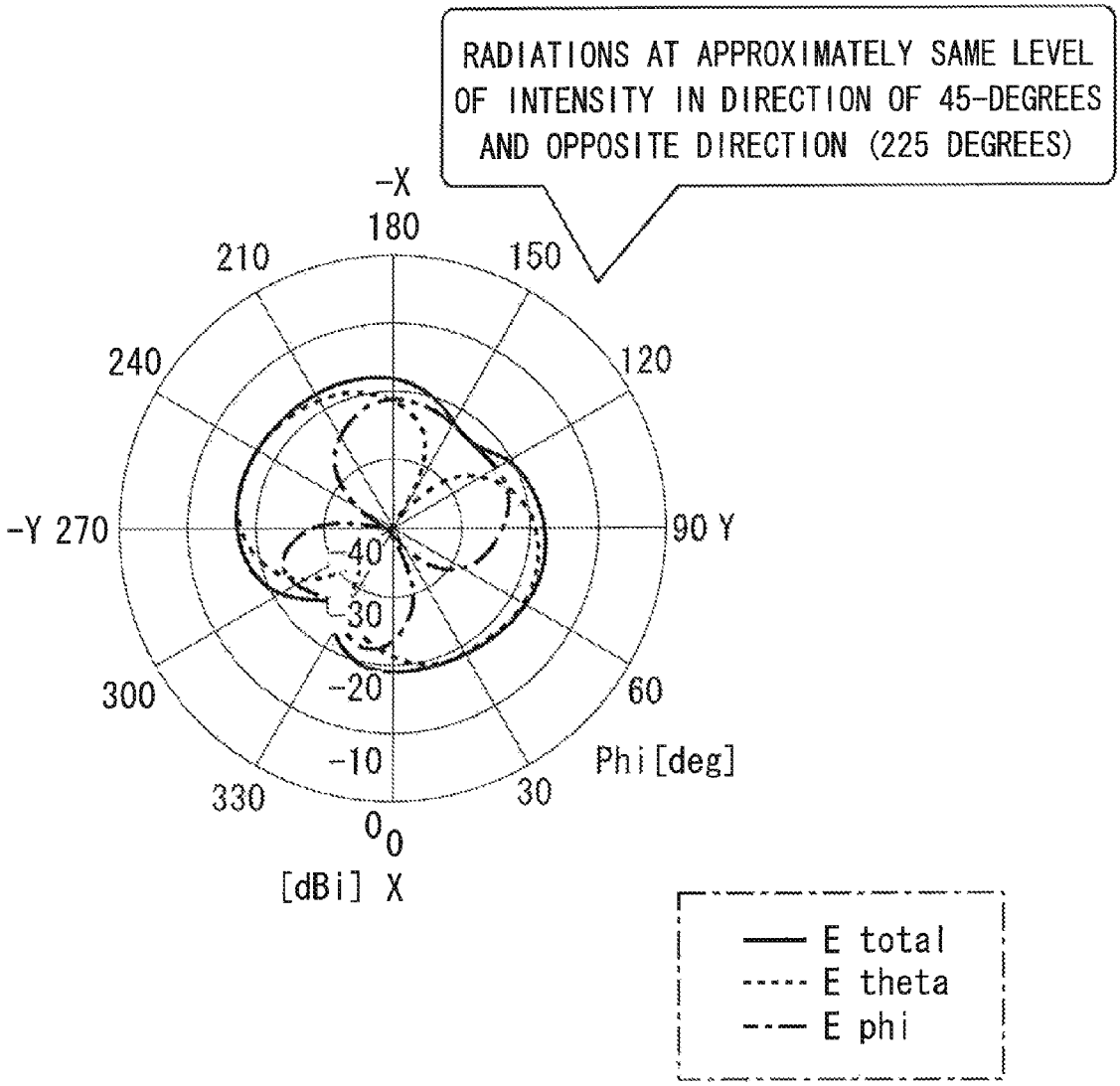
FIG. 23 is a graph illustrating the radiation directivity on the X-Y plane in the model 1.
Figure 24:
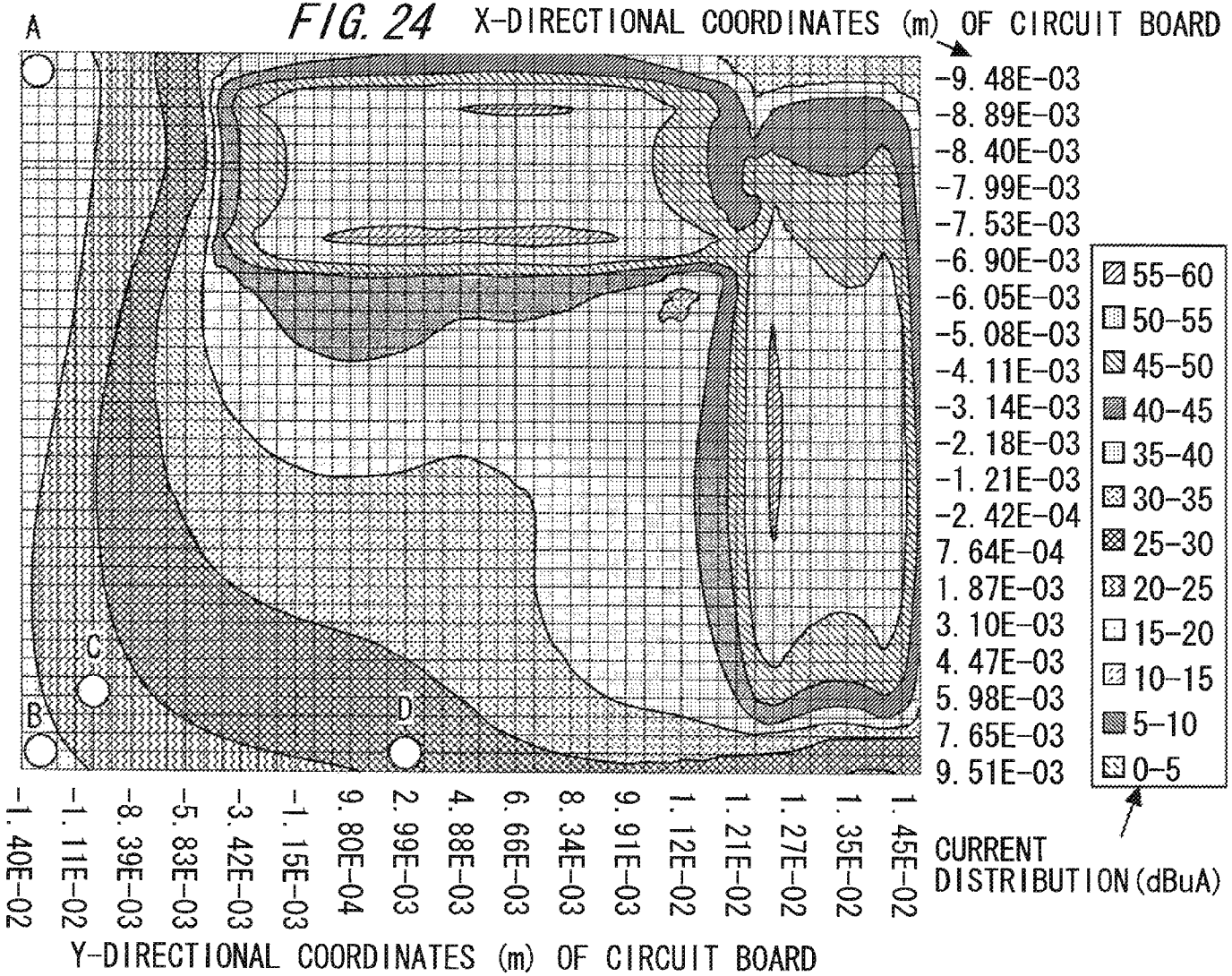
FIG. 24 is a graph illustrating the current distribution on the circuit board 30 in the model 1.

FIG. 23 is a graph illustrating the radiation pattern on the X-Y plane in the model 1. FIG. 24 is a graph illustrating the current distribution on the circuit board 30 in the model 1. In the model 1, i.e., the radiation pattern in a state where none of the obstacle exists in the vicinity of the sensor device 1, as illustrated in FIG. 23, the signals are radiated at approximately the same level of intensity in a 45-degrees direction and an opposite 225-degrees direction on the X-Y plane where the +X direction is set at 0 degree and the +Y direction is set at 90 degrees. The current distribution of the model 1 is that as depicted in FIG. 24, the maximum current flows in the position close to the antenna element 20, however, the current becomes gradually smaller as the position gets away (in a 315-degrees direction) from the antenna element 20.

In this case, the positions A and B belong to the current distribution ranging from 15 [dBuA] to 20 [dBuA], the position C belongs to the current distribution ranging from 20 [dBuA] to 25 [dBuA], and the position D belongs to the current distribution ranging from 25 [dBuA] to 30 [dBuA]. Hence, if the current value in the position C is larger than a current value difference between the position A and the position B by a difference value exceeding 5 [dBuA] and if the current value in the position D is larger than the current value in the position C by a difference value exceeding 5 [dBuA], the radiation pattern in the case of having no obstacle, i.e., the radiation pattern having approximately the same level of intensity in the 45-degrees direction and the 225-degrees direction, can be specified as the present radiation directivity.

Figure 25:
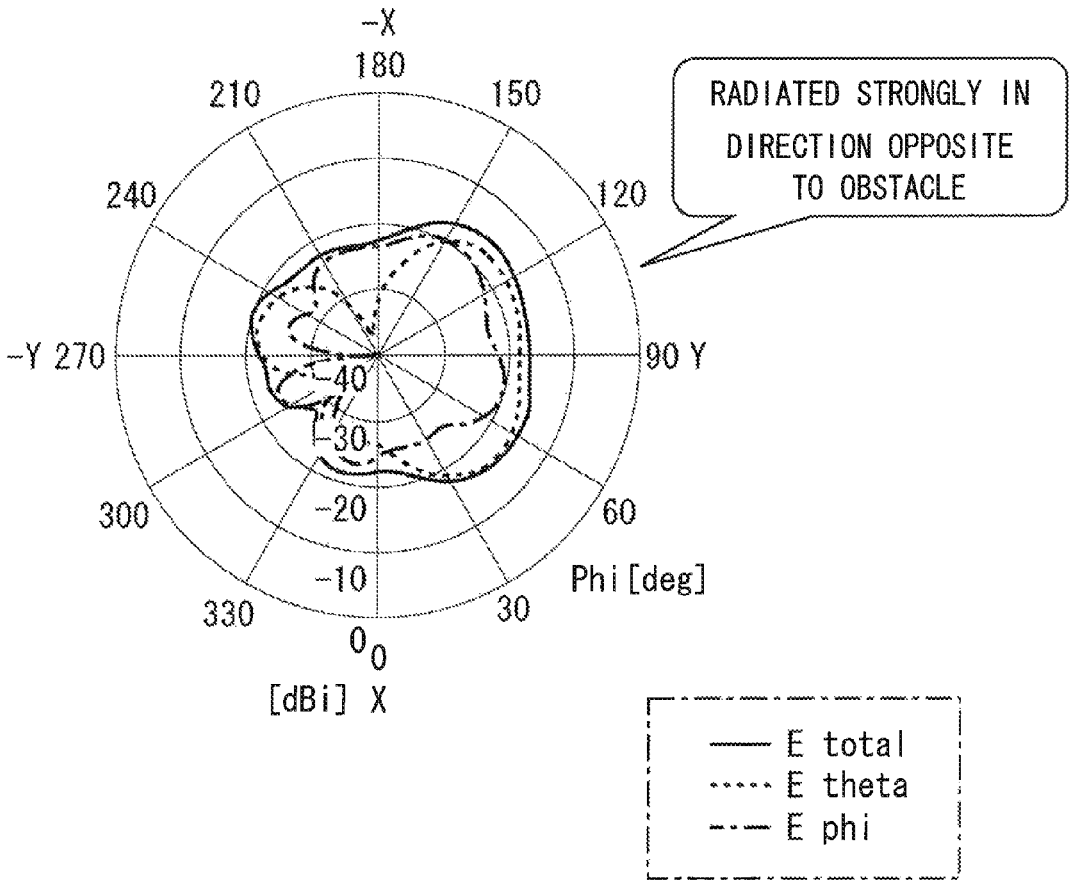
FIG. 25 is a graph illustrating the radiation directivity on the X-Y plane in the model 2.
Figure 26:
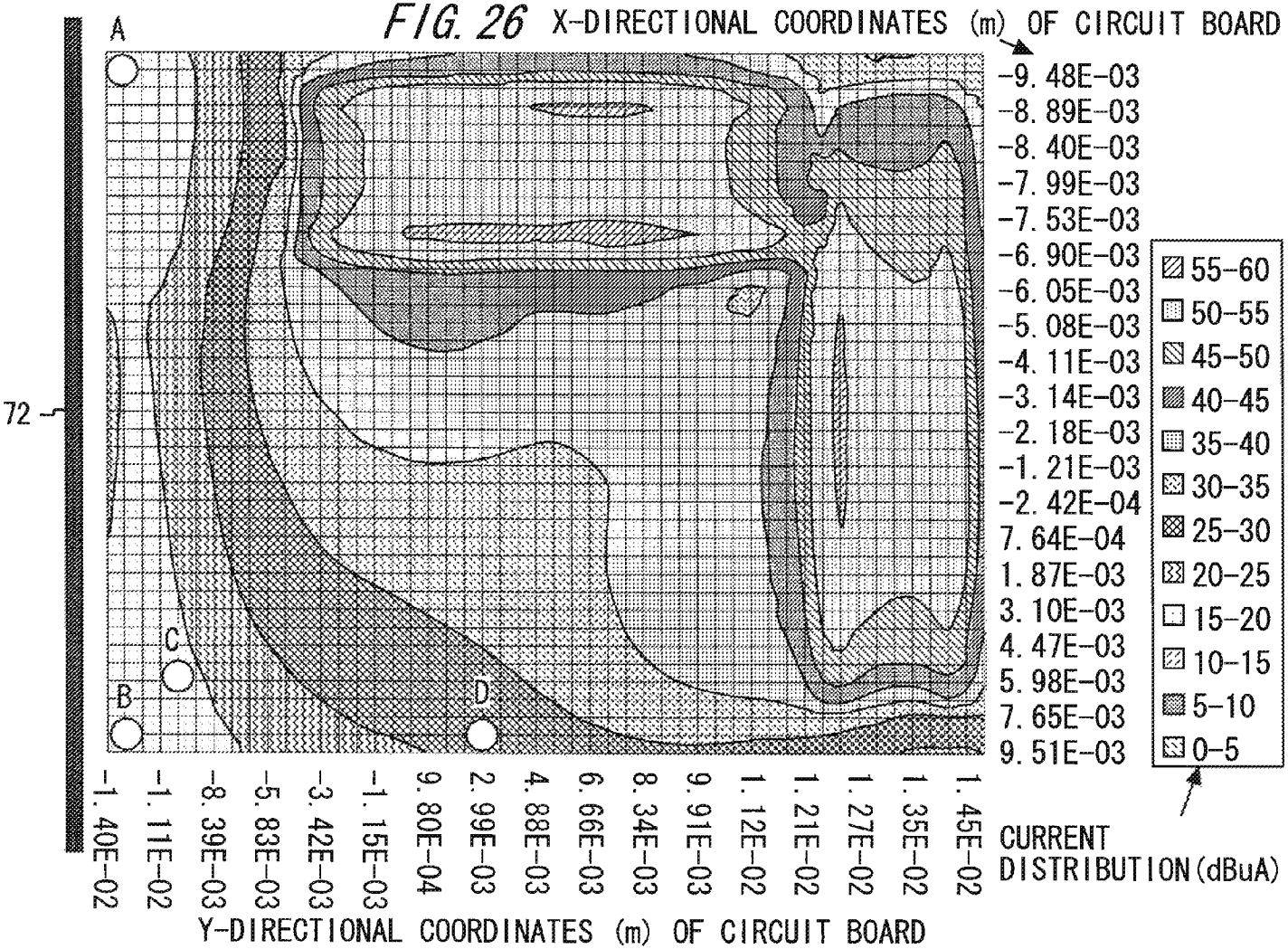
FIG. 26 is a graph illustrating the current distribution on the circuit board 30 in the model 2.

FIG. 25 is a graph illustrating the radiation pattern on the X-Y plane in the model 2. FIG. 26 is a graph illustrating the current distribution on the circuit board 30 in the model 2. In the radiation pattern of the model 2, the radiation is, as illustrated in FIG. 25, strong on the side (in the +Y direction) opposite to the position of the obstacle, but any remarkable bias of the radiation directivity is not seen in the ±X directions. In the current distribution of this model 2, as depicted in FIG. 26, the current distribution ranging from 15 [dBuA] to 20 [dBuA] spreads most widely in the area vicinal to the obstacle.

As a result, the positions A, B and C belong to the same current distribution (ranging from 15 [dBuA] to 20 [dBuA]), and hence the current value difference between the respective positions falls within 5 [dBuA]. On the other hand, the position D belongs to the current distribution ranging from 25 [dBuA] to 30 [dBuA], and therefore the current value in the position D is larger than each of the current values in other positions A, B and C by a difference exceeding 5 [dBuA]. Hence, if the current value difference between the positions A, B and C falls within 5 [dBuA] and if the current value in the position D is larger than each of the current values in other positions A, B and C by a difference exceeding 5 [dBuA], the radiation pattern, which is strong in the +Y direction, can be specified as the present radiation directivity.

Figure 27:
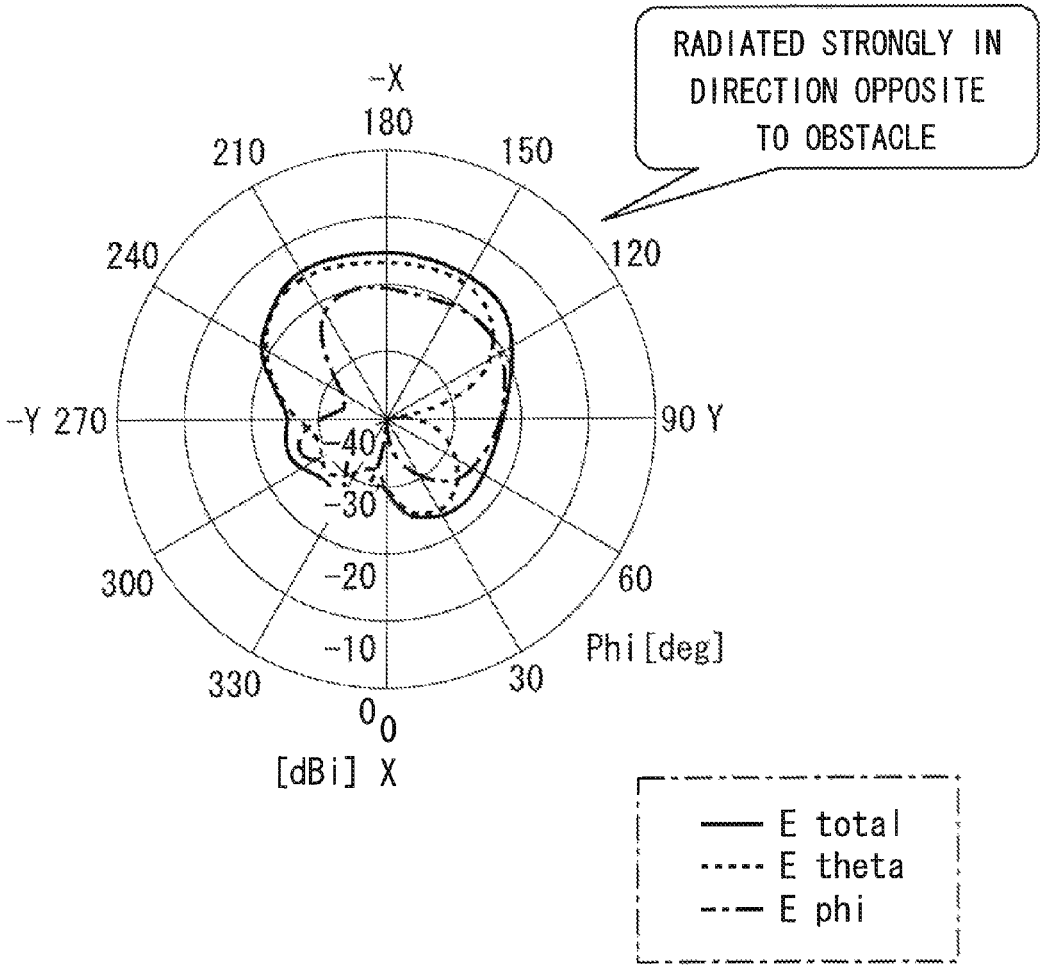
FIG. 27 is a graph illustrating the radiation directivity on the X-Y plane in the model 3.
Figure 28:
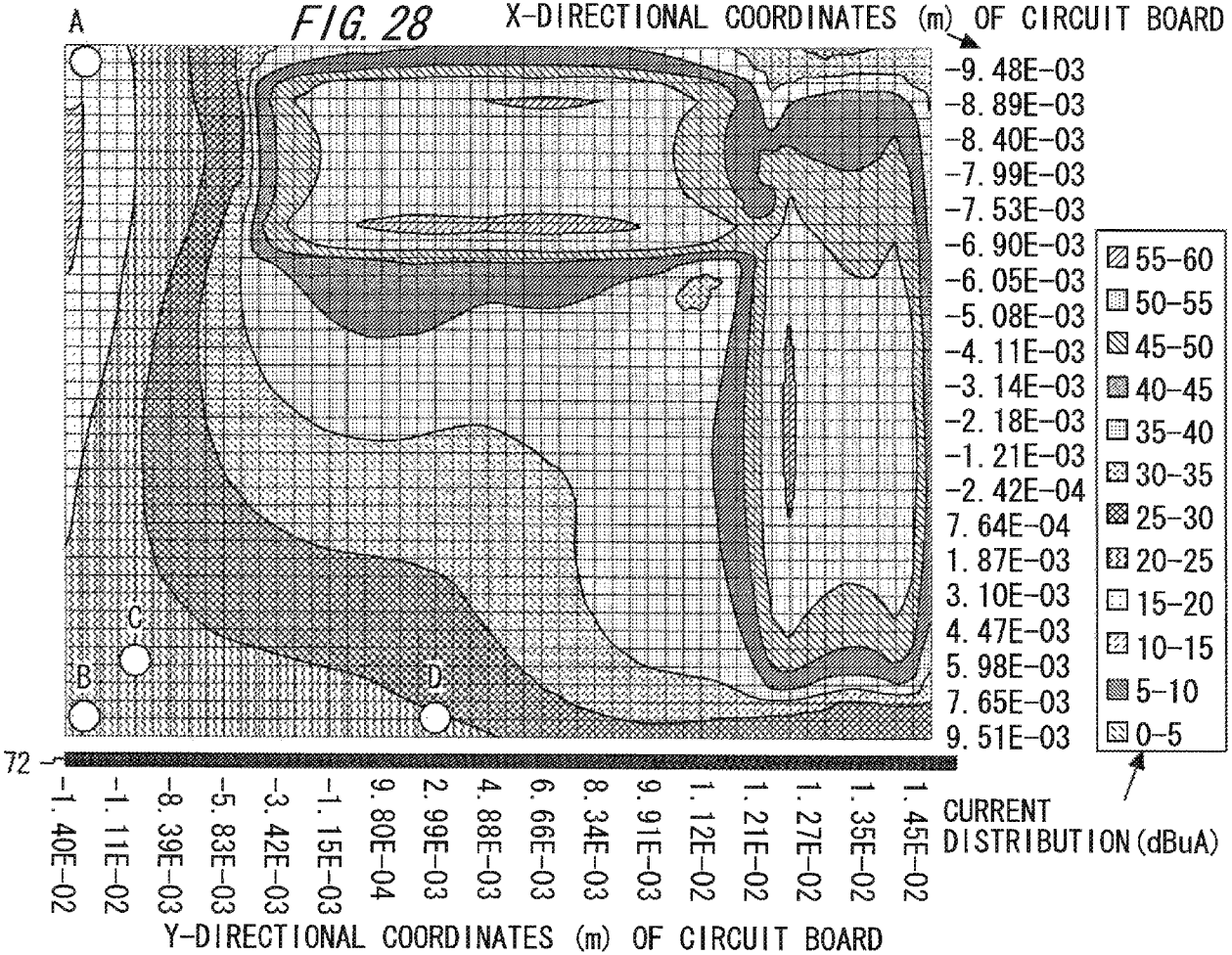
FIG. 28 is a graph illustrating the current distribution on the circuit board 30 in the model 3.

FIG. 27 is a graph illustrating the radiation pattern on the X-Y plane in the model 3. FIG. 28 is a graph illustrating the current distribution on the circuit board 30 in the model 3. In the radiation pattern of the model 3, as illustrated in FIG. 27, there is no remarkable bias of the radiation directivity in the ±Y directions, and the radiation is strong in the direction opposite to the obstacle. In the current distribution of the model 3, as illustrated in FIG. 28, the current distribution ranging from 20 [dBuA] to 25 [dBuA] is larger than in the models 1 and 2 in the edge area in the −Y direction in the position (the +X directional edge area) close to the obstacle.

In this case, the positions B, C and D belong to the current distribution ranging from 20 [dBuA] to 25 [dBuA]. Hence, if the current value difference between the positions B, C and D falls within 5 [dBuA], the radiation pattern, which is strong in the −X direction, can be specified as the present radiation directivity.

Figure 29:
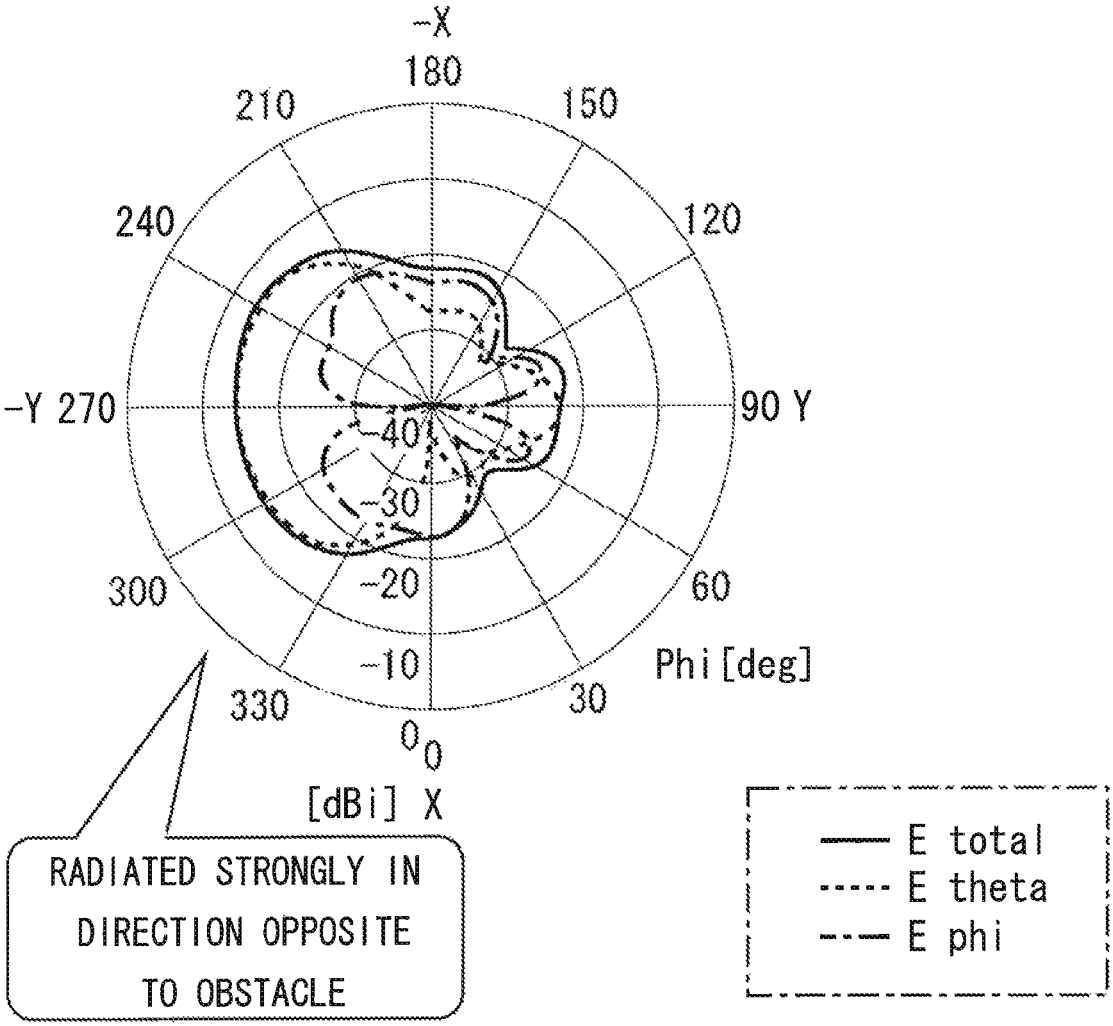
FIG. 29 is a graph illustrating the radiation directivity on the X-Y plane in the model 4.
Figure 30:
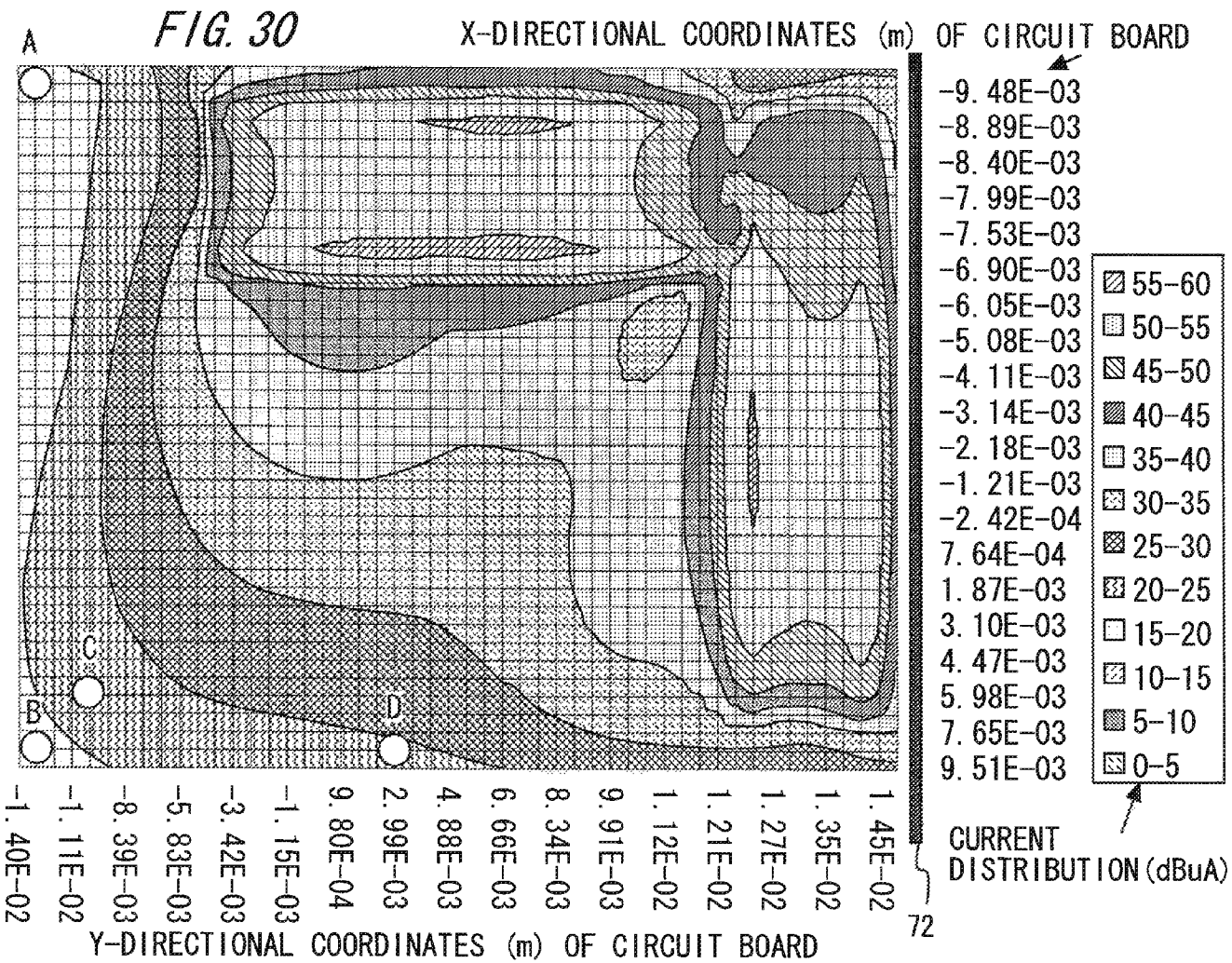
FIG. 30 is a graph illustrating the current distribution on the circuit board 30 in the model 4.

FIG. 29 is a graph illustrating the radiation pattern on the X-Y plane in the model 4. FIG. 30 is a graph illustrating the current distribution on the circuit board 30 in the model 4. In the radiation pattern of the model 4, as illustrated in FIG. 29, there is no remarkable bias of the radiation directivity in the ±X directions, and the radiation is strong in the −Y direction opposite to the obstacle. In the current distribution of the model 4, as illustrated in FIG. 30, the current value starts reducing from the position vicinal to the antenna element 20 as compared with the model 1. With this reduction, the current distributions ranging from 30 [dBuA] to 35 [dBuA], ranging from 25 [dBuA] to 30 [dBuA] and ranging from 20 [dBuA] to 25 [dBuA] deviate from those in the model 1 in the direction getting close to the antenna.

From this point, the positions A and B belong to the current distribution ranging from 15 [dBuA] to 20 [dBuA], and the positions C and D belong to the current distribution ranging from 20 [dBuA] to 25 [dBuA]. Hence, if the current value difference between the positions C and D falls within 5 [dBuA] and if the current values in the positions C and D are larger than the current values in the positions A and B by a difference exceeding 5 [dBuA], the radiation pattern, which is strong in the −Y direction, can be specified as the present radiation directivity.

Figure 31:
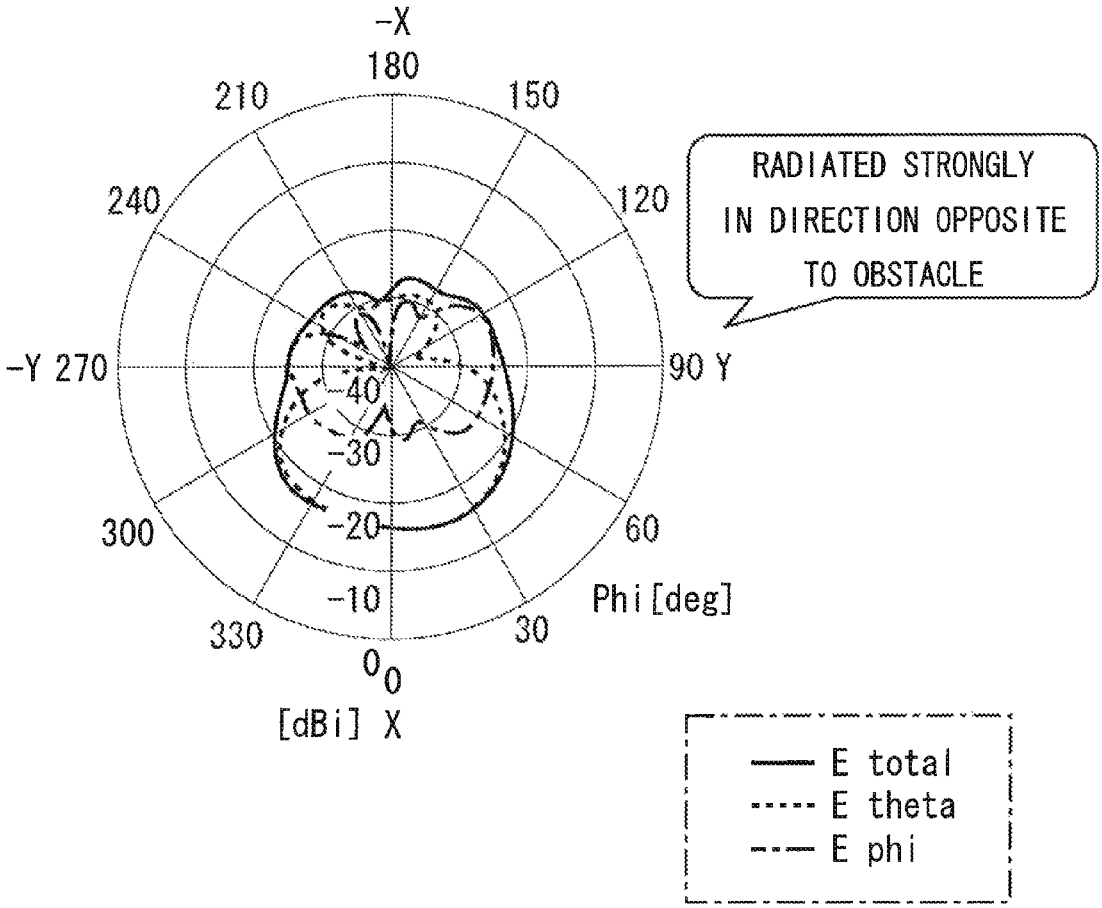
FIG. 31 is a graph illustrating the radiation directivity on the X-Y plane in the model 5.
Figure 32:
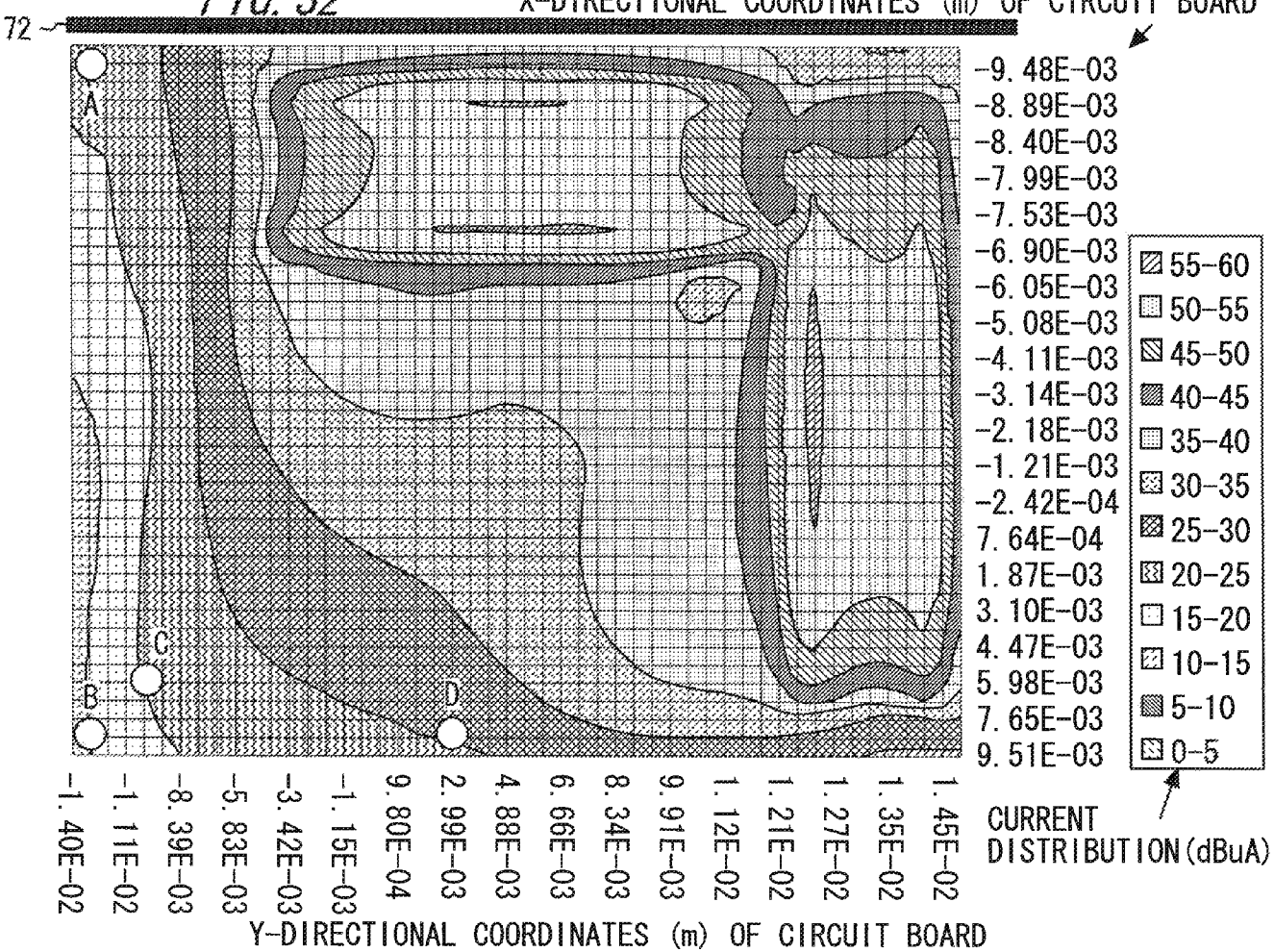
FIG. 32 is a graph illustrating the current distribution on the circuit board 30 in the model 5.

FIG. 31 is a graph illustrating the radiation pattern on the X-Y plane in the model 5. FIG. 32 is a graph illustrating the current distribution on the circuit board 30 in the model 5. In the radiation directivity of the model 5, as illustrated in FIG. 31, there is no remarkable bias of the radiation directivity in the ±Y directions, and the radiation is strong in the +X direction opposite to the obstacle. In the current distribution of the model 5, as illustrated in FIG. 32, the current distributions ranging from 15 [dBuA] to 20 [dBuA] and ranging from 10 [dBuA] to 15 [dBuA] widely spread in the edge area in the direction spaced away from the antenna element 20 as compared with the model 1.

As a result, the current value in the position D is larger than the current value in the position C by its difference exceeding 5 [dBuA], and the current value in the position C is larger than the current value in the position B by its difference exceeding 5 [dBuA]. Accordingly, the relation between the positions B, C and D is the same as that in the model 1, and it is therefore impossible to distinguish between the model 1 and the model 5. Such being the case, the model 5 is distinguished from other models on the basis of the relation between the position A and the position B. In other models, the current value difference between the position A and the position B falls within 5 [dBuA] or the current value in the position A is smaller than the current value in the position B by its difference exceeding 5 [dBuA]. Hence, in such a case that the current value in the position A is larger than the current value in the position B by its difference exceeding 5 [dBuA], this pattern can be specified as the model 5.

From this point, if the current value in the position A is larger than the current value in the position B by its difference exceeding 5 [dBuA], the radiation pattern, which is strong in the +X direction, can be specified.

Figure 33:
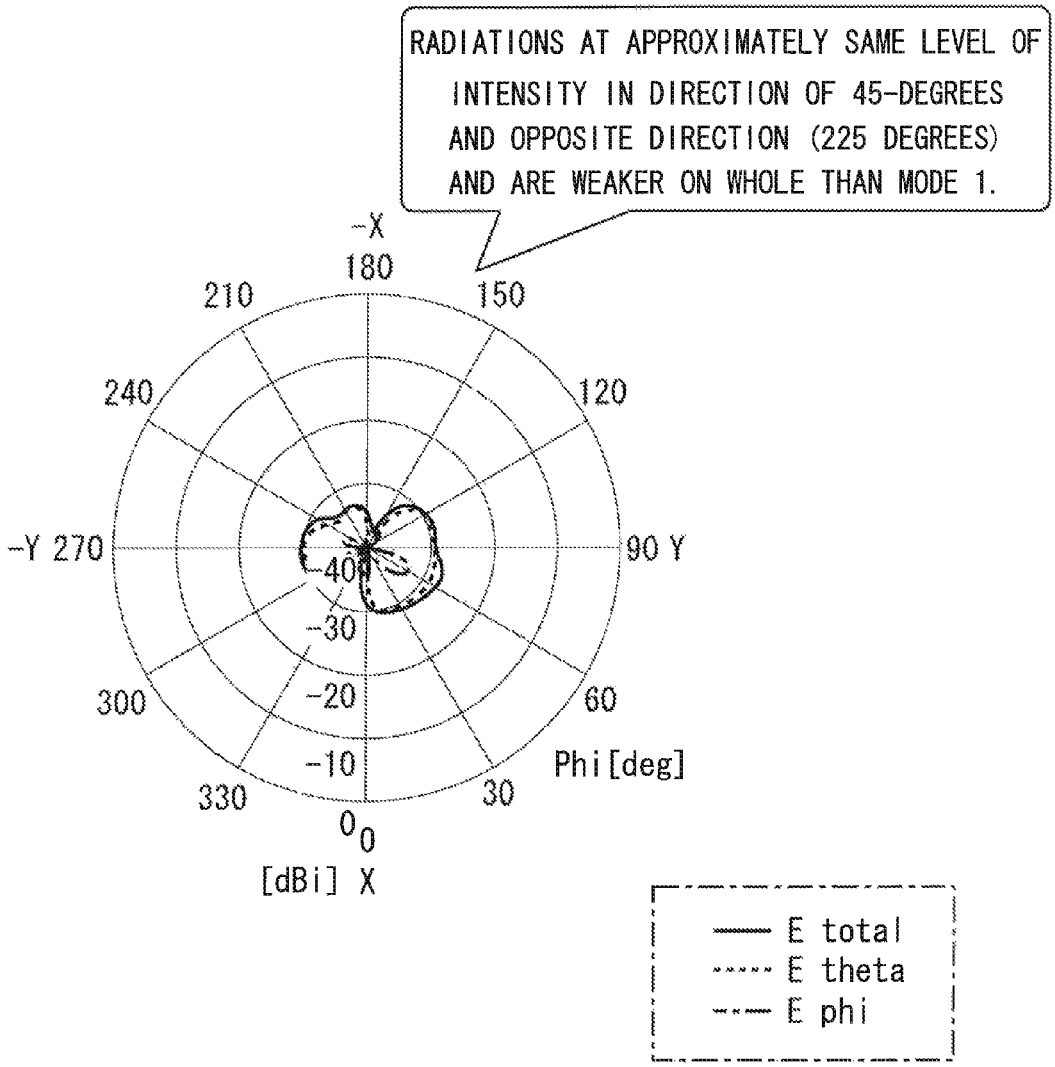
FIG. 33 is a graph illustrating the radiation directivity on the X-Y plane in the model 6.
Figure 34:
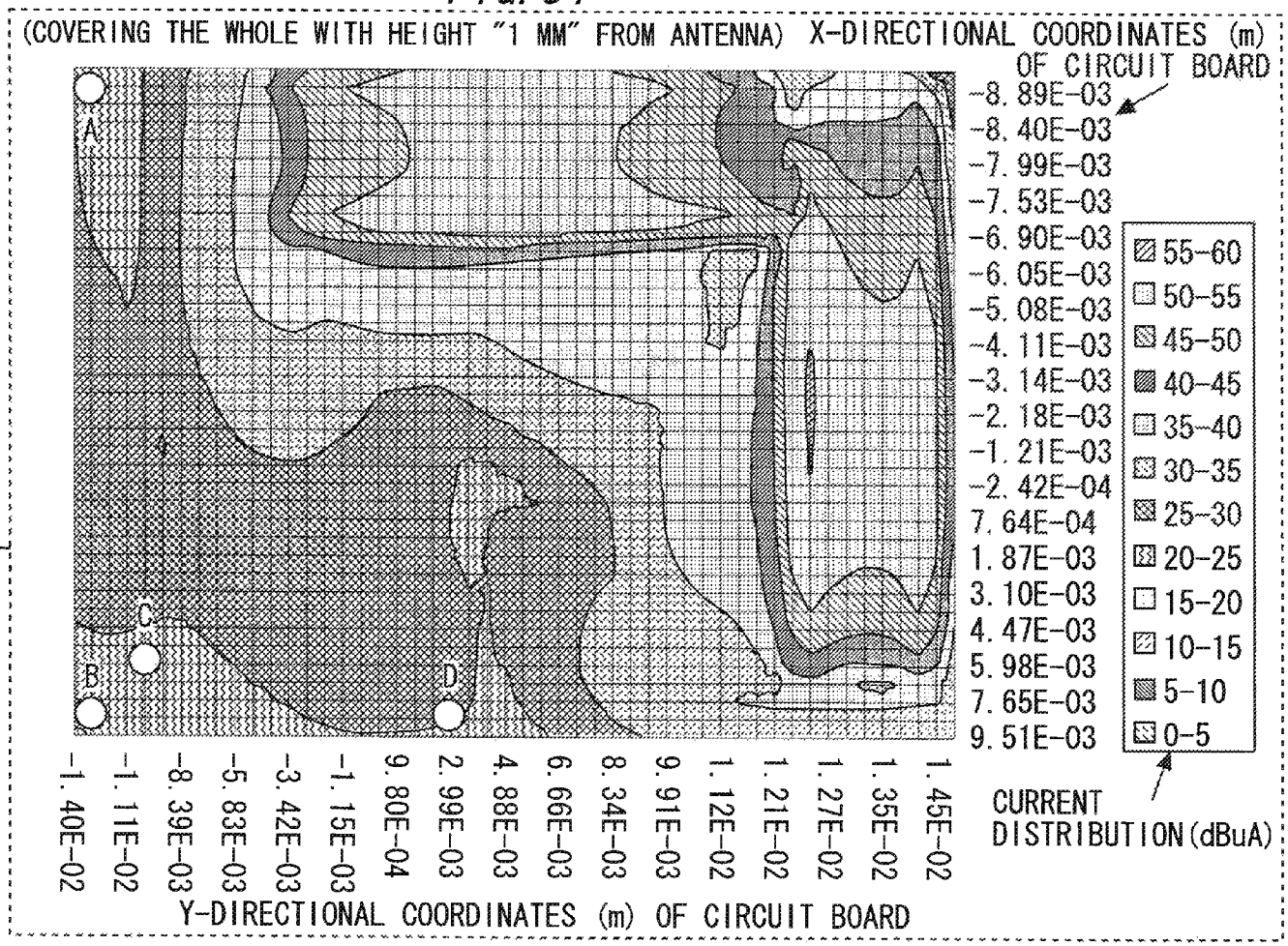
FIG. 34 is a graph illustrating the current distribution on the circuit board 30 in the model 6.

FIG. 33 is a graph illustrating the radiation pattern on the X-Y plane in the model 6. FIG. 34 is a graph illustrating the current distribution on the circuit board 30 in the model 6. The radiation pattern of the model 6, as illustrated in FIG. 33, has the weaker radiation on the whole than the model 1. In the current distribution of the model 6, as illustrated in FIG. 34, the current values ranging from 25 [dBuA] to 30 [dBuA] widely spread.

In this case, the current values in the positions A, B and C belong to the current distribution ranging from 20 [dBuA] to 25 [dBuA], and the current value in the position D belongs to the current distribution ranging from 25 [dBuA] to 30 [dBuA]. From this point, the model 6 corresponds to a case in which the current value difference between the positions A, B and C falls within 5 [dBuA], and the current value in the position D is larger than each of the current values in the positions A, B and C by its difference exceeding 5 [dBuA]. The relationship between these positions A, B, C and D is, however, the same as that in the model 2. The current value difference between the positions A, B, C and D in the model 6 is, however, smaller than that in the model 2. Hence, if the current value difference between the positions A, B and C falls within 5 [dBuA] and if the current value in the position D is larger than each of the current values in the positions A, B and C by its difference exceeding the difference in the model 2, the radiation pattern, which has the same level of intensity in the 45-degrees direction and the 225-degrees direction and is weaker on the whole than the model 1, can be specified as the present radiation directivity.

Figure 35:
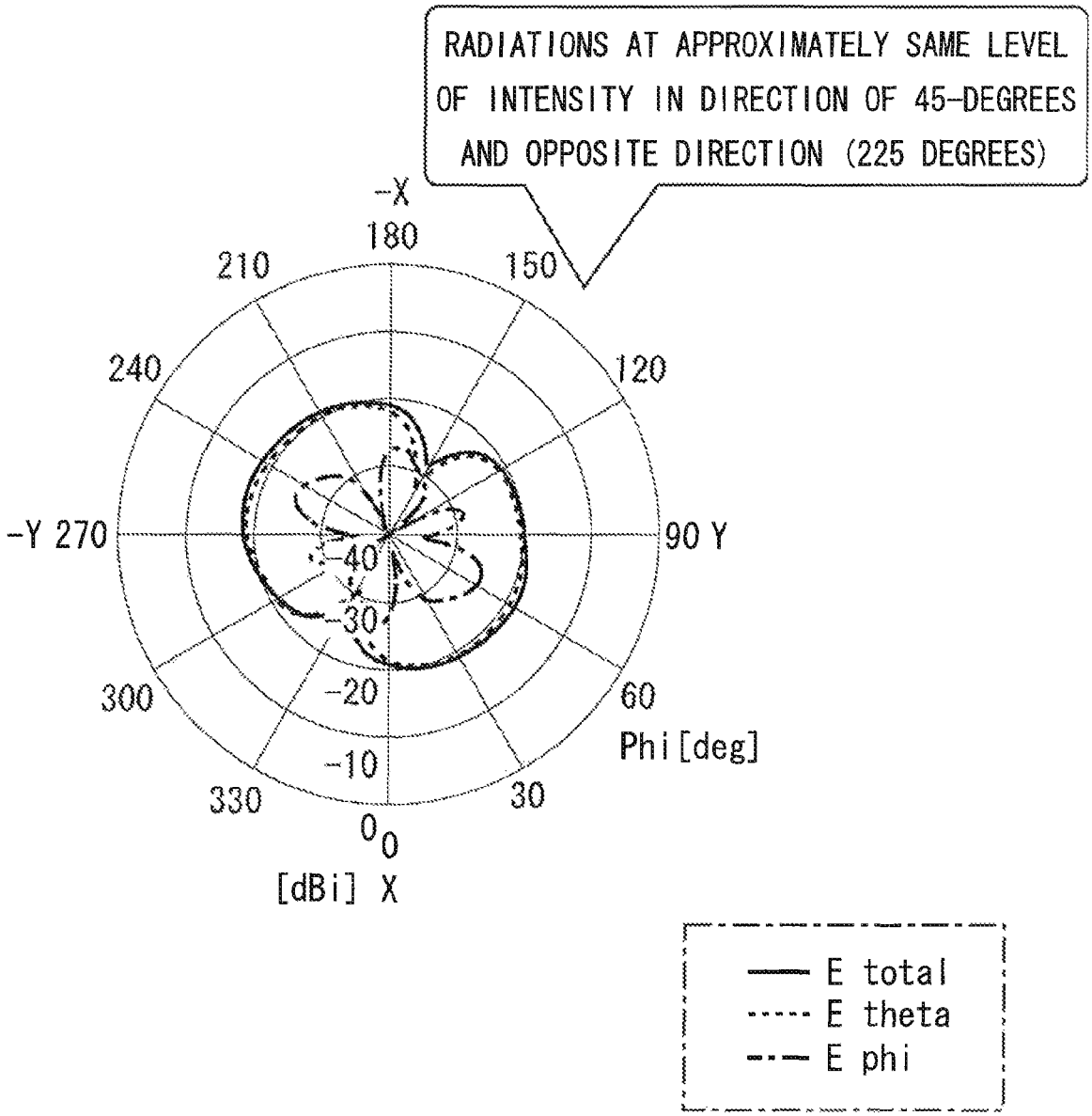
FIG. 35 is a graph illustrating the radiation directivity on the X-Y plane in the model 7.
Figure 36:
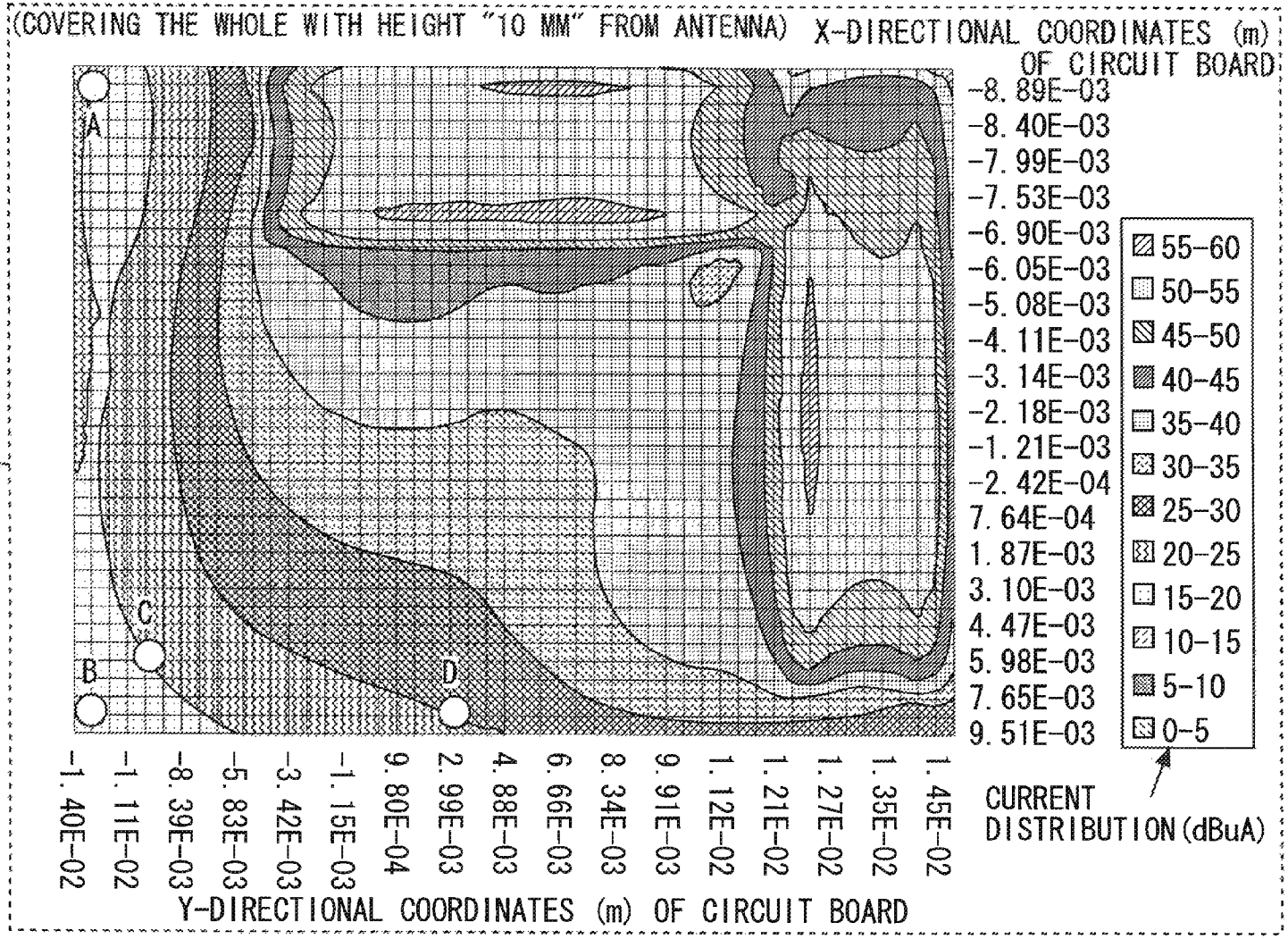
FIG. 36 is a graph illustrating the current distribution on the circuit board 30 in the model 7.

FIG. 35 is a graph illustrating the radiation pattern on the X-Y plane in the model 7. FIG. 36 is a graph illustrating the current distribution on the circuit board 30 in the model 7. The radiation pattern of the model 7 is, as illustrated in FIG. 35, similar to the radiation pattern in the model 1. The current distribution in the model 7 has, though not explicitly illustrated in FIG. 36 in terms of the matter of precision of the graph, no large difference from the model 1 having none of the obstacle. Hence, without distinguishing between the model 7 and the model 1, the same radiation pattern can be specified as the present radiation directivity.

According to the results of the electromagnetic field simulation described above, it is feasible to acquire the associative relation between the current distribution and the radiation pattern of each model as illustrated in FIG. 22. According to the example in FIG. 22, the models 1 and 7 indicate the current distribution pattern 1 in FIG. 22 and the radiation pattern associated therewith. Similarly, the model 5 indicates the current distribution pattern 2 in FIG. 22, the model 3 indicates the current distribution pattern 3 in FIG. 22, the model 2 indicates the current distribution pattern 4 in FIG. 22, the model 4 indicates the current distribution pattern state 5 in FIG. 22, and the model 6 indicates the current distribution pattern 6 in FIG. 22.

Furthermore, it is possible to verify that the current distributions of the respective models, i.e., the individual current distribution patterns corresponding to the position of the obstacle can be estimated by use of the current values detected in the four current detecting positions A, B, C and D. As a result, the current sensors 31 (#1, #2, #3 and #4) are disposed in the thus-determined current detecting positions, and the sensor device 1 in the third working example can be realized by incorporating the relationship between the correlations of the current values detected in the respective current detecting positions and the radiation patterns into the current distribution estimating unit 27 and the radiation pattern specifying unit 28.

It should be noted that the present method, as discussed above, provides the current detecting position A for distinguishing the model 5 from other models. Though the radiation pattern specifying accuracy declines, however, in the case of the model 5 also, the same radiation patterns as those in the model 1 may be specified without providing the current detecting position A. Thus, the number and the positions of the current sensors 31 may be determined in a way that takes account of a balance between the radiation pattern specifying accuracy and other matters such as a free area on the circuit board 30.

Even in the case of using the antenna element 20 taking the different form from that in the second working example as discussed above, the number and the installing positions of the current sensors 31 are determined in accordance with the form of the antenna element 20, whereby the same effects as those in the second working example can be acquired.

Fourth Working Example

The sensor device 1 in a fourth working example will hereinafter be described. The fourth working example will exemplify an example in which the form and the installing position of the antenna element 20 are different from those in the second and third working examples.

[Configuration of Device]

Figure 37:
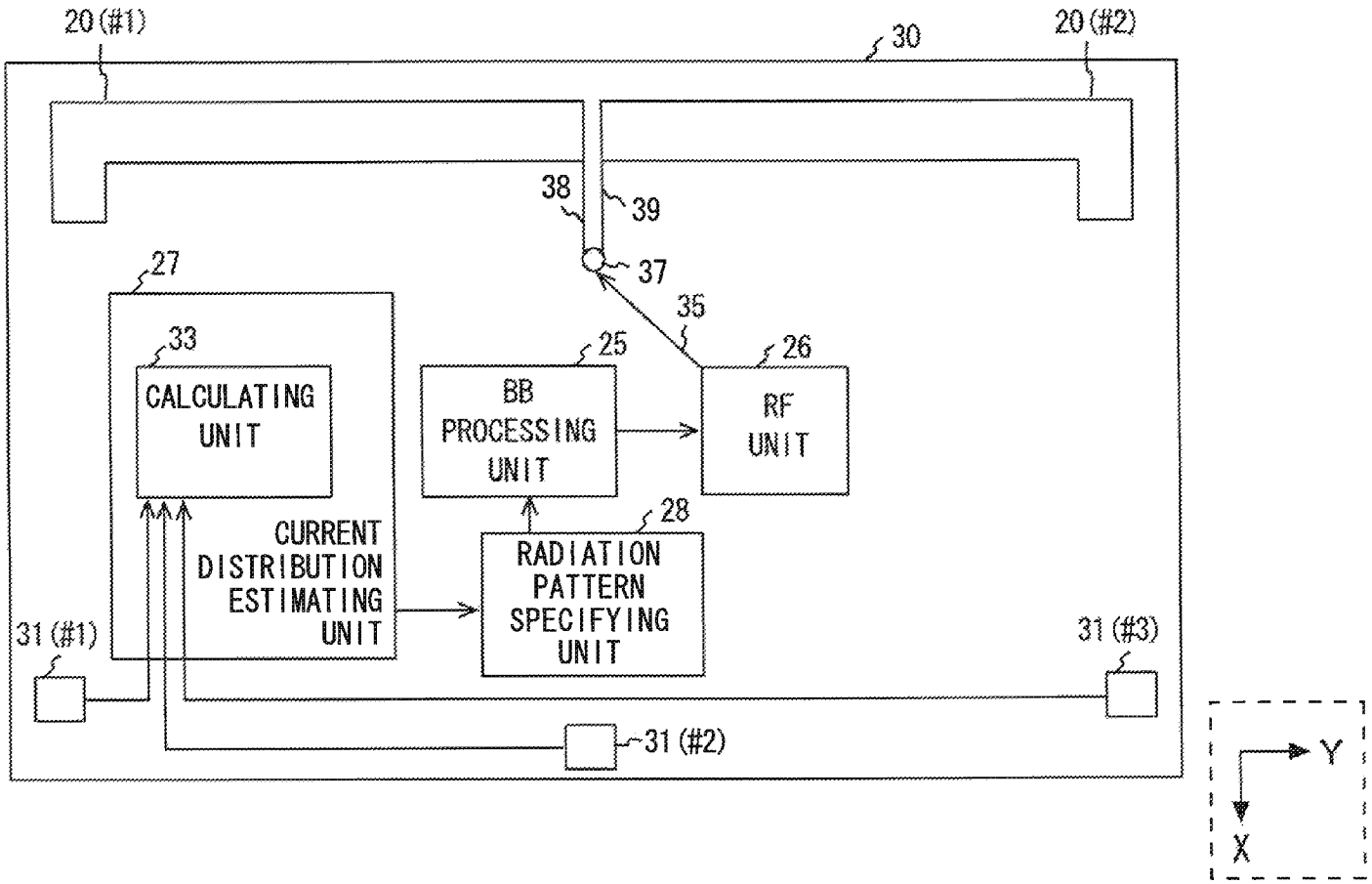
FIG. 37 is a diagram illustrating an example of a partial configuration of the sensor device 1 in a fourth working example.

FIG. 37 is a diagram illustrating an example of a partial configuration of the sensor device 1 in the fourth working example. The sensor device 1 in the fourth working example is different from the sensor device 1 in the second working example in terms of, as illustrated in FIG. 37, the forms and the installing positions of the antenna elements 20 (#1 and #2) and the installing positions of the current sensors 31. Other configurations are the same as in the second working example.

The antenna elements 20 (#1 and #2) are L-shaped linear conductors each having a predetermined width and form the dipole antennas. The antenna elements 20 (#1 and #2) in the fourth working example are, as illustrated in FIG. 37, fitted to the edge area in the −X direction on the upper surface of the circuit board 30 so that these antenna elements 20 are symmetric with respect to the center along the Y-axis (in the longitudinal direction) of the circuit board 30. Namely, the arrangement that the antenna elements 20 in the fourth working example are provided in the edge area on the long side, is different from the arrangement in the second working example in which the antenna elements 20 in the second working example are provided in the edge area on the short side.

The sensor device 1 in the fourth working example includes three pieces of current sensors 31 (#1, #2 and #3). The current distribution estimating unit 27 and the radiation pattern specifying unit 28 previously retain the associative information of the correlation of the respective detected current values and the radiation directivity, which are illustrated in FIG. 38. The installing positions of the respective current sensors 31 and the associative information are determined through the electromagnetic field simulations etc in the same way as in the second and third working examples.

FIG. 38 is a diagram illustrating an example of the associative relation between the detected current and the radiation directivity in the fourth working example. In FIG. 38, the symbol "A" represents the detected current value of the current sensor 31 (#1), "B" designates the detected current value of the current sensor 31 (#2), and "C" stands for the detected current value of the current sensor 31 (#3)

According to the example in FIG. 38, a current distribution pattern 1 represents a relation in which the difference between A and C falls within the predetermined value, and B is larger than A and C by a difference value exceeding the predetermined value. A current distribution pattern 2 represents a relation in which A, B and C are approximate to each other with a difference that is within the predetermined value. A current distribution pattern 3 represents a relation in which B and C are approximate to each other with a difference that is within the predetermined value, and B and C are larger than A by a difference value exceeding the predetermined value. A current distribution pattern 4 represents a relation in which A and B are approximate to each other with a difference that is within the predetermined value, and C is smaller than A and B by a difference value exceeding the predetermined value. The respective current distribution patterns 1 through 4 illustrated in FIG. 38 correspond to current distributions estimated by the current distribution estimating unit 27.

[Method of Determining Position of Current Sensor]

In the fourth working example also, the positions where the current sensors 31 (#1, #2 and #3) are disposed are determined as those enabling the detection of the current distribution corresponding to the change in radiation directivity due to the obstacle by employing the same methods and the same analytic models as those in the second and third working examples.

As the results of the electromagnetic field simulations, in the sensor device 1 of the fourth working example, the three positions A, B and C are determined to be the current detecting positions, corresponding to the form of the antenna element 20. With respect to the current detecting positions, the positions A, B and C are determined in the areas which are spaced-apart from the antenna elements 20 and where the distinction between the changes in current distributions is distinguishable. The scheme of facilitating the distinction between the changes in current distributions in the areas spaced-apart from the antenna elements 20, is the same as in the form of the antenna element 20 in the second and third working examples.

The results of the electromagnetic field simulations in the analytic models given above will hereinafter be described, and the three current detecting positions A, B and C will be verified.

Figure 39:
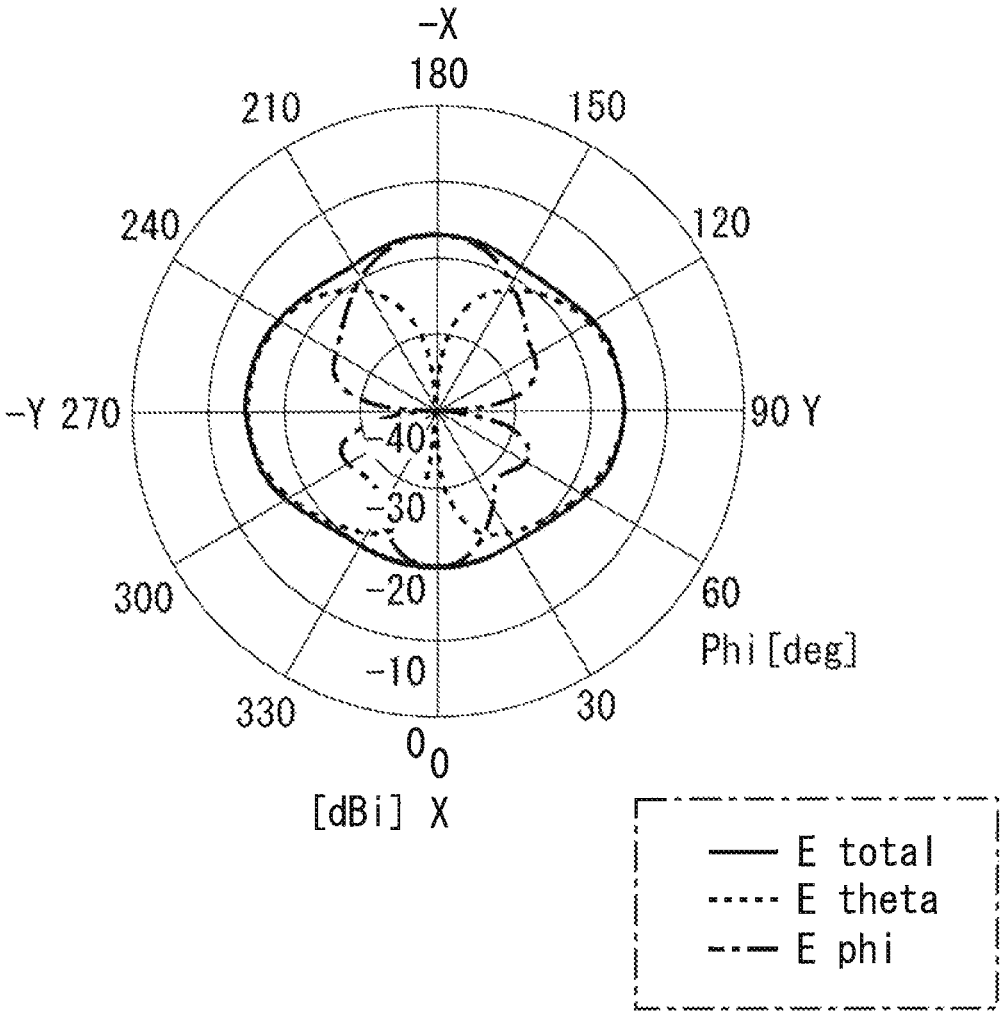
FIG. 39 is a graph illustrating the radiation directivity on the X-Y plane in the model 1.
Figure 40:
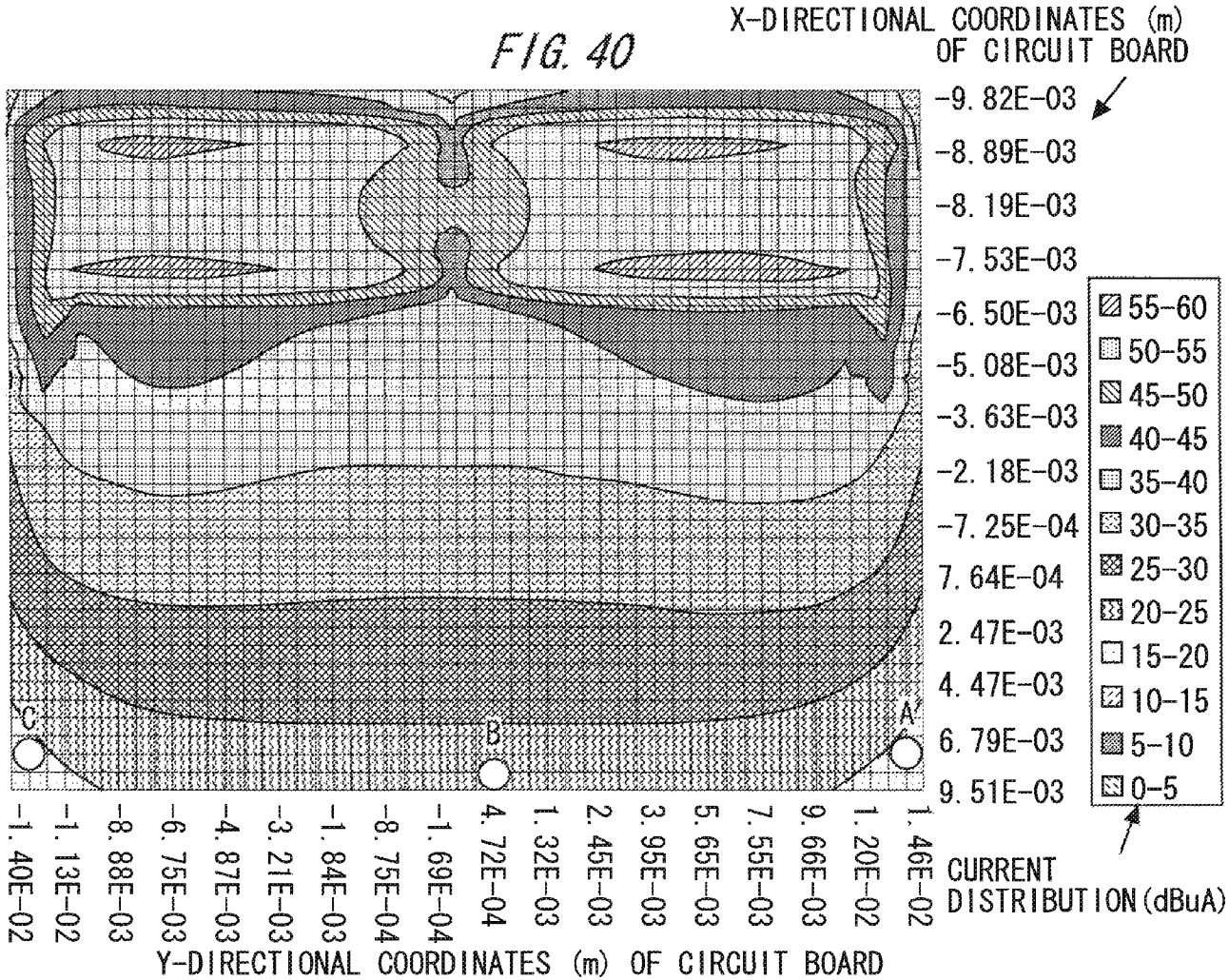
FIG. 40 is a graph illustrating the current distribution on the circuit board 30 in the model 1.

FIG. 39 is a graph illustrating the radiation pattern on the X-Y plane in the model 1. FIG. 40 is a graph illustrating the current distribution on the circuit board 30 in the model 1. In the model 1, i.e., the radiation pattern in a state where none of the obstacle exists in the vicinity of the sensor device 1, as illustrated in FIG. 39, the signals are radiated at approximately the same level of intensity in the +X direction and the −X direction, and also in the +Y direction and the −Y direction, respectively, from the circuit board 30 on the X-Y plane. The current distribution of the model 1 is that as depicted in FIG. 40, the maximum current flows in the position close to the antenna element 20, and the current becomes gradually smaller as the position gets away (in the +X direction) from the antenna element 20.

As a result, the positions A and C belong to the current distribution ranging from 15 [dBuA] to 20 [dBuA], and the position B belongs to the current distribution ranging from 20 [dBuA] to 25 [dBuA]. Hence, if the current value difference between the positions A and C falls within 5 [dBuA] and if the current value in the position B is larger than the current values in the positions A and C by its difference exceeding 5 [dBuA], the radiation pattern having approximately the same level of intensity in the +X direction and the −X direction, and also in the +Y direction and the −Y direction, respectively, can be specified as the present radiation directivity.

Figure 41:
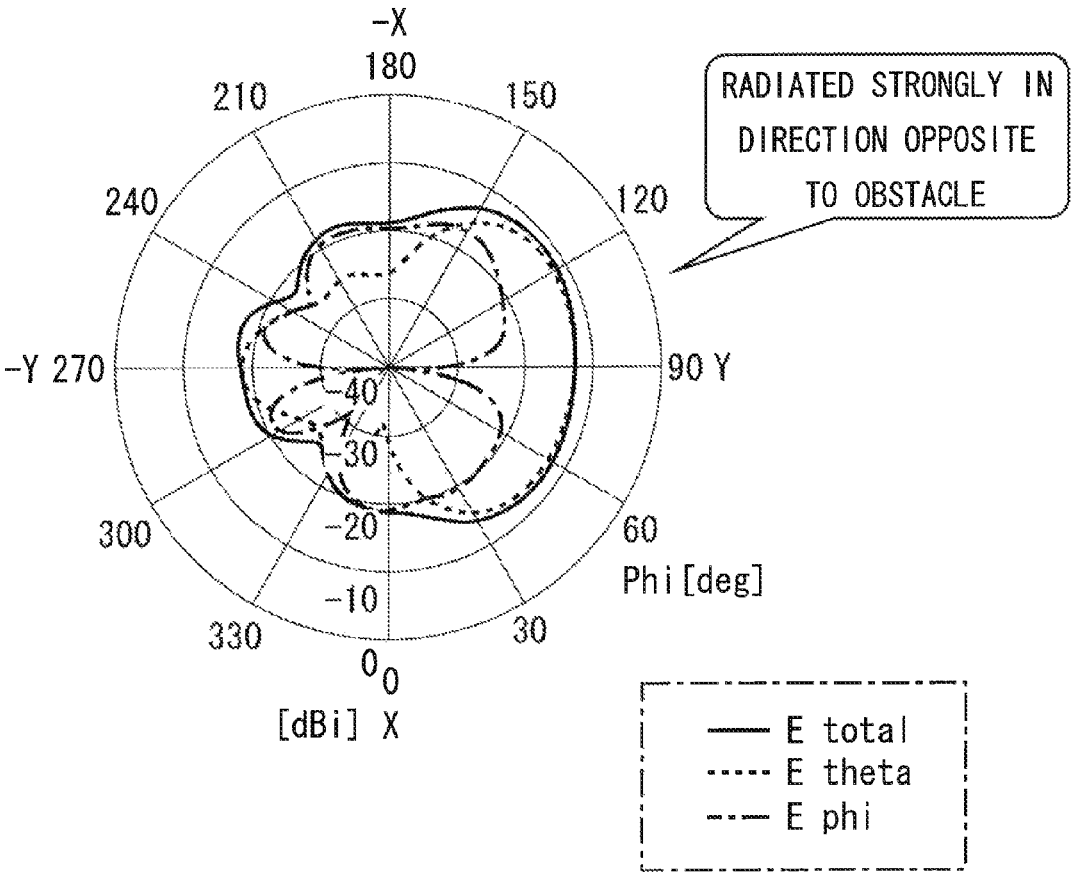
FIG. 41 is a graph illustrating the radiation directivity on the X-Y plane in the model 2.
Figure 42:
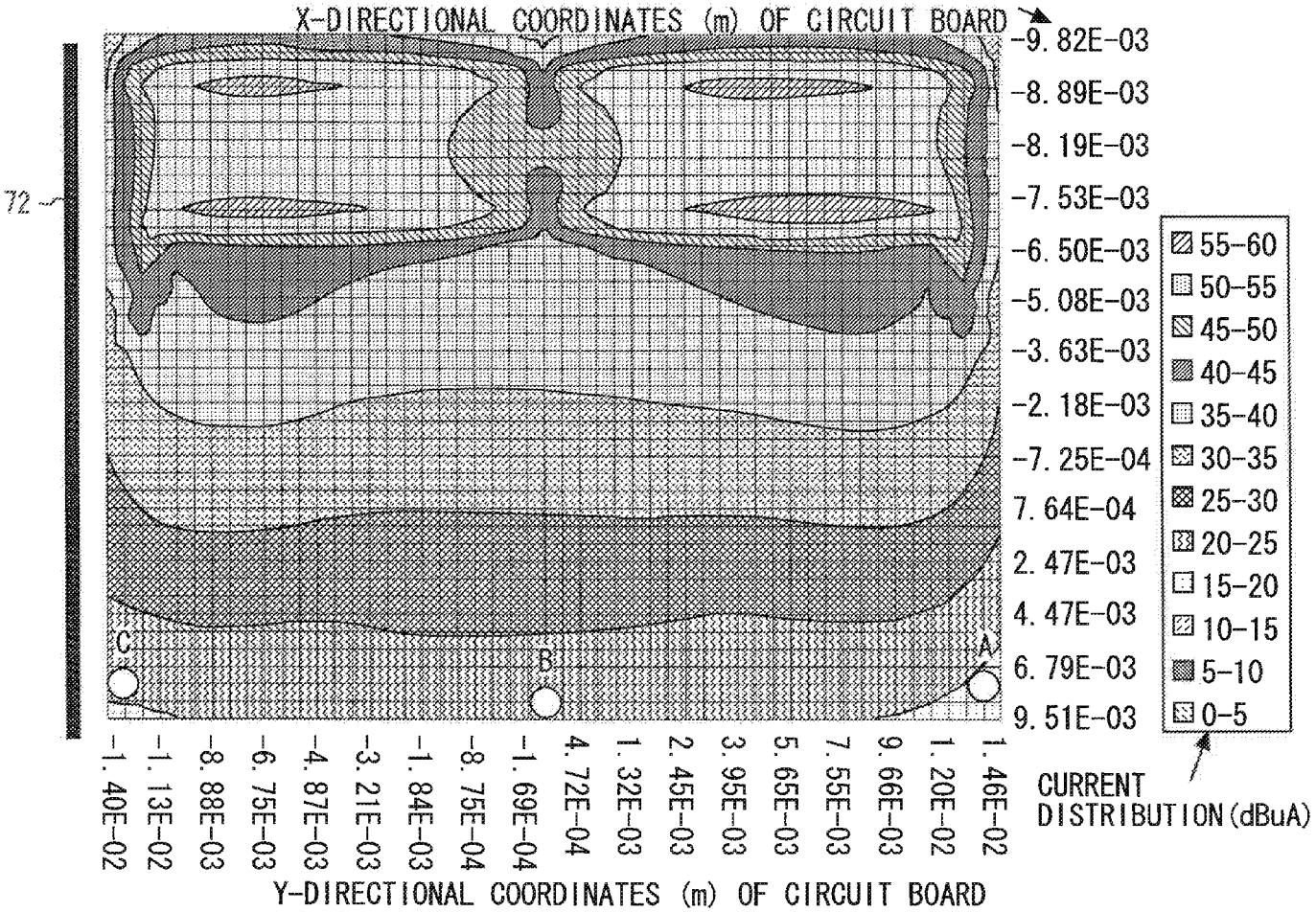
FIG. 42 is a graph illustrating the current distribution on the circuit board 30 in the model 2.

FIG. 41 is a graph illustrating the radiation pattern on the X-Y plane in the model 2. FIG. 42 is a graph illustrating the current distribution on the circuit board 30 in the model 2. In the radiation pattern of the model 2, the radiation is, as illustrated in FIG. 41, strong on the side (in the +Y direction) opposite to the position of the obstacle, but any remarkable bias of the radiation directivity is not seen in the +X directions. In the current distribution of this model 2, as depicted in FIG. 42, the large current spreads wider in the edge area spaced-apart from the obstacle and the antenna element 20 than in the model 1.

As a result, the positions B and C belong to the same current distribution (ranging from 20 [dBuA] to 25 [dBuA]), and the position A belongs to the current distribution ranging from 15 [dBuA] to 20 [dBuA]. Hence, if the current value difference between the positions B and C falls within 5 [dBuA] and if the current value in the position A is smaller than each of the current values in other positions B and C by its difference exceeding 5 [dBuA], the radiation pattern, which is strong in the +Y direction, can be specified as the present radiation directivity.

As discussed above, in the fourth working example, the antenna elements 20 are positioned in the edge area in the −X direction, and the direction of getting away from the antenna elements 20 is the +X direction, whereby the current distribution of each model is similar to the current distribution that is rotated through 90 degrees from each current distribution in the second working example. Moreover, the radiation directivity in the fourth working example is also similar to the radiation directivity in the second working example in terms of having the strong radiation characteristic in the direction opposite to the position of the obstacle except when the obstacle exists in the nearest position to the antenna element 20.

The same electromagnetic field simulations are conducted with respect to other models 3 through 7 in the same way as in the second and third working examples, and the following results are drawn out.

The model 3 has a relation in which each of the current value differences between the positions A, B and C falls within 5 [dBuA] and has the radiation pattern showing the strong intensity in the −X direction opposite to the position of the obstacle. The model 4 has a relation in which the current value difference between the positions A and B falls within 5 [dBuA] and the current value in the position C is smaller than each of the current values in the positions A and B by its difference exceeding 5 [dBuA], and has the radiation pattern showing the strong intensity in the −Y direction opposite to the position of the obstacle. In the model 5, the correlation of the respective current values in the positions A, B and C and the directivity of the radiation pattern are the same as those in the model 1. In the model 5, however, since the obstacle exists in the vicinity of the antenna element, the respective current values in the positions A, B and C are smaller than those in the model 1, and the radiation pattern is weaker on the whole than in the model 1. In the model 6, the correlation of the respective current values in the positions A, B and C and the directivity of the radiation pattern are the same as those in the model 1. In the model 6, the respective current values in the positions A, B and C are substantially the same as those in the model 1, however, the radiation pattern is weaker on the whole than in the model 1. In the model 7, the correlation of the respective current values in the positions A, B and C and the directivity of the radiation pattern are respectively similar to those in the model 1.

Owing to the results of the electromagnetic field simulation described above, the associative relation between the current distribution and the radiation pattern of each model as illustrated in FIG. 38 is acquired. According to the example in FIG. 38, the models 1, 5, 6 and 7 indicate the current distribution pattern 1 in FIG. 38 and the radiation pattern associated therewith. Similarly, the model 2 indicates the current distribution pattern 3 in FIG. 38, the model 3 indicates the current distribution pattern 2 in FIG. 38, and the model 4 indicates the current distribution pattern 4 in FIG. 38.

Thus, in the fourth working example, the number and the positions of the current sensors 31 are determined in a mode that does not distinguish between the models 1, 5, 6 and 7. The modes 5 and 6 have the weaker radiation directivity than in the models 1 and 7. The models 5 and 6 have no directional bias in the directivity, and hence the fourth working example adopts the mode that does not distinguish from the models 1 and 7. The number and the positions of the current sensors 31 may, however, be determined in the way of enabling the distinction between the models 1, 5, 6 and 7, respectively.

Accordingly, even in the case of using the antenna element 20 taking a further different configuration from those in the second and third working examples, the number and the installing positions of the current sensors 31 are determined in accordance with the configuration of the antenna element 20, whereby the same effects as those in the second and third working examples can be obtained. Namely, according to the embodiment, the change in radiation directivity corresponding to the obstacle can be detected without restricting the configuration and the position of the antenna element 20 on the circuit board 30.

[Others]

<Concerning Hardware Components and Software Components>

The hardware components are defined as hardware circuits and are exemplified by an FPGA [Field Programmable Gate Array], an ASIC [Application Specific Integrated Circuit], a gate array, a combination of logic gates, a signal processing circuit, an analog circuit, etc.

The software components are parts (segments or fragments) for realizing the processes as the software but do not imply concepts that limit languages and development environments for realizing the software. The software components are exemplified by a task, a process, a thread, a driver, firmware, a database, a table, a function, a procedure, a subroutine, a predetermined module of program codes, a data structure, an array, a variable and a parameter. These software components are realized on one or a plurality of memories (one or a plurality of processors (e.g., a CPU (Central Processing Unit), a DSP (Digital Signal Processor), etc).

It should be noted that each embodiment discussed above does not limit the methods of realizing the processing unit described above. It may be sufficient that the processing units are configured by the methods which can be actualized by the ordinary engineers in the field of the present technology as the hardware components or the software components or combinations of these components.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

What is claimed is:

1. A wireless communication device comprising:

a circuit board to include an antenna element;

an estimating unit to estimate a current distribution based on current values which are generated by power feeding to the antenna element on the circuit board; and a specifying unit to specify a radiation pattern indicating a directivity from the estimated current distribution on the circuit board on which the antenna element is disposed, by using pre-retained correspondence relation between current distribution patterns and radiation patterns.

2. The wireless communication device according to claim 1, further comprising a current detecting unit to detect a current on the circuit board, wherein the estimating unit estimates, as a present current distribution, any one of a plurality of previously-retained current distribution patterns on the circuit board by use of a current value detected by the current detecting unit, and the specifying unit specifies, as the radiation directivity of the circuit board, the radiation pattern associated with the current distribution estimated by the estimating unit in the plurality of radiation patterns associated respectively with the plurality of previously-retained current distribution patterns on the circuit board.

3. The wireless communication device according to claim 2, wherein the current detecting unit are a plurality of current sensors which are disposed in a plurality of different positions on the circuit board and detect the respective current values in individual positions, and the estimating unit retains a plurality of current distribution patterns associated with correlations of the respective current values detected in the different positions on the circuit board, and estimates any one of the plurality of current distribution patterns as the present current distribution by use of results of comparisons between the plurality of current values detected by the plurality of current sensors.

4. The wireless communication device according to claim 2, wherein the current detecting unit detects the currents in positions in which to make identifiable the respective current distribution patterns where the radiation patterns on the circuit board change corresponding to the plurality of current distribution patterns on the circuit board that are calculated by electromagnetic field simulations on the assumption that a living body is in contact with a lower surface of the circuit board and exists in a predetermined position from each side other than the lower surface of the circuit board.

5. The wireless communication device according to claim 2, wherein the current detecting unit, when the antenna element is installed in an edge area on the circuit board, detects the currents in a plurality of different positions in the other edge area, spaced-apart from the antenna element, on the circuit board.

6. A radiation directivity estimating method to estimate radiation directivity from a circuit board which includes an antenna element, the method including:

estimating a current distribution based on current values which are generated by power feeding to the antenna element on the circuit board; and specifying a radiation pattern indicating a directivity from the estimated current distribution on the circuit board on which the antenna element is disposed, by using pre-retained correspondence relation between current distribution patterns and radiation patterns.

7. The radiation directivity estimating method according to claim 6, further including detecting a current on the circuit board, wherein the estimating the current distribution includes estimating, as a present current distribution, any one of a plurality of previously-retained current distribution patterns on the circuit board by use of a detected current value, and the specifying the radiation pattern includes specifying, as the radiation directivity of the circuit board, the radiation pattern associated with the estimated current distribution in the plurality of radiation patterns associated respectively with the plurality of previously-retained current distribution patterns on the circuit board.

8. The radiation directivity estimating method according to claim 7, wherein the detecting the current includes detecting the respective current values in the plurality of different positions on the circuit board, and the estimating the current distribution includes estimating any one of the current distribution patterns, as the present current distribution, associated with the correlation of the respective current values detected in the different positions on the circuit board from within the plurality of previously-retained current distribution patterns.

9. The radiation directivity estimating method according to claim 7, wherein the detecting the current includes detecting the currents in positions in which to make identifiable the respective current distribution patterns where the radiation patterns on the circuit board change corresponding to the plurality of current distribution patterns on the circuit board that are calculated by electromagnetic field simulations on the assumption that a living body is in contact with a lower surface of the circuit board and exists in a predetermined position from each side other than the lower surface of the circuit board.

10. The radiation directivity estimating method according to claim 7, wherein the detecting the current includes, when the antenna element is installed in an edge area on the circuit board, detecting the currents in a plurality of different positions in the other edge area, spaced-apart from the antenna element, on the circuit board.

* * * * *